US005511793A

United States Patent [19]

Watt

[11] Patent Number: 5,511,793

[45] Date of Patent: Apr. 30, 1996

[54] COMPOSITE CHESS GAME AND METHOD

[75] Inventor: James S. Watt, Kapaa, Hi.

[73] Assignee: Quantum Development, Inc., Carson City, Nev.

[21] Appl. No.: 895,596

[22] Filed: Jun. 8, 1992

[51] Int. Cl.[6] ..... A63F 3/02

[52] U.S. Cl. ..... 273/260; 273/261

[58] Field of Search ..... 273/260, 261; D21/24

[56] References Cited

U.S. PATENT DOCUMENTS

| | | | |
|---|---|---|---|
| 937,796 | 10/1909 | Hallock | 273/260 |
| 1,628,412 | 5/1927 | Lesavoy | 273/288 |
| 3,608,904 | 9/1971 | Margetson | 273/137 R |
| 3,627,324 | 12/1971 | Krepp | 273/131 B |
| 3,677,550 | 7/1972 | Mathers | 273/137 R |
| 3,806,125 | 4/1974 | Bialek | 273/260 |
| 4,033,586 | 7/1977 | Corinthios | 273/260 |
| 4,095,801 | 6/1978 | Kembar | 273/260 |
| 4,234,188 | 11/1980 | Keegan | 273/290 |

FOREIGN PATENT DOCUMENTS

| | | | |
|---|---|---|---|
| 3611513 | 10/1987 | Germany | 273/288 |
| 318266 | of 1895 | United Kingdom | 273/260 |
| 2180765 | 4/1987 | United Kingdom | 273/260 |

OTHER PUBLICATIONS

Chess Variation by John Gollon, "Giveaway Chess I", pp. 230–231, Charles E. Tuttle Co., 1974.

H. Murray, A History of Chess, Oxford Press, 1913, pp. 341, 347.

J. Gollon, Chess Variations, Chas. Thomas, Rutland, VT., 1968, pp. 59–67, 177–187, 214–218, and 219–222.

A. Dickins, A Guide to Fairy Chess, Q Press, Richmond, (Surrey) England, 1969, pp. 8, 9, 31, 49, 65 and 66.

A. Dickins, A Short History of Fairy Chess, F. Bailey & Son, Dursley, England, 1975.

H. Davidson, A Short History of Chess, McKay, New York, 1981, pp. 102–107.

J. Capablanca, Brighter Chess, Why Changes Should Be Made, Chess Amateur, Nov. 1929, pp. 44–45.

E. Lasker, Chess Secrets I Learned from the Masters, pp. 427–428, D. McKay, New York, 1951.

*Primary Examiner*—Benjamin H. Layno

[57] ABSTRACT

Five related strategy type board games which are variations of conventional chess. Two are generic versions which can be played on sixteen square to sixty-four square boards using only simplex pieces: rooks, bishops, and knights; and duplex pieces: princess, crown-prince, and archbishop which are composites of two different simplex components and possess their dual powers. A third version played on a one hundred square board, includes three pairs of simplex playing pieces: rooks, bishops, and knights; three different types of duplex playing pieces: archbishop, crown-prince and queen, are all composites of two different simplex components; plus a king and ten pawns. Pawns have increased powers of movement, cannot be converted to queens, but can liberate captured pieces and possibly be knighted in the process. The crown-prince may succeed to the throne when the king has been annihilated, permitting the contest to continue. The fourth and fifth versions are played on one hundred forty-four square boards using four different types of simplex pieces: rooks, bishops, knights, and bowmen; six different composite duplex pieces having dual options: princess, duke, marquess, earl, viscount, and baron; four different composite triplex pieces having triple options: queen-II, crown-prince-II, counsellor and archbishop-II; twelve pawns; king-II, and court-jester that can exchange places with other pieces including king-II. All five versions can be played on a color-coded multi-perimeter gameboard comprised of six concentric square playing surfaces with marginal indicia.

24 Claims, 32 Drawing Sheets

COMPOSITE CHESS GAME AND METHOD

I) BACKGROUND—FIELD OF THE INVENTION

The present invention relates to a strategy board game, particularly to variations and improvements in the conceptual, structural, and methodological aspects of the game of chess.

II) BACKGROUND—DESCRIPTION OF THE PRIOR ART

A) The History of Chess:

The game of chess has undergone a remarkable evolution during the past fifteen hundred years. The actual time and place of origin of the game will probably never be known with any degree of certainty. Some of the most credible chess historians (H. J. R. Murray, and R. Eales) have established that the game first began in northern India around 600 A.D., being played upon an eight by eight square checkered gameboard with two contrasting armies, each having four divisions (two chariots, two cavalry, two elephants, and eight infantry) which are headed by a field marshal and a king. Other notable historians (J. Needham, and A. Dickins) have disputed this claiming recent evidence for the origin of a prototype chess game in China in 569 A.D. comprising various astrological symbols which were cast upon the board for divinatory purposes. However, Eales strongly disputes this claim by maintaining that this "prototype" does not meet the requirements to qualify as a true chess game, which are essentially, with minor modifications: 1) a game of strategy requiring thoughtful consideration as opposed to chance, 2) two contrasting equally matched forces, and 3) each contrasting force comprising the same different elements.

Although the "prototype-chess" game, which was called "image-chess" or hsiang chhi was based on astronomical elements used for divination purposes, had been documented in China as early as 561–576 A.D., the first known recorded evidence for the existence of a true chess game in China meeting the above criteria is not until around 762 A.D., or about one hundred fifty years after the first recorded evidence of chess existing in India. However this fact alone does not necessarily preclude the possibility of the game's origin in China, and there are some rather compelling reasons to consider this yet as a real possibility.

The Persians acknowledged their reception of the game of chess from India sometime between 531–579 A.D., but there are only four references to chess in all of Indian literature prior to 1000 A.D. which remain in existence today, with the two earliest of these being about 600 A.D. and 625 A.D.

When the Arabs conquered Persia in 640 A.D., Islamic culture had it's first encounter with chess, and except for a few prior references to the game in their literature, the very first known chess books that actually describe how the game was played were written in Arabic and did not appear until about 850 A.D. It then took another two hundred years before the first references to chess were documented in Europe.

Every time the game was transmitted to a different culture major transformations occurred in either the gameboard, the playing pieces, or the method of play. However, there is no record in China acknowledging the receipt of the game from India, as was the case in Persia. Whether the game was transmitted from India to China, or from China to India, the most radical changes in the development of the game occurred between these two cultures.

The Chinese chess piece movements were as follows:

A. The Ku (castle/rook) moved orthogonally just like the modern rook.

B. The Ma (horse/knight) moved one square orthogonally and one square diagonally but did not jump over intervening pieces.

C. The Kin (elephant/bishop) could move only two squares diagonally and without jumping.

D. The Phao/Pao (incendiary archers/cannon) were additional pieces positioned medially to the Kin. Although they could move like a rook, in order to capture an opponent they had to fire over another piece on lines orthogonal to it. Although gunpowder was not invented until about 900 A.D. and the cannon was not in use until around 1200 A.D., simple bombs or grenades were thrown from trebuchets or mangonels by 1000 A.D., but various incendiary substances including naphtha were ignited and launched airborne with bows and arrows before chess was invented. Since all projectile devices of this nature were originally termed Phao from whence Pao is later derived it seems probable that the earliest form of this piece represented some type of incendiary archer or launcher, which would be consistent with the radically different type of capturing movement permitted this piece, which specifies moving orthogonally during any turn but having to fly over a first piece in order to glide to and capture a second piece, which is the next piece in a straight line beyond the first piece.

E. There were six Kia (infantry/pawns) which were positioned on the lines between the third and fourth ranks, and they moved only forward like pawns until they crossed a river which ran through the middle of the board between the two forces, beyond which they could move one square forward or laterally, either just to move or to capture an opponent.

F. The Swai (counsellor) started the game by occupying the middle back line intersection within the emperor's palace which was comprised of a block of four squares having nine line intersections or possible piece positions. The Swai could move only one square diagonally and could not leave the palace area.

G. The Shang (emperor/king) began the game at a position in the center of the palace and immediately in front of the Swai. The Shang could move only one square orthogonally and also could not leave the palace area. A Shang could not be moved to the same orthogonal line as an opposing Shang unless there was an intervening piece on the board.

Now, if chess passed from India to China, the Indian chess game would require the following changes:

A) invention of a radically different gameboard probably derived from the more ancient game of "Go" or wei chhi dating back to at least 100 A.D. and perhaps as far back as 400 B,C. ("Go" was played by two players, each with one hundred fifty similar pieces or "stones", upon the intersections of the outlines of the squares of a nineteen by nineteen square board, providing four hundred placement options, instead of being played upon the squares themselves), with the new gameboard being ten by ten squares providing eleven by eleven intersecting lines having one hundred twenty-one placement options, B) creation of a four square palace area centered at the first and last two rows, within which the king and his adviser were each confined to one of only nine positions shared between them, C) introduction of a different type of playing piece, the Phao or incendiary archer or launcher, or later the Pao or cannon, which moved orthogonally like a rook, and also captured orthogonally but only by flying over a first piece to capture the second piece in the same line of squares as the first piece, D) reduction of the number of infantry from eight to six, E) creation of a river which divided the board into two equal halves, and which the infantry had to cross before they could move laterally to capture, F) elimination of the jumping ability of the horse/knight, and G) elimination of the one square diagonal movement or half of the potential movement of the king.

Now, on the other hand, if chess passed from China to India, the Chinese chess game would require the following changes:

A) reduction of the gameboard from an eleven by eleven intersecting line board to the checkered eight by eight square ashtapada board, with the game being played upon the squares, B) elimination of the river, C) elimination of the palace area and the confinement of both the king and his adviser, D) elimination of the Phao/Pao or incendiary archer/cannon, E) addition of two infantrymen to complete a row of eight squares, F) giving the horse/knight the ability to jump, and later also giving the elephant the ability to jump, and G) giving the king the added ability to move one square diagonally.

Of these two alternative possibilities, the transmission from China to India seems more probable. It seems highly improbable that if the Chinese had imported the game from India that they ever would have terminated the ability of the horse/knight to jump). This "theory" should in no way discredit the Indians, but rather it actually credits them for making some of the most important advances in this most dynamic of all board games in the course history.

Therefore, if in fact, the Chinese chess game reached northern India by the seventh century where it was called chaturanga, meaning an army of four parts (elephants, chariots, cavalry, and infantry), and also it now began to be played with the pieces centered within the squares of the smaller eight by eight square checkered ashtapada board (which had been used previously in India to play many different games), but without the Chinese fifth division or Phao/Pao or archer/cannon. Infantry were increased from six to eight and were moved back from the third/fourth rank lines to the second rank squares and the cavalry were allowed to jump over intervening pieces for the first time just like the knights of contemporary chess. The elephant (which later becomes the bishop) also was permitted to jump two squares over a diagonally adjacent piece. The king was permitted to move not only one square orthogonally, but now also one square diagonally, and furthermore was no longer restricted to the palace area. The Phao/Pao (archer/cannon), the river, and the palace areas of the original Chinese game were all eliminated when the game began to be played on the smaller ashtapada board. Although the Chinese archer/cannon or Phao/Pao , which was the only piece that could pass over intervening pieces, was probably dropped from the game because the Indians did not have sufficient space for all of the Chinese pieces on the ashtapada board when the game was introduced, the concept of the ability to pass over another playing piece was still utilized but transferred to both the horse (knight) and also for a time to the elephant (bishop) in the Indian chess game.

During the Muslim period, around the ninth century, the Alfil/Talia (elephant/scout/later bishop) was now also permitted to glide after the two square jump diagonally. By the thirteenth century, in medieval Europe, the elephant was gradually converted to a courier or runner (Germany and the Netherlands) which lost the ability to jump but could now move any number of squares diagonally. In Britain and Iceland this piece became the bishop, but in France it was called the fool or jester.

In medieval Europe about the fourteenth century (because of an error of translation of fierge meaning counsellor being mistaken for vierge meaning virgin), the counsellor became converted rather astonishingly into a queen but still had the power to move only one square diagonally. Later, for a short time, the queen was also permitted one leap (like the knight) during a game, but this was soon dropped when near the end of the fifteenth century, the queen was granted her enormous powers by combining the power of the rook and the bishop which opened the game up dramatically. However, the queen's power so outweighed the power of the other pieces that unilateral loss of the queen usually resulted in defeat.

The pawn (foot-soldier) originally could move only one square forward (and captured by moving one square diagonally forward) but in the sixteenth century a one or two square move forward was permitted, but only for the first move of every pawn from the initial pawn ranks. This was done in order to hasten the opening development of the game, and the en passant rule which soon followed (which provides the option to capture a passing adjacent pawn having made a two square move) thereby preventing the avoidance of capture by opposing pawns, which helped to limit abuse of the initial two square move from the second or seventh pawn ranks.

The pawn promotion rule had a history of stormy conflict during the seventeenth and eighteenth centuries as various experts heatedly disagreed between (a) the promotion of pawns reaching the eighth or first last ranks only to a previously captured piece, and (b) the unlimited promotion of pawns reaching the last ranks to a queen. By the nineteenth century, the unlimited promotion to a queen became almost universally accepted (largely because of the preferences expounded a book of chess written by Philador who was the best chess player at the time) in spite of the absurdity of converting a foot-soldier into a queen and the ridiculous possibility of having two or more queens on a given side simultaneously.

Since the adoption of the stalemate rule in the early nineteenth century (when a king, that is not in check, must be moved, but can not do so without moving into check: which ends the game in a draw), the structure and methodology of the game of chess has been essentially unchanged, with most experts believing the game has reached perfection and cannot be improved upon. So the contemporary version of chess has resisted any further changes for the past one hundred seventy years.

B) Other Attempted Revisions of Contemporary Chess:

Numerous people, throughout the world, have suggested various revisions of the game, a few of which have gained limited acceptance but most have been rejected and not implemented. These revisions have usually taken the form of increasing the size of the board or inventing new pieces. There have been three notable proposed modifications of chess structure which utilized a ten by ten square board: (1) Arch (European origin) which added two pieces, a centurion (which combined the moves of knight and king) and a decurion (which moves one square diagonally), (2) Attama (Arabic origin) which added one piece, the camel (which moves two squares diagonally) and (3) Complete (Moslem origin) which also added one piece, the sow (which moves like a king). However, none of these inventions combined either the moves of the rook and knight or the bishop and knight.

Foster (U.S.A.) invented chancellor chess which added a chancellor (combining the moves of the rook and knight). This invention was played on a nine-by-nine square board having eighty-one squares. However, the difficulty with this arrangement is that there are an unequal number of light and dark squares on the board and every corner square is of the same color, which greatly distorts the balance and symmetry of the minor pieces and requires that the bishop and knight on the king's side exchange starting positions in order to place bishops on opposite colored squares.

There have been three notable chess innovations which combined the moves of the rook and knight and also combined the moves of the bishop and knight, but they all utilized eight by ten square asymmetrical boards. These inventions were: (1) Bird's (English) which added two pieces, the guard (which combined the moves of rook and knight) and the equerry (which combined the moves of bishop and knight), (2) Carrera's (Italian) which added two pieces, the champion (which combined the moves of rook and knight) and the centaur (which combined the moves of bishop and knight) and (3) Capablanca's (Cuban, world champion 1921–1927) and Lasker's (German, international grandmaster) invention which actually only slightly modified Bird's invention by moving the two new major pieces away from the king and queen by placing them between the bishops and the knights and designating them with different names, the chancellor and the cardinal, the game otherwise was played by the conventional rules of chess. However, the problem with an asymmetric board is that diagonal moves from opposite corners cannot be accomplished in less than three moves instead of just one move, as is possible on symmetrical thirty-six, sixty-four, one hundred or one hundred forty four square boards. Consequently, this asymmetrical design is very unfavorable for bishops and to a lesser degree also for the queen, which detracts from the balance and global dynamics of the game.

Several United States and foreign patents have issued or applied for, which disclose various suggested modifications to contemporary chess:

U.S. Pat. Nos. 4,033,586, Jul. 5, 1977, and Re. 32,716, to Michael Corinthios, disclose a variation of chess called grandchess, having a nine by nine (eighty-one square) board with the elimination of the queen and the substitution of two princes that have the same moves as the queen of traditional chess. This setup puts all bishops on the same color of squares and has one additional pawn. The addition of two princes does little to balance forces on the board compared with the great disruption of balance and the general dynamics of play caused by a) the same asymmetrical board problems referred to above, and b) not one bishop can move on half of the board squares (dark squares), which produces a greater distortion of symmetry of the game than is inherent in the conventional chess game originally.

U.S. Pat. No. 4,778,187, Oct. 18, 1988, to Joseph Deak, Jr., discloses a method of playing a chess game on a modified enlarged board of one hundred ninety two squares with two to four sets of different colored conventional chessmen played by two to four players by conventional rules. Except for allowing more than two players to play simultaneously, this invention adds little except to unnecessarily complicate the game and to unduly prolong the contest on an excessively large gameboard which requires thirteen moves for a pawn to reach the last rank as opposed to five moves in conventional chess.

U.S. Pat. No. 4,932,669, Jun. 12, 1990, to John Perry, discloses a method of playing a multiple player chess game on an enlarged board of one hundred sixty squares. Pawns may change direction ninety degrees after making a capture diagonally to one side. Pawns have direction indicators. Otherwise the game is played conventionally by two to four players. While allowing more players to compete simultaneously and having a novel pawn move, the invention has primarily just a greater number of conventional pieces, a peculiar cross shaped board having a greater number of squares and a game which is unnecessarily complicated by simply multiplying the numbers of conventional pieces which also tends to greatly prolong the games.

U.S. Pat. No. 3,806,125 Apr. 23, 1974, to Norman Bialek, refers to a modified chess game comprised of stackable pieces in the form of uniform slabs or blocks having indicia on their upper and lateral flat surfaces which designate the type of chessman each represents and colored markers or background colors on opposite lateral surfaces indicate ownership of each block when in stacked positions. The blocks can be stacked vertically upon each other in any number or in any order. The blocks can also be unstacked. The game is played on an extremely small board of only nine or sixteen squares by two players. The game is intended to be played three dimensionally as well as two dimensionally so that players can stack an unlimited number of their own pieces on one square. Players can only capture single pieces in the conventional manner or just the top piece in the case of a stack of an opponent's pieces. All of the blocks merely represent conventional pieces and a rather vague and incomplete three dimensional method of play is mentioned in the specifications. This invention loses much of the interesting two dimensional dynamics of conventional chess by a rather inadequate attempt to project the game into a three dimensional framework.

U.S. Pat. No. 3,843,130, Oct. 22, 1974, to Karl Whitney, Jr., describes a modified chess game for two, three or four players with a board of one hundred thirty six squares which utilizes double the conventional number of chesspieces plus two additional royal pieces (knights) on each of four different sides which are initially positioned on two remote squares directly behind the king and queen. A peculiar irregular gameboard and an increased number of knights. Four players may play as partners or as individuals according to basically conventional rules. Pawns require nine or ten moves to reach the last rank which greatly diminishes their power and utility.

U.S. Pat. No. 4,856,789, Aug. 15, 1989, to Richard Carlson, discloses a chess type game for opposing two man teams, each team having essentially two sets of chess pieces but only one king, each set also having one less pawn. Each of the resulting two teams having one new additional piece called a warder placed in front of the shared king, which moves within a limited nine square area like a super pawn to protect the king. The otherwise conventional pieces play on a twelve by fifteen square board utilizing a slightly variant method of play. Pawns require nine moves to reach the last rank as opposed to just five moves in conventional chess which diminishes their relative strength and value considerably.

U.S. Pat. No. 4,234,188, Nov. 18, 1980, to Robert Keegan, discloses a modular chess set for a conventional chess game where the kings, queens and rooks, are constructed from modular pawns, knights and bishops by interlocking stacks of two or more of these basic modular pieces (pawns, bishops and knights) having a cruciform shape with a central projection and a central opening. Fundamentally, the invention is supposed to provide a way of creating the an entire conventional chess set from three modular units and also have the advantage of enabling the creation of a second queen from modular components if needed during a game. The structure of the modular components is one of cruciform horizontal cross-sectional shapes, one of which is shaped for engagement and disengagement with two different sizes of other cruciform shapes to form the various additional modernistic but otherwise conventional chess pieces.

U.S. Pat. No. 4,095,801, Jan. 20, 1978, to Ross J. Kembar, discloses a thirty-two piece chess set for a conventional chess game with the height of each piece signifying its relative importance and the cross-section of each piece indicating its direction of movement. Pieces have a constant cross-section throughout their length. Bishops are five sided polygons, knights are "L" shaped polygons, rooks are four sided polygons having a vertical square notch in each side, pawns are short four sided polygons without vertical notches, queens are eight sided polygons, and kings are tall four sided polygons. The shapes of rooks, bishops, knights and pawns enables them to be vertically nested for storage when not in use and for shipment as a compact package. Vertical nesting is temporary and not related to the operation of the pieces or to the play of the game.

U.S. Pat. No. 3,677,550, Jul. 18, 1972, to Ronald A. Mathers, discloses a set of chessmen for a conventional chess game the various pieces, except for kings, having uniform cross-sections which are linearly symbolic of their mobility on a chessboard. The cross-sections of rooks look like two "I" beams intersecting at right angles, bishops look like "+"s or "×"s depending depending upon positioning upon board squares, knights look like "Y"s, pawns look like "L"s, and queens look like two bishops intersecting at forty-five degrees off center to each other like an eight pointed asterisk. Kings are cylindrical tubes having circular cross-sections. There are no frames of reference for the various pieces.

U.S. Pat. No. 1,628,412, May 10, 1927, to Isadore L. Lesavoy, discloses a set of chessmen for a conventional chess game the various pieces carrying numerical indicia signifying their relative sacrifice value and directional indicia suggesting possible movement. The directional indicia are mostly directional arrows superimposed upon a background grid representing considerable and various numbers of checkered squares of the chessboard. The directional indicia of the knight are different from the other pieces by having no directional arrows but rather a complex symbol of four "Y"s conjoined at the base of each "Y" with each other, so that the stem of each "Y" being in line with the stem of one other "Y" as mirror images of each other, with each such pair being at right angles to the other pair in similar alignment, with the ends of each "Y" branch terminating in a circular dot signifying termination of direction, and with the entire complex symbol being projected upon a twenty-five square grid for orientation of the complex knight movement upon the chessboard. The various pieces do not employ a single common square frame of reference and the indicia are not simple concentric geometric symbols.

U.S. Pat. No. 3,608,904, Sep. 28, 1971, to Desmond W. Margetson, discloses a set of reversible chess pieces of identical size for a conventional chess game having on one side the name and letter symbol of the piece, and the name and move on the other side. Each side surface of each piece bears two respectively inverted letter indicia to further identify each different piece. The directional indicia of pawns shows arrow vectors designating movement, "×"s at the ends of vectors indicating capturing ability, and a background grid of four squares for orientation on the chessboard. The knight piece has eight broken-line "L" shaped vectors indicating direction of movement terminating with "×"s indicating capturing ability, upon a background grid of twenty-five squares for orientation. The bishop and rook pieces each have four diagonally and four orthogonally oriented vectors terminating with "×"s indicating their respective movement and capturing abilities. The queen piece has eight equal length vectors arranged diagonally and orthogonally and terminating at "×"s thereby indicating possible movement and capturing ability. The king piece is similar to the queen but has shorter vectors. The various pieces do not employ a single common square frame of reference and the indicia are not simple concentric geometric symbols.

U.S. Pat. No. 3,627,324, Dec. 14, 1971, to James B. Krepp, discloses a chess type game having circular pieces with directional indicia comprising arrows. Pawns have one directional arrow, bishops have two opposite direction arrows, and rooks have two sets of opposite direction arrows. These three pieces are permitted rotational moves that allow them to have alternative movements not permitted in conventional chess so that alternatively pawns can move laterally, bishops can move orthogonally, and rooks can move diagonally. Although this invention may increase the diversity of movement of these three pieces, it also destroys the specificity of the bishop and the rook pieces, since they both are capable of the same type of movement and capturing patterns. The various pieces do not employ a single common square frame of reference and the indicia are not simple concentric geometric symbols.

U.K. Pat. No. 318,266, Dec. 26, 1895, to Francis Moody, discloses a one hundred square board with the addition of two squires which are positioned between the knights and the rooks. The squires move something like knights but always stay on squares of the same color by moving either three squares orthogonally and one square at right angles or two squares orthogonally and two squares at right angles. The number of pawns are increased from eight to ten and they are also permitted an initial move of one, two or three squares. While the new piece does increase the complexity of the game a bit, it reduces the relative strength of pawns by requiring a minimum of seven moves to reach the last rank instead of just five in conventional chess.

U.K. Published Patent Application No. 2,180,765 A, Apr. 8, 1987, to Adrian Ciobotaru, relates to a chess set design which suggests the pattern of movement of the different pieces which are manipulated on a conventional chess board of sixty-four squares. The chessmen are designed to illustrate the role each piece plays in the game and the particular shapes are derived analytically from the method and range of displacement on the board. Each type of piece is given very specific geometric and relative proportions.

German Published Patent Application No. DE 3,611,513 A1, Apr. 5, 1986, to Peter Abbeck, discloses various means to provide stackable chess pieces with primary means being a hole in the center of their bases and a protuberance on the head of each chess piece so that two, three or more pieces can be temporarily stacked upon each other to form a unit which is readily detachable. Pieces are stackable in multiples and in any combination. In the description, the inventor states that the intention of the invention is to enable any piece that captures an opponent's piece to be combined with the captured piece in this manner, in order to obtain the moving and capturing possibilities of both pieces. The capturing piece remains on top of the captured piece of the opposite color. The pieces are separated again at the end of the game and the procedure repeats with each game.

C) Revisions and the Resistance to Revisions:

It is apparent from the foregoing paragraphs that the game of chess has had a long and gradual evolutionary history to reach its contemporary form. Historically, major changes in the game often occurred suddenly after centuries of relative stability. For example, the sudden development of the mad queen in the fifteenth century radically altered the game in a very positive and dynamic way.

It is astonishing that while both Capablanca and Lasker (who were both world champion chess players) considered their variation (which was referred to previously) to be vastly superior to conventional chess, their version never became established. The reasons for this are probably due to (a) major difficulties associated with asymmetrical boards as previously mentioned, (b) difficulty relating the identity of two new major pieces with their respective complex moves, and (c) general inertial resistance to changing a firmly established game entity.

Many different variations in (a) board sizes or configurations, (b) types of playing pieces and their design and (c) the method of rules of play have been proposed by many people throughout the world during the past seventeen or eighteen hundred years, but only a very small fraction of these proposed innovations ever became incorporated into the game of chess and some of them for only a limited period of time. In spite of the relative static state of contemporary chess for the past one hundred seventy years, it will undoubtedly evolve further with time.

D) Disadvantages of the Various Proposed Revisions:

1) The greatly enlarged gameboards, while being capable of accommodating more than two players at simultaneous play, greatly distort the relativity of the pieces to each other in terms of their relative strength or power and to the gameboard itself. While the complexity of the game is increased primarily by the sheer increased number of playing pieces and the increased number of squares, the overall balance and dynamism of the game suffers, the games take excessive time to play and interest in this type of game is not sustained for long.

2) None of the previously mentioned inventions substantially improve the game of chess because they also simultaneously sacrifice something which is critically important from a balanced schematic frame of reference. This is especially true for all those inventions utilizing asymmetrical gameboards, such as eight-by-ten or ten-by-twelve boards, since pieces like the queen and the bishop can no longer traverse the board on the diagonal to an opposite corner in one move, but they now require two or three moves to accomplish this.

3) The odd numbered symmetrical checkered gameboards, such as nine-by-nine or eleven-by-eleven square boards, disturb the balance of the bishops because there are an unequal number of light and dark squares and more importantly it forces a radical change in the starting position of one of the bishops in order to place them on opposite colored squares or failure to do this results in a peculiar game where all the bishops operate only on squares of the same color and restricts them collectively to operate on approximately only half of the gameboard.

4) Most of the newly invented pieces add little to the game except for the pieces combining (a) the bishop and the knight and (b) the knight and the rook, However in the inventions where these pieces were employed, the overall success and significance of these innovations suffered from: (a) the lack of the appropriate size of the gameboard, (b) the lack of a more advantageous structural conceptualization of the pieces and (c) the lack of sufficient modification of the rules to create a completely integrated system having the proper balance of forces within an optimal space to generate a more dynamically interesting and intellectually stimulating game.

E) Relevant publications relating to the historical evolution of the game of chess, and proposed variations of the game:

1) H. J. R. Murray, *A History of Chess,* Clarendon Press, Oxford, England, 1913.

2) John Gollon, *Chess Variations,* Charles Tuttle, Japan and Rutland, Vt., 1968.

3) A. S. M. Dickins, *A Short History of Fairy Chess,* (by the author), Kew Gardens, England, 1975.

4) Henry Davidson, *A Short History of Chess,* McKay, New York, N.Y., 1981.

5) Richard G. Eales, Chess, *the History of a Game,* Facts on File Press, New York, N.Y., 1985.

III) OBJECTS AND ADVANTAGES OF THE INVENTION

Accordingly several objects and advantages of the present invention are:

A) Providing the essential requirements of a true chess game: 1) a game of pure strategy requiring thoughtful consideration as opposed to luck and chance, 2) two contrasting equally matched forces, 3) each contrasting equivalent force comprising different elements; and now herewith greatly enhancing the dynamic complexity of the game by adding a fourth criteria: 4) the different elements comprising a) at least three different types of simplex symmetrical geometric configurations, each different type of simplex symmetrical geometric configuration indicating one specific different movement and capturing potential, and b) at least three different types of duplex symmetrical geometric configuration, each different type of duplex symmetrical geometric configuration comprising two of at least three different types of simplex symmetrical geometric configurations, thereby each different type of duplex symmetrical geometric configuration indicating two alternative specific different movement and capturing potentials.

B) A chess-type strategy game with a composite multiple gameboard playing surface and additional composite playing pieces to enable the playing of a hierarchy of games of differing size and complexity.

C) The utilization of several new powerful playing pieces giving better balance and dynamism to the game by counterbalancing the excessive power of the queen.

D) Different playing piece design concepts, both representational and functional, which enable players to visualize more easily both the simpler movements of the simplex playing pieces and the more complex alternative movements of the composite duplex playing pieces.

E) New methods of play involving a few major rule changes and innovations:

1) Knights can liberate captured pieces by reaching last rank corner squares.

2) Pawns are given greater mobility and consequently greater capacity to reach the last ranks to liberate captured pieces, which is essential on an enlarged gameboard and creates a more dynamic game.

3) Restoration of a more rational perspective to the game, since pawns can no longer become queens, and having two or more queens on one side is now impossible.

4) The new game adds greater dynamic realism to the game, since crown-princes can ascend to the throne (become new-kings) and pawns (foot-soldiers) can be knighted (become knights) for liberating captive pieces.

5) Both pawns and knights can liberate certain captured (captivated) playing pieces, but cannot liberate certain other captured (annihilated) playing pieces.

F) An alternative method of scoring games involving:

1) A diverse hierarchy of numerical values for all the different playing pieces.

2) A further differentiation of the status of captured playing pieces to: a) captivated, and b) annihilated.

3) An alternative scoring system which reflects the degree of victory and the degree of defeat.

G) A functional symbol variation idealy suited for two-dimensional computerization of the game.

H) Further objects and advantages will become apparent from a consideration of the description and the drawings.

IV) SUMMARY OF CLAIMED INVENTION

Accordingly, the present invention provides several different versions of chess-type strategy games of various degrees of complexity, which are played upon a multiple concentric perimeter checkered gameboard playing surface, which utilize several different types of simplex and composite duplex playing pieces comprising simplex symmetrical geometric configurations and duplex symmetrical geometric configurations, respectively, in two basic forms or styles: 1) representational, and 2) functional. The representational style playing pieces comprise at least three different types of simplex (single-tier) configurations having different movement and capturing potentials, and various combinations of two of at least three different types of simplex (single-tier) configurations which are permanently and vertically stacked upon each other, thereby creating at least three different types of composite duplex (double-tier) configurations having two different alternative movement and capturing potentials. All of these composite duplex configurations are equally potentially vulnerable to each other.

The most simple version of the game has playing pieces which comprise three different types of simplex (single-tier) configurations, and three different types of duplex (double-tier) configurations.

The most complex version of the game has playing pieces which comprise four different types of simplex (single-tier) configurations, six different types of duplex (double-tier) configurations, and four different types of triplex (triple-tier) configurations.

Several improved methods of play and many different and more dynamic playing pieces generate several different and more interesting chess-type strategy games.

Additionally, several different variations of functional style playing pieces comprise several similar simplex structural forms, each having one different type of simplex functional symbol indicating the different functional operations of the various simplex playing pieces, and several similar duplex structural forms, each having two different types of simplex functional symbols which are superimposed concentrically upon each other creating different types of duplex functional symbols indicating the different functional operations of the various duplex playing pieces, and several similar triplex structural forms, each having three different types of simplex functional symbols which are superimposed upon each other creating different types of triplex functional symbols indicating the different functional operations of the various triplex playing pieces.

Finally, these same simplex, duplex, and triplex functional symbols provide the basis for simplified computer versions of all the various different chess-type strategy games.

V) BRIEF DESCRIPTION OF THE DRAWINGS

FIG. 1 is a top plan view of a composite, symmetrical, one hundred forty-four square, multiple-concentric-perimeter checkered gameboard playing surface, having different color-coded perimeter lines, for use with five described versions (V1, V2, V3, V4, and V5) of the chess-type strategy game.

FIGS. 2A, 2B, and 2C are respectively side, front and top plan views of a first-simplex representational playing piece or rook for use with five described versions (V1, V2, V3, V4, and V5) of the chess-type strategy game.

FIGS. 3A, 3B, and 3C are respectively side, front and top plan views of a second-simplex representational playing piece or bishop for use with five described versions (V1, V2, V3, V4, and V5) of the chess-type strategy game.

FIGS. 4A, 4B, and 4C are respectively side, front and top plan views of a third-simplex representational playing piece or knight for use with five described versions (V1, V2, V3, V4, and V5) of the chess-type strategy game.

FIGS. 5A, 5B, and 5C are respectively side, front and top plan views of a composite first-duplex representational playing piece or princess for use with four described versions (V1, V2, V4, and V5) of the chess-type strategy game.

FIGS. 6A, 6B, and 6C are respectively side, front and top plan views of a composite second-duplex representational playing piece or crown-prince for use with three described versions (V1, V2, and V3) of the chess-type strategy game; or duke for use in two described versions (V4, and V5) of the chess-type strategy game.

FIGS. 7A, 7B, and 7C are respectively side, front and top plan views of a composite third-duplex representational playing piece or archbishop for use with three described versions (V1, V2, and V3) of the chess-type strategy game; or earl for use with two described versions (V4, and V5) of the chess-type strategy game.

FIG. 8 is a top plan view of a composite, symmetrical, one hundred forty-four square, first-alternative multi-concentric-perimeter checkered gameboard playing surface, having different color-coded perimeter squares, for use with five described versions (V1, V2, V3, V4, and V5) of the chess-type strategy game, and showing the starting positions of the various playing pieces for the third-version (V3) of the chess-type strategy game.

FIGS. 9A, 9B, and 9C are respectively side, front and top plan views of an objective representational playing piece or king, for use with one described version (V3) of the chess-type strategy game.

FIGS. 10A, 10B, and 10C are respectively side, front and top plan views of a substitute-first duplex representational playing piece or queen, for use with one described version (V3) of the chess-type strategy game.

FIGS. 11A, 11B, and 11C are, respectively, side, front and top plan views of a minimal representational playing piece or pawn, for use for use with three described versions (V3, V4, and V5) of the chess-type strategy game.

FIG. 12 is a top plan view of a composite, symmetrical, one hundred forty-four square, second-alternative multi-concentric-perimeter checkered gameboard playing surface, having different shade-coded perimeter squares, for use with five described versions (V1, V2, V3, V4, and V5) of the chess-type strategy game and showing the starting positions of the various playing pieces for use with the fourth-version (V4) of the chess-type strategy game.

FIGS. 13A, 13B, and 13C are respectively side, front and top plan views of a fourth-simplex representational playing piece or bowman for use with two described versions (V4, and V5) of the chess-type strategy game.

FIGS. 14A, 14B, and 14C are respectively side, front and top plan views of a composite fourth-duplex representational playing piece or marquess, for use with two described versions (V4, and V5) of the chess-type strategy game.

FIGS. 15A, 15B, and 15C are respectively side, front and top plan views of a composite fifth-duplex representational playing piece or viscount, for use with two described versions (V4, and V5) of the chess-type strategy game.

FIGS. 16A, 16B, and 16C are respectively side, front and top plan views of a composite sixth-duplex representational playing piece or baron, for use with two described versions (V4, and V5) of the chess-type strategy game.

FIGS. 17A, 17B, and 17C are respectively side, front and top plan views of a composite first-triplex representational playing piece or queen-II, for use with two described versions (V4, and V5) of the chess-type strategy game.

FIGS. 18A, 18B, and 18C are respectively side, front and top plan views of a composite second-triplex representational playing piece or crown-prince-II, for use with two described versions (V4, and V5) of the chess-type strategy game.

FIGS. 19A, 19B, and 19C are respectively side, front and top plan views of a composite third-triplex representational playing piece or counsellor, for use with two described versions (V4, and V5) of the chess-type strategy game.

FIGS. 20A, 20B, and 20C are respectively side, front and top plan views of a composite fourth-triplex representational playing piece or archbishop-II, for use with two described versions (V4, and V5) of the chess-type strategy game.

FIGS. 21 , 21 , and 21C are respectively side, front and top plan views of a substitute-objective representational playing piece or king-II, for use with two described versions (V4, and V5) of the chess-type strategy game.

FIGS. 22A, 22B, and 22C are respectively side, front and top plan views of a singular representational playing piece or court-jester, for use with two described versions (V4, and V5) of the chess-type strategy game.

FIGS. 23A, 23B, and 23C are respectively side, front, and top plan views of a first-simplex functional playing piece or alternative rook, for use with five described versions (V1, V2, V3, V4, and V5) of the chess-type strategy game.

FIGS. 24A, 24B, and 24C are respectively side, front and top plan views of a second-simplex functional playing piece or alternative bishop, for use with five described versions (V1, V2, V3, V4, and V5) of the chess-type strategy game.

FIGS. 25A, 25B, and 25C are respectively side, front and top plan views of a third-simplex functional playing piece or alternative knight, for use with five described versions (V1, V2, V3, V4, and V5) of the chess-type strategy game.

FIGS. 26A, 26B, and 26C are respectively side, front and top plan views of a composite first-duplex functional playing piece or alternative princess, for use with four described versions (V1, V2, V4, and V5) of the chess-type strategy game.

FIGS. 27A, 27B, and 27C are respectively side, front and top plan views of a composite second-duplex functional playing piece or alternative crown-prince, for use with three described versions (V1, V2, and V3) of the chess-type strategy game; or an alternative duke, for use with two described versions (V4, and V5) of the chess-type strategy game.

FIGS. 28A, 28B, and 28 are respectively side, front and top plan views of an composite third-duplex functional playing piece or alternative archbishop, for use with three described versions (V1, V2, and V3) of the chess-type strategy game; or alternative earl, for use with two described versions (V4, and V5) of the chess-type strategy game.

FIGS. 29A, 29B, and 29C are respectively side, front and top plan views of an objective functional playing piece or alternative king, for use with one described version (V3) of the chess-type strategy game.

FIGS. 30A, 30B, and 30C are respectively side, front and top plan views of a composite substitute-first duplex functional playing piece representing an alternative queen, for use with one described version (V3) of the chess-type strategy game.

FIGS. 31A, 31B, and 31C are, respectively, side, front and top plan views of a minimal functional playing piece or alternative pawn, for use with three described versions (V3, V4, and V5) of the chess-type strategy game.

FIGS. 32A, 32B, and 32C are respectively side, front and top plan views of a fourth-simplex functional playing piece or alternative bowman, for use with two described versions (V4, and V5) of the chess-type strategy game.

FIGS. 33A, 33B, and 33C are respectively side, front and top plan views of a composite fourth-duplex functional playing piece or alternative marquess, for use with two described versions (V4, and V5) of the chess-type strategy game.

FIGS. 34A, 34B, and 34C are respectively side, front and top plan views of a composite fifth-duplex functional playing piece or alternative viscount, for use with two described versions (V4, and V5) of the chess-type strategy game.

FIGS. 35A, 35B, and 35C are respectively side, front and top plan views of a composite sixth-duplex functional playing piece or alternative baron, for use with two described versions (V4, and V5) of the chess-type strategy game.

FIGS. 36A, 36B, and 36C are respectively side, front and top plan views of a composite first-triplex functional playing piece or alternative queen-II, for use with two described versions (V4, and V5) of the chess-type strategy game.

FIGS. 37A, 37B, and 37C are respectively side, front and top plan views of a composite second-triplex functional playing piece or alternative crown-prince-II, for use with two described versions (V4, and V5) of the chess-type strategy game.

FIGS. 38A, 38B, and 38C are respectively side, front and top plan views of a composite third-triplex functional playing piece or alternative counsellor, for use with two described versions (V4, and V5) of the chess-type strategy game.

FIGS. 39A, 39B, and 39C are respectively side, front and top plan views of a composite fourth-triplex functional playing piece or alternative archbishop-II, for use with two described versions (V4, and V5) of the chess-type strategy game.

FIGS. 40A, 40B, and 40C are respectively side, front and top plan views of a substitute-objective functional playing piece representing an alternative king-II, for use with two described versions (V4, and V5) of the chess-type strategy game.

FIGS. 41A, 41B, and 41C are respectively side, front and top plan views of a singular functional playing piece or alternative court-jester, for use with two described versions (V4, and V5) of the chess-type strategy game.

Figure 45A:
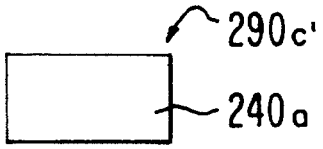
Figure 45B:
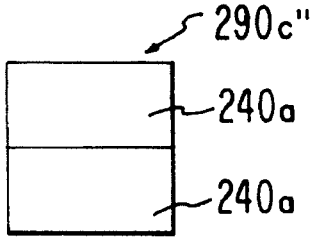
Figure 45C:
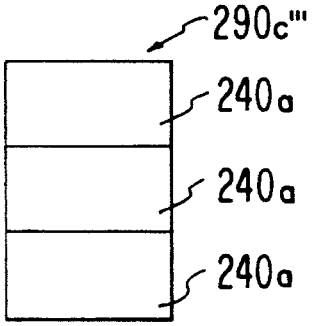
Figure 45D:
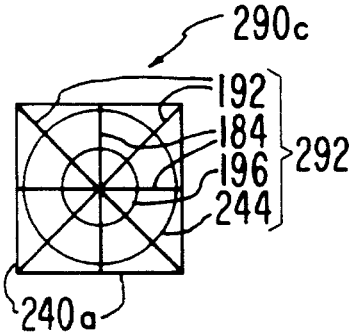

FIG. 45A is a side and frontal view of a simplex single-tier fourth-variation alternative functional playing piece, FIG. 45B is a side and frontal view of a duplex double-tier fourth-variation alternative functional playing piece, FIG. 45C is a side and frontal view of a triplex triple-tier fourth-variation alternative functional playing piece, and FIG. 45D is a top plan view of a hypothetical-universal fourth-variation functional playing piece comprising a hypothetical-universal functional symbol to illustrate a variant form of functional playing pieces for use with five versions (V1-F4, V2-F4, V3-F4, V4-F4, and V5-F4) of the chess-type strategy game.

Figure 46A:
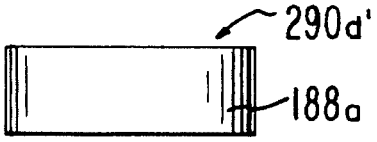
Figure 46B:
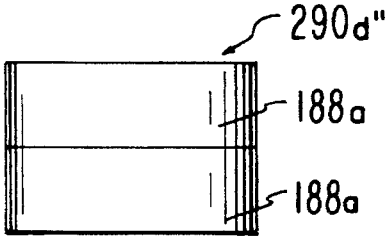
Figure 46C:
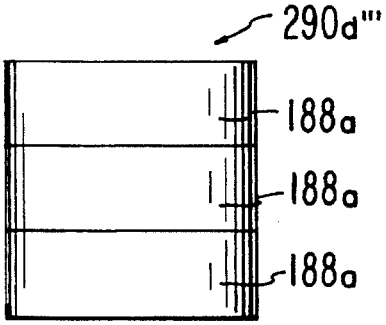
Figure 46D:
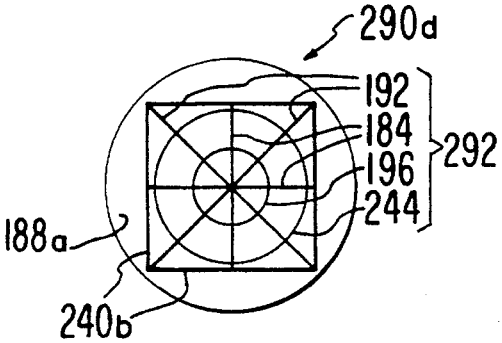

FIG. 46A is a side and frontal view of a simplex single-tier fifth-variation alternative functional playing piece, FIG. 46B is a side and frontal view of a duplex double-tier fifth-variation alternative functional playing piece, FIG. 46C is a side and frontal view of a triplex triple-tier fifth-variation alternative functional playing piece, and FIG. 46D is a top plan view of a hypothetical-universal fifth-variation functional playing piece comprising a hypothetical-universal functional symbol to illustrate a variant form of functional playing pieces for use with five versions (V1-F5, V2-F5, V3-F5, V4-F5, and V5-F5) of the chess-type strategy game.

Figure 47A:
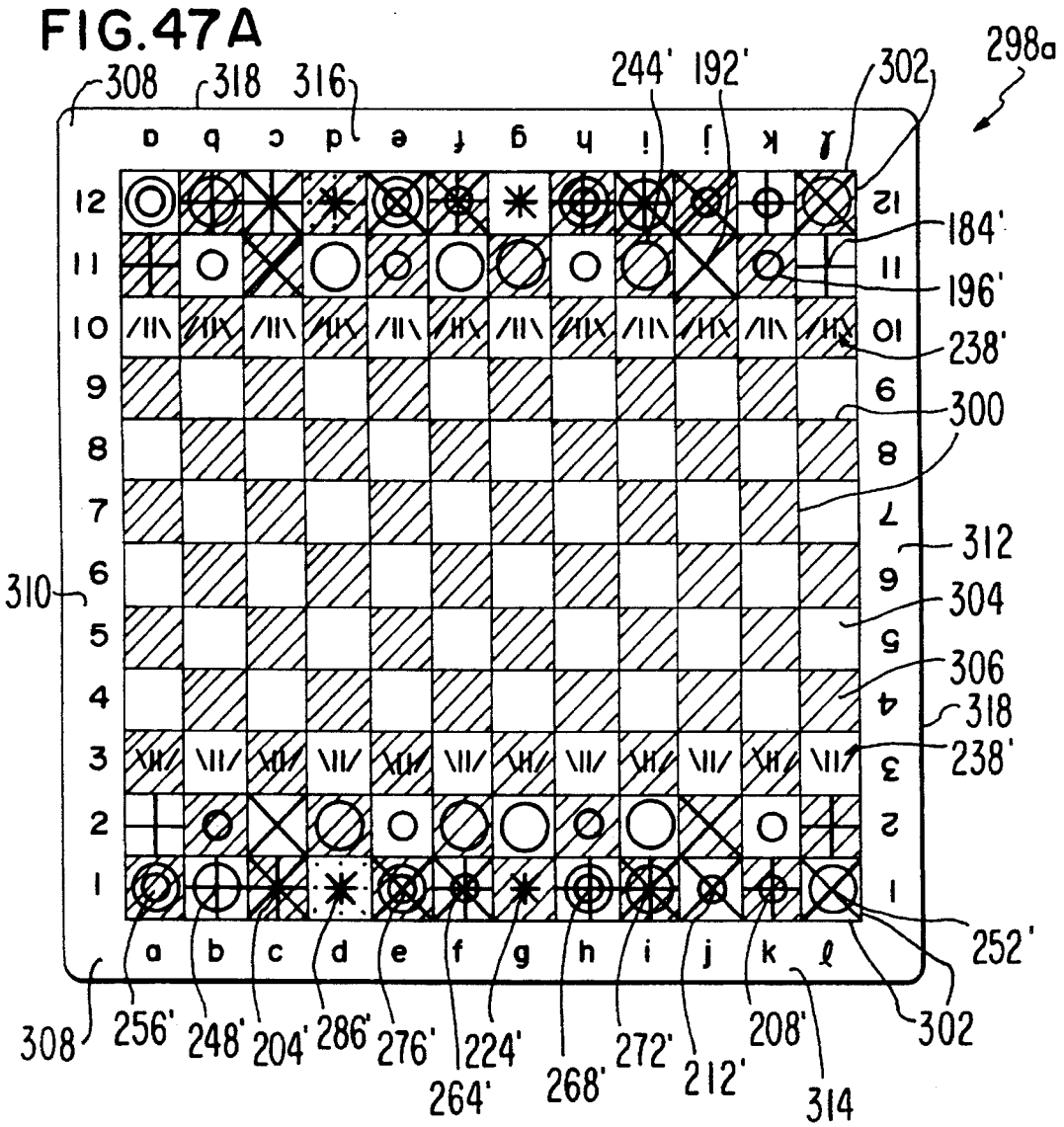

FIG. 47A illustrates a computer monitor screen representing a computer monitor displayed one hundred forty-four square checkered gameboard playing surface, and showing starting positions for two sets of thirty-six computer monitor displayed functional icons for the computer adapted fifth-version (V5-CF) of the chess-type strategy game.

Figure 47B:
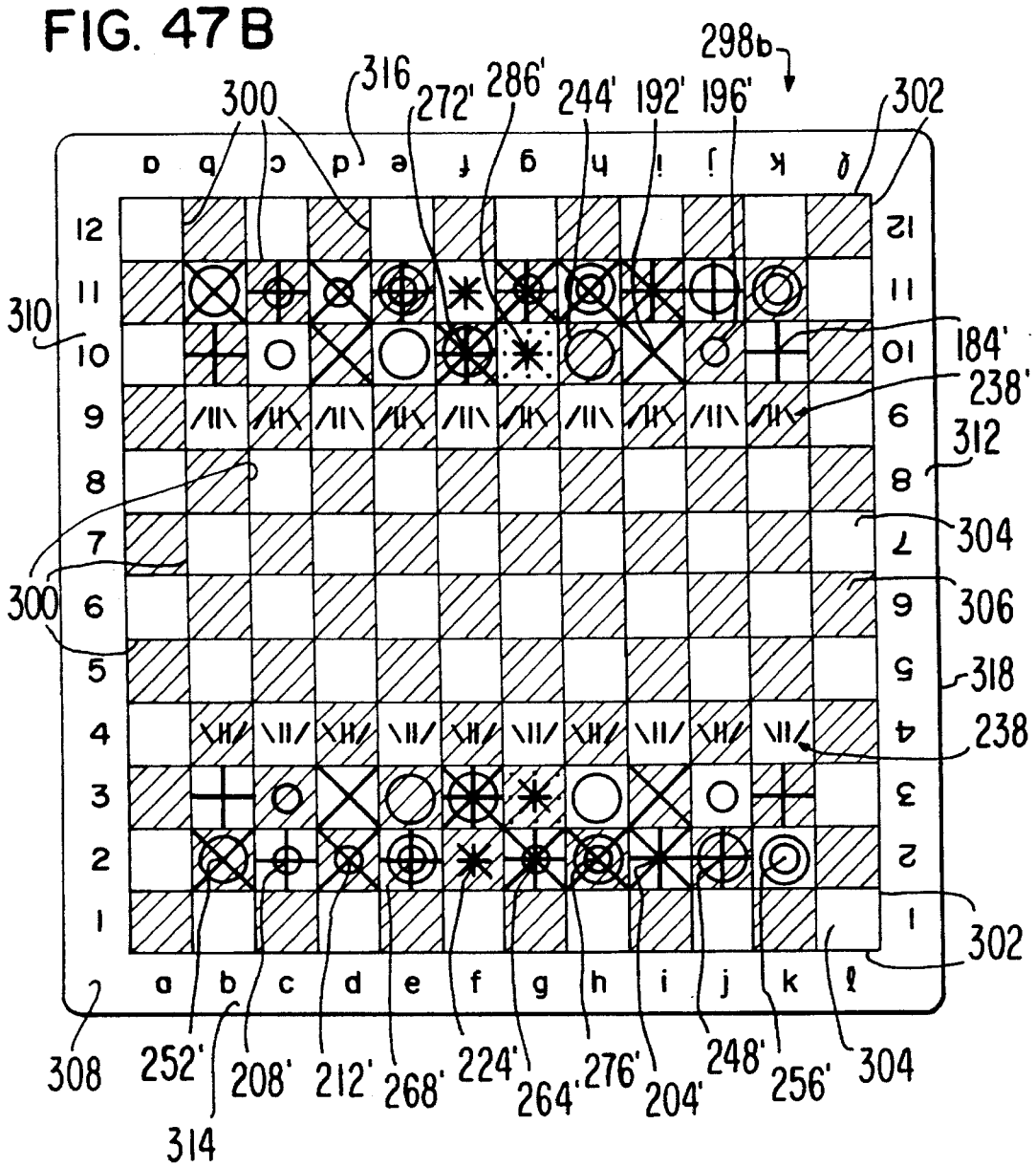

FIG. 47B illustrates a computer monitor screen representing a computer monitor displayed one hundred forty-four square checkered gameboard playing surface, and showing starting positions for two sets of thirty computer monitor displayed functional icons for the computer adapted fourth-version variation "a" (V4*a*-CF) of the chess-type strategy game.

Figure 48A:
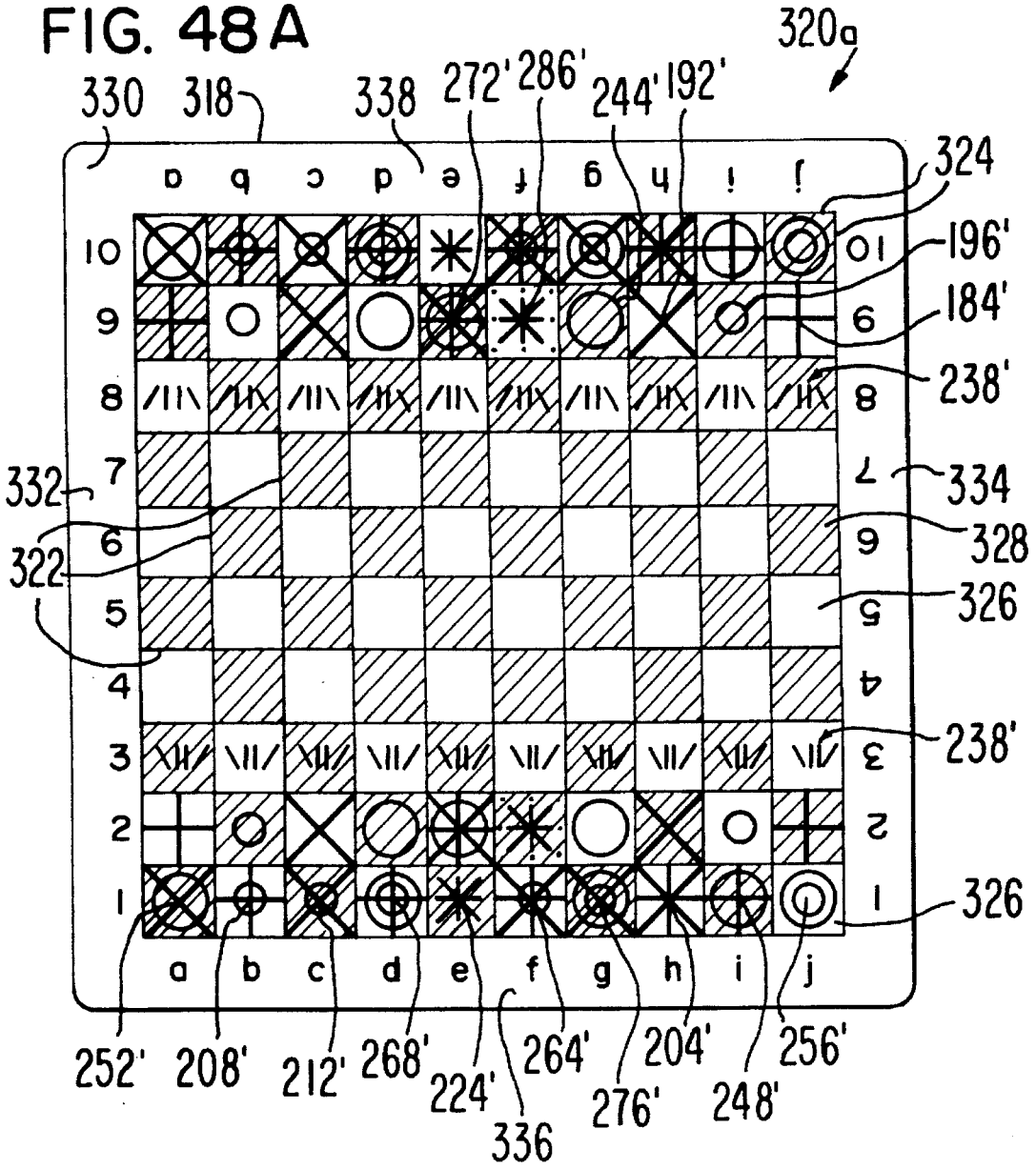

FIG. 48A illustrates a computer monitor screen representing a computer monitor displayed one hundred square checkered gameboard playing surface, and showing starting positions for two sets of thirty computer monitor displayed functional icons for the computer adapted fourth-version variation-"b (V4*b*-CF) of the chess-type strategy game.

Figure 48B:
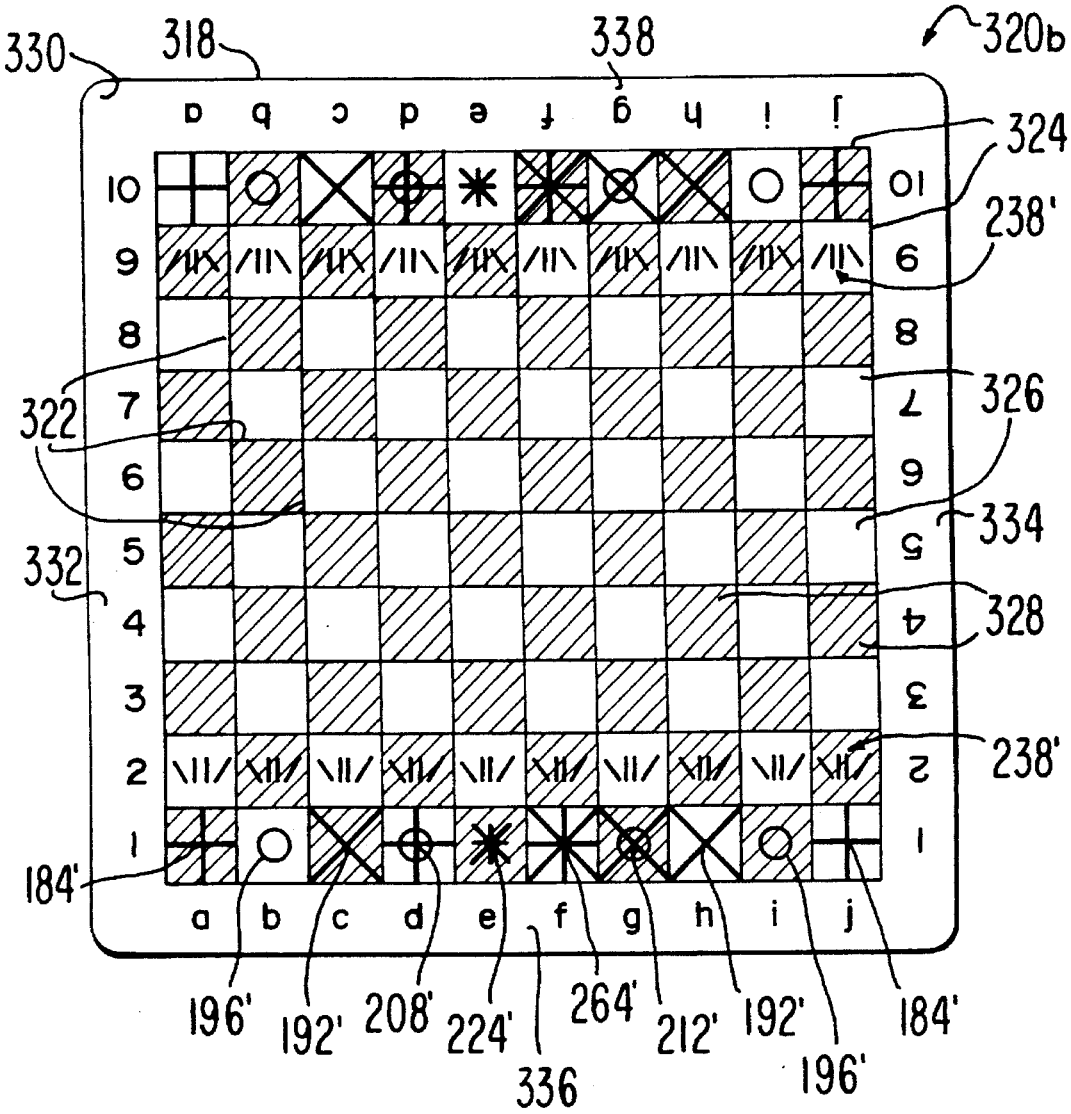

FIG. 48B illustrates a computer monitor screen representing a computer monitor displayed one hundred square checkered gameboard playing surface, and showing starting positions for two sets of twenty computer monitor displayed functional icons for the computer adapted third-version (V3-CF) of the chess-type strategy game.

Figure 49:
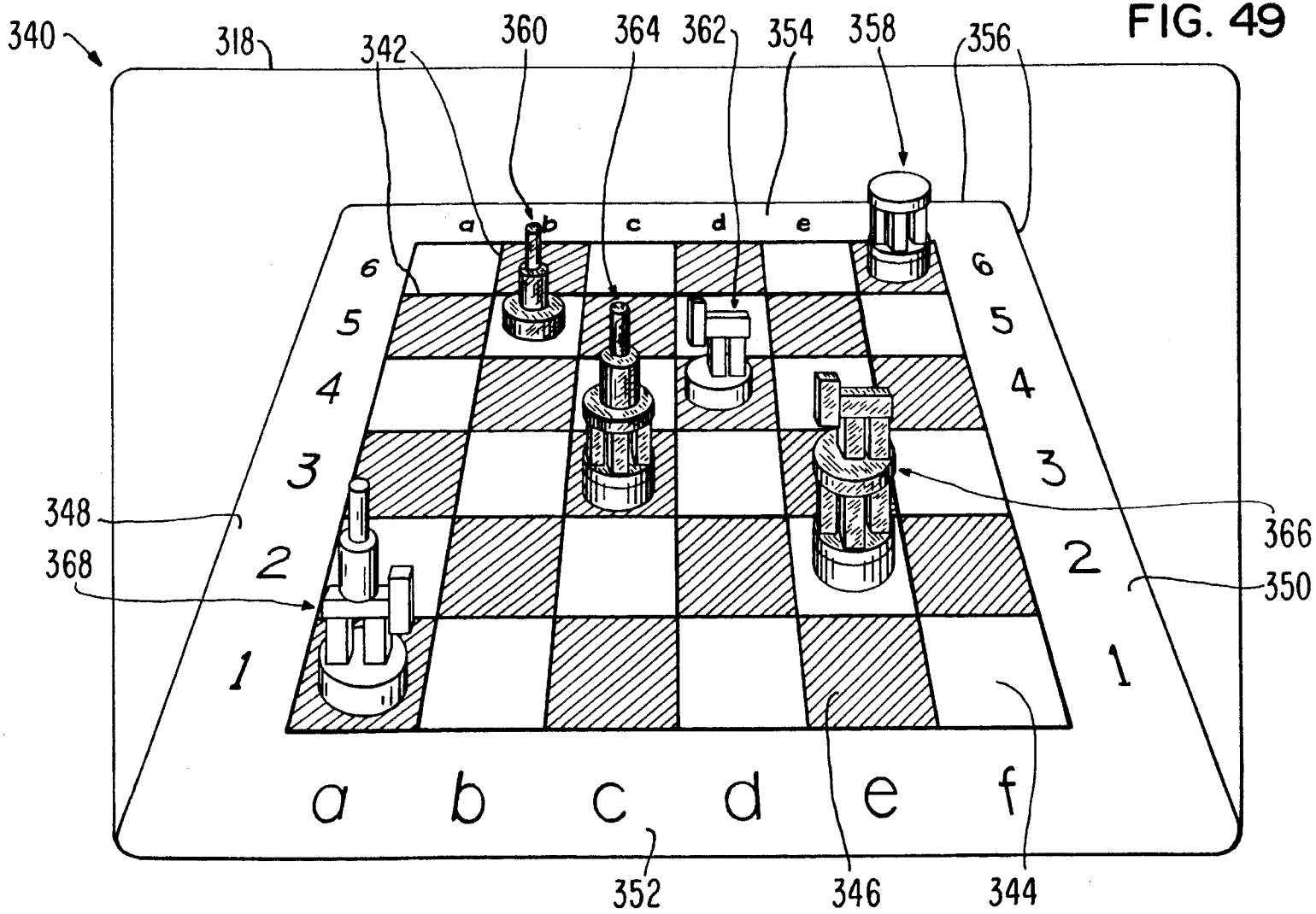

FIG. 49 illustrates a computer monitor screen representing a computer monitor displayed three-dimensional perspective thirty-six square checkered gameboard, and showing six different types of computer monitor displayed three-dimensional perspective representational playing piece images for the computer adapted first and second-versions (V1-CR, and V2-CR) of the chess-type strategy game.

VI) MULTIPLE-CONCENTRIC-PERIMETER CHECKERED GAMEBOARD (FIG. 1)

A composite, symmetrical multiple-concentric-perimeter checkered gameboard is described for use with all versions of the present invention, including: 1) a generic first-version (V1), 2) a second-version (V2), 3) a third-version (V3), 4) a fourth-version (V4), and a fifth-version (V5). The gameboard is comprised of a composite of multiple, concentric, square, checkered playing surfaces, each having alternating squares of contrasting humanly sensible indicia, and also marginal numerical indicia and marginal alphabetical indicia.

Figure 1:
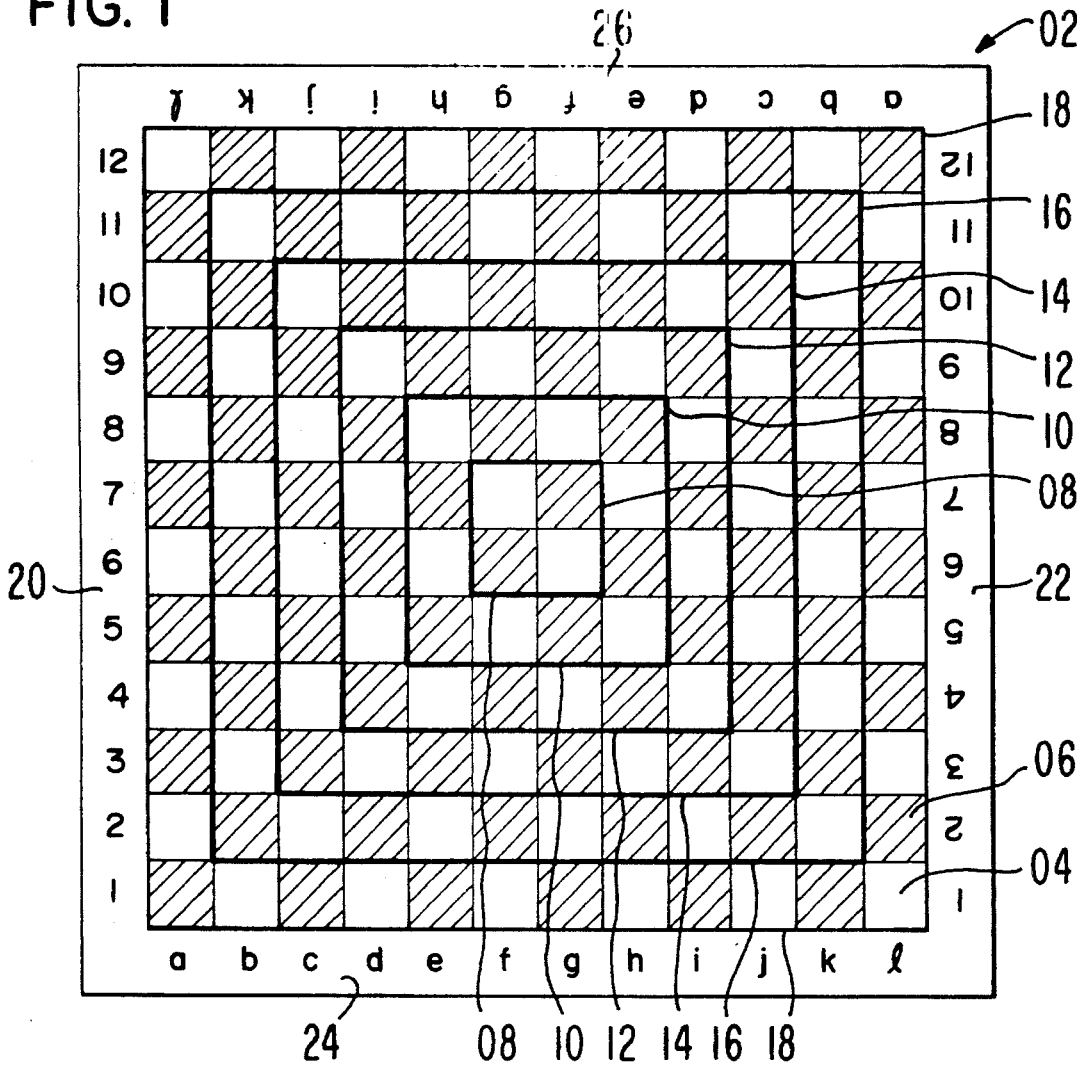

FIG. 1 shows a composite, symmetrical, multiple-concentric-perimeter checkered gameboard playing surface 02 comprised of several square-shaped concentric checkered playing surfaces, of alternate contrasting squares of two different humanly sensible indicia, such as light squares or non-colored squares or non-shaded squares 04 and dark squares or colored squares or shaded squares 06, respectively. The central four alternate contrasting squares provide a playing surface of four squares having a square first-perimeter 08. The central four squares are surrounded by an additional twelve alternate contrasting squares providing a playing surface of sixteen squares having a square second-perimeter 10. The central sixteen squares are surrounded by an additional twenty alternate contrasting squares providing a playing surface of thirty-six squares having a square third-perimeter 12. The central thirty-six squares are surrounded by an additional twenty-eight alternate contrasting squares providing a playing surface of sixty-four squares having a square fourth-perimeter 14. The central sixty-four squares are surrounded by an additional thirty-six alternately colored squares providing a playing surface of one hundred squares having a square fifth-perimeter 16. The central one hundred squares are surrounded by an additional forty-four alternately colored squares providing a playing surface of one hundred forty-four squares having a square sixth-perimeter 18. The alternating light squares 04 and dark squares 06 are aligned such that like-squares are diagonally aligned and alternate orthogonally. The square sixth-perimeter 18 is surrounded by: a left-margin with numerical indicia from "1" to "12" 20, and a right-margin with numerical indicia from "1" to "12" 22, identifying ranks; and a lower-margin with alphabetical indicia from "a" to "1" 24, and an upper-margin with alphabetical indicia from "a" to "1" 26, identifying files; such that any square on the gameboard can be located algebraically by a letter and a number. The various square perimeters 08, 10, 12, 14, 16, and 18 define the limits of each different board size. The different perimeters are differentiated by any humanly sensible indicia distinguishing different perimeter lines, and alternate squares, such as differences in texture and color.

Different symmetrical gameboard sizes can be distinguished by a sequence of different colored perimeter lines such as: (red) square first-perimeter 08, (orange) square second-perimeter 10, (yellow) square third-perimeter 12, (green) square fourth-perimeter 14, (blue) square fifth-perimeter 16, and (violet) square sixth-perimeter 18). This design defines the borders of each of all six progressively larger playing surfaces by color-coding. Thus for the generic first-version, the sixteen square perimeter line is orange, and the thirty-six square perimeter line is yellow. For the second-version, the thirty-six square perimeter line is yellow, and the sixty-four square perimeter line is green. For the third-version, the one hundred square perimeter line is blue. For the fourth-version, the one hundred square perimeter line is blue, and the one hundred forty-four square perimeter line is violet. For the fifth-version, the one hundred forty-four square perimeter line is violet.

VII) REPRESENTATIONAL PLAYING PIECES (-R)

These playing piece sets are designed and constructed to represent both the six basic different types of playing pieces of conventional chess (rooks, bishops, knights, queens, kings, and pawns) and the additional eleven different types of playing pieces utilized in these various new chess-type strategy games (crown-princes, archbishops, princesses, dukes, marquess, earls, viscounts, barons, counsellors, court-jesters, and bowmen). The rooks, bishops, knights, and the new bowmen playing pieces comprised simplex symmetrical geometric representational configurations which are single-tier structures that provide the components for both duplex symmetrical geometric representational configurations which are double-tier structures stacked vertically upon each other, and triplex symmetrical geometric representational configurations which are triple-tier structures stacked vertically upon each other. The designs of the different single-tier structures enables them to be stacked vertically and permanently upon each other in various different combinations as composite double-tier structures, and composite triple-tier structures, thereby permitting the creation of more complex playing pieces, whose identities and operations are readily apparent from their component simplex configurational compositions.

A) The Generic First-Versions of the Chess-Type Strategy Game (V1*a*, and V1*b*):

(FIGS. 1; 2A, 2B, 2C; 3A, 3B, 3C; 4A, 4B, 4C; 5A, 5B, 5C; 6A, 6B, 6C; 7A, 7B, and 7C).

1) The Gameboard (for V1*a*, and V1*b*): (FIG. 1):

The generic first-version (V1) of the game can be played upon either:

a) sixteen squares using the orange second-perimeter 10 (for V1*a*), or b) thirty-six squares using the yellow third-perimeter 12 lines (for V1*b*) of the composite multiple-concentric-perimeter checkered gameboard of FIG. 1, but the larger board is generally preferred, because although the game can be played upon the smaller board, it is usually more confusing, because initially the playing pieces are very crowded. There are no fixed starting positions assigned for the pieces on the gameboard in the generic first-versions of the game.

2) The Playing Pieces (for V1*a*, and V1*b*):

a) The Number of Pieces and Their Relative Strengths:

The various lettered playing piece abbreviations used are listed below. The numbers in parentheses indicate the number of specific pieces per player. The letters in parentheses indicate duplex configuration composition. The numbers in brackets indicate relative strength of pieces based on the number of squares a particular type of piece can reach from a central square on an empty thirty-six square gameboard. The number of pieces for V1*a* and V1*b* are the same.

R=first-simplex playing piece (1):[10]

B=second-simplex playing piece (1):[9]

N=third-simplex playing piece (1):[8]

S=first-duplex playing piece (11):(B+R):[19]

P=second-simplex playing piece (1):(N+R):[18]

Figure 2A:
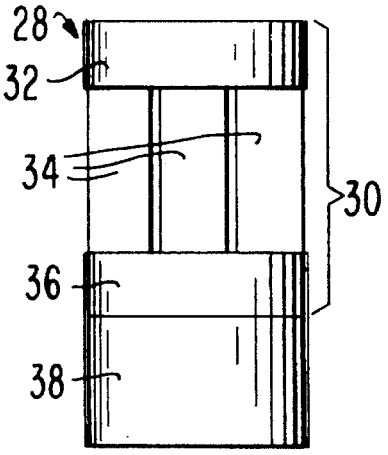
Figure 2B:
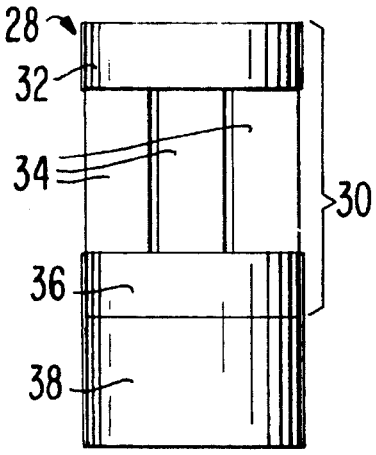
Figure 2C:
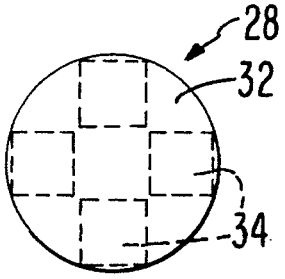

A=third-simplex playing piece (1):(B+N):[17]

b) Detailed Description of the Representational Style Playing Pieces (-R):

(1) FIGS. 2A, 2B, and 2C illustrate a first-simplex representational playing piece or rook 28 (for use with all versions of the game) comprising a first-simplex representational configuration or first-single-tier configuration or rook configuration 30 having a short large-diameter cylindrical parapet section 32 supported horizontally by four solid-rectangular column sections 34 mounted vertically and positioned radially and equidistantly around the circumference of a short, large-diameter cylindrical foundation section 36. The complete rook configuration 30 being mounted permanently, vertically and concentrically upon a large diameter cylindrical pedestal section 38. FIG. 2C also shows the relative positions of the square ends of the four solid-rectangular column sections 34 as broken line outlines underneath the cylindrical parapet section 32.

Figure 3A:
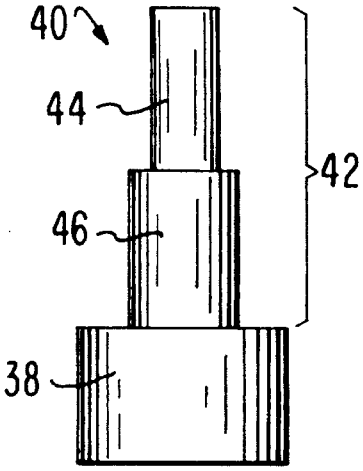
Figure 3B:
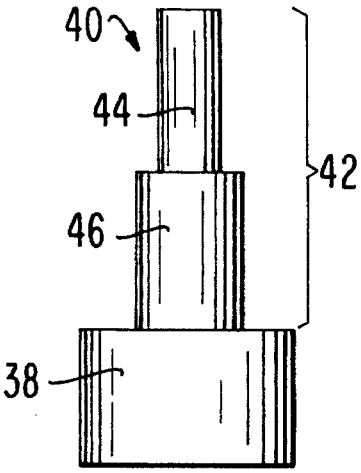
Figure 3C:
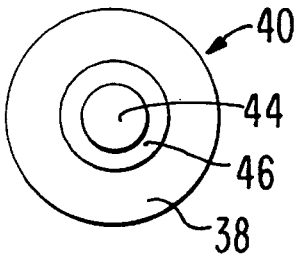

(2) FIGS. 3A, 3B, and 3C illustrate a second-simplex representational playing piece or bishop 40 (for use with all versions of the game) comprising a second-simplex representational configuration or second-single-tier configuration or bishop configuration 42 having a tall, small-diameter upper cylindrical headdress section 44 which is centered and mounted vertically upon a lower medium-diameter cylindrical bishop-torso section 46. The complete bishop configuration 42 being mounted permanently, vertically and concentrically upon a large-diameter cylindrical pedestal section 38.

Figure 4A:
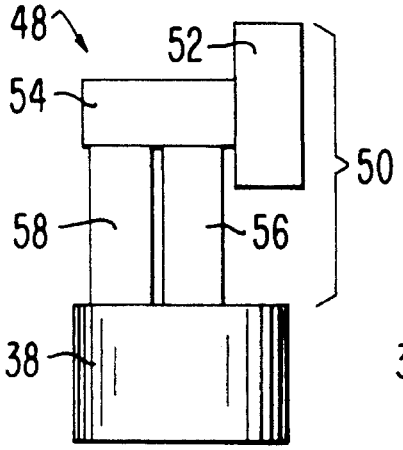
Figure 4B:
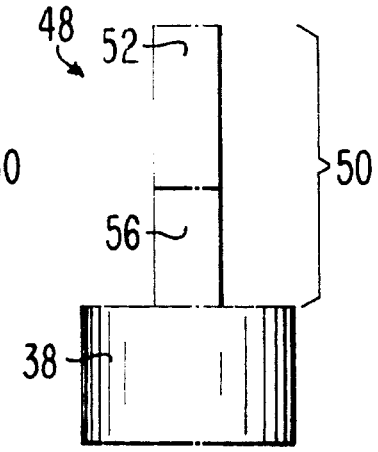
Figure 4C:
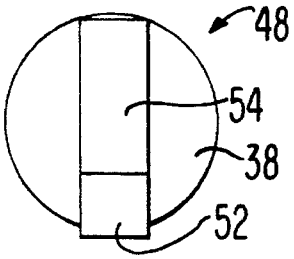

(3) FIGS. 4A, 4B, and 4C illustrate a third-simplex representational playing piece or knight 48 (for use with all versions of the game) comprising a third-simplex representational configuration or third-single-tier configuration or knight configuration 50 having a vertical solid-rectangular horse-head section 52 connected at its midsection at right angles to one end of a horizontal solid-rectangular horse-body section 54 supported near both ends by two vertical, parallel solid-rectangular leg segments, a front-legs section 56 and a hind-legs section 58. The complete knight configuration 50 being mounted permanently, vertically and concentrically upon a large-diameter cylindrical pedestal section 38.

Figure 5A:
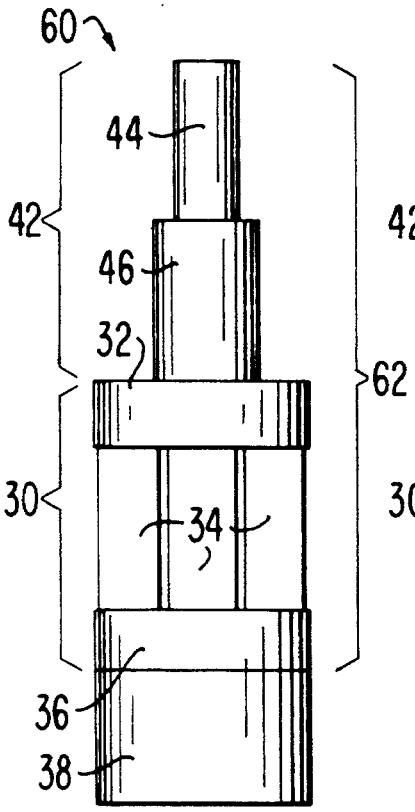
Figure 5B:
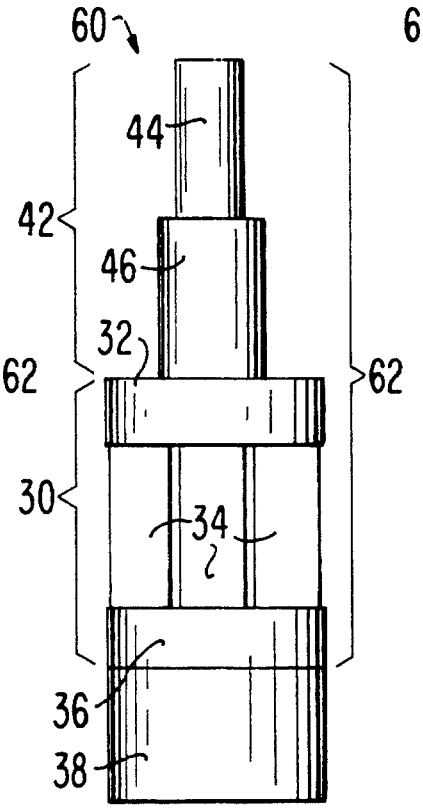
Figure 5C:
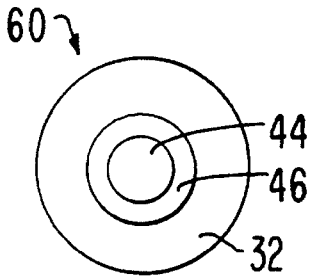

(4) FIGS. 5A, 5B, and 5C illustrate a first-duplex representational playing piece or princess 60 (for use with the first, second, fourth, and fifth versions of the game) comprising a composite first-duplex representational configuration or first-double-tier configuration or princess configuration 62, having an upper-tier bishop configuration 42 mounted permanently and vertically upon a lower-tier rook configuration 30. The upper-tier bishop configuration 42 comprising a tall, small-diameter cylindrical headdress section 44 centered and mounted vertically on a medium-diameter cylindrical bishop-torso section 46. The lower-tier rook configuration 30 comprising a short, large-diameter cylindrical parapet section 32 supported horizontally by four solid-rectangular column sections 34 mounted vertically and positioned radially and equidistantly around the circumference of a short, large-diameter cylindrical foundation section 36. The complete princess configuration 62 being mounted permanently, vertically and concentrically upon a large-diameter cylindrical pedestal section 38.

Figure 6A:
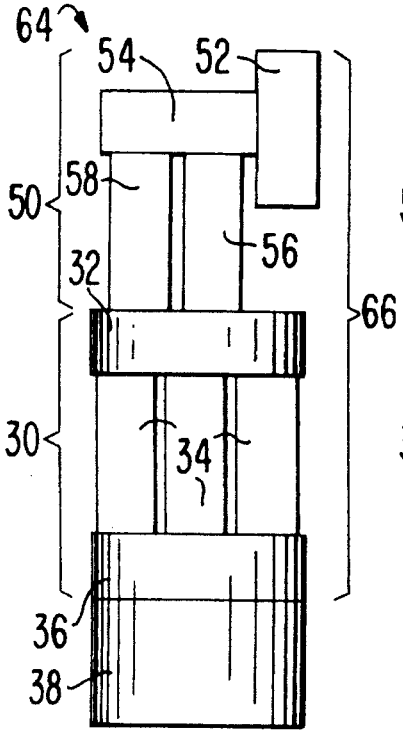
Figure 6B:
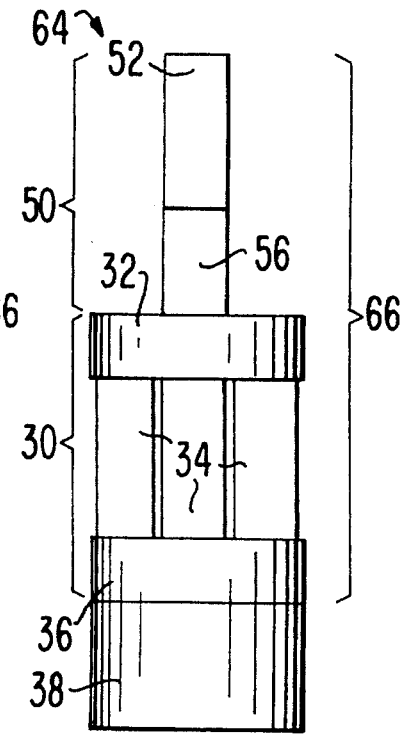
Figure 6C:
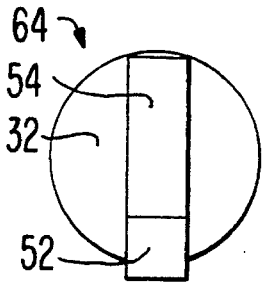

(5) FIGS. 6A, 6B, and 6C illustrate a second-duplex representational playing piece or crown-prince 64 (for use with the first, second, and third versions of the game), or duke 64 (for use with the fourth, and fifth versions of the game), comprising a composite second-duplex representational configuration or second-double-tier configuration or crown-prince configuration, or duke configuration 66, having an upper-tier knight configuration 50 mounted permanently and vertically upon a lower-tier rook configuration 30. The upper-tier knight configuration 50 comprising a vertical solid-rectangular horse-head section 52 connected at its midsection at right angles to one end of a horizontal solid-rectangular horse-body section 54 supported near both ends by two vertical, parallel, solid-rectangular leg segments, a front-legs section 56 and a hind-legs section 58. The lower-tier rook configuration 30 comprised of a short, large-diameter cylindrical parapet section 32 supported horizontally by four solid-rectangular column sections 34 mounted vertically and positioned radially and equidistantly around the circumference of a short, large-diameter cylindrical foundation section 36. The complete composite crown-prince configuration or duke configuration 66 being mounted permanently, vertically and concentrically upon a large-diameter cylindrical pedestal section 38.

Figure 7A:
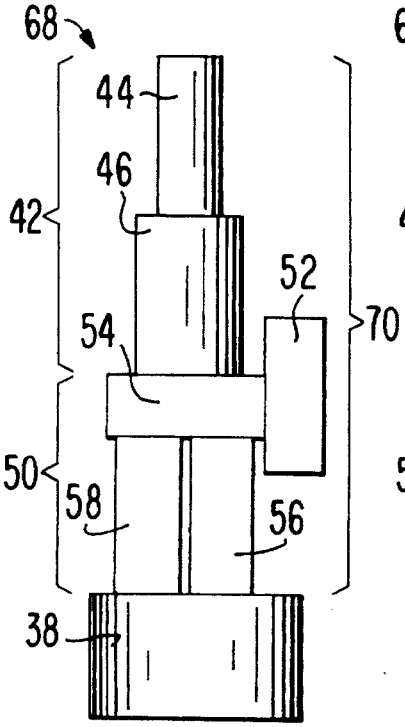
Figure 7B:
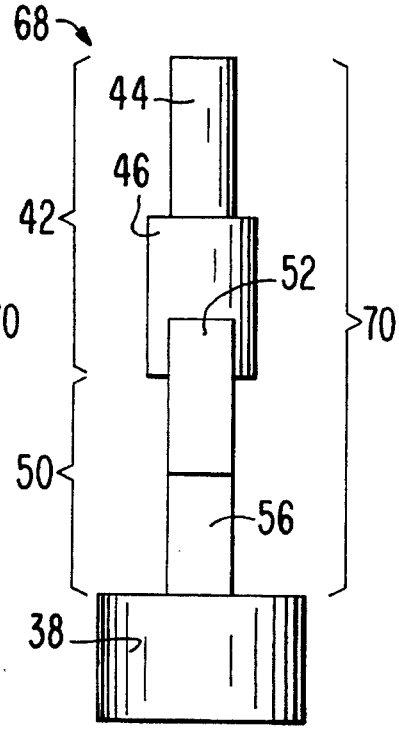
Figure 7C:
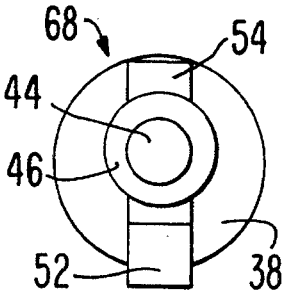

(6) FIGS. 7A, 7B, and 7C illustrate a third-duplex representational playing piece or archbishop 68 (for the first, second, and third versions of the game) or earl 68 (for use with the fourth, and fifth versions of the game), comprising a composite third-duplex representational configuration or third-double-tier configuration or archbishop configuration 70 or earl configuration 70, comprising an upper-tier bishop configuration 42 mounted permanently and vertically upon a lower-tier knight configuration 50. The upper-tier bishop configuration 42 comprised of a tall, small-diameter cylindrical headdress section 44 which is centered and mounted vertically on a medium-diameter cylindrical bishop-torso section 46. The lower-tier knight configuration 50 comprising a vertical solid-rectangular horse-head section 52 connected at its midsection at right angles to one end of a horizontal solid-rectangular horse-body section 54 supported near both ends by two vertical, parallel solid-rectangular leg segments, front-legs section 56 and hind-legs section 58. The complete composite archbishop configuration or earl configuration 70 being mounted permanently, vertically and concentrically upon a large-diameter cylindrical pedestal section 38.

3) The Method of Play (for V1):

A methodology for playing the generic first-version (V1) of the chess-type strategy game is as follows:

a) Provide the following elements:

(1) A four-by-four checkered gameboard having sixteen squares (for V1*a*), and a six-by-six checkered gameboard having thirty-six squares (for V1*b*), as in FIG. 1.

(2) Two sets of contrasting pieces, each set having:

(a) at least three different types of simplex playing pieces comprising one of at least three different types of simplex configurations (known as R, B, and N), such that each different type of simplex configuration represents a different specific movement and capturing pattern of simplex playing pieces upon the gameboard: R=pattern (a); B=pattern (b); and N=pattern (c) .

(b) at least three different types of duplex playing pieces comprising one of at least three different types of duplex configurations (known as S, P, and A) each different type of duplex configuration comprising two of at least three different types of the simplex configurations (B/R, N/R, and B/N, respectively) such that the two different types of simplex configurations constituting the duplex configurations represent different alternative specific movement and capturing patterns of the duplex playing pieces upon the gameboard, so that:

S=alternative pattern (a), and (b);

P=alternative pattern (a), and (c); and

A=alternative pattern (b), and (c).

b) Move the playing pieces on the gameboard according to the following rules:

(1) Move individual playing pieces:

(a) First-simplex playing piece: by pattern (a), (such as extended movement orthogonally in four possible directions, any number of open squares from "1" to "x") and able to capture the first of any opponent pieces encountered in its path by displacement of the opponent's piece from the board and occupation of that position.

(b) Second-simplex playing piece: by pattern (b), (such as extended movement diagonally in four possible directions, any number of open squares from "1" to "x"), which is different from pattern (a), and able to capture the first of any opponent pieces encountered in its path by displacement of the opponent's piece from the board and occupation of that position.

(c) Third-simplex playing piece: by pattern (c), (such as a jumping single-dog-leg, in eight possible directions, comprising two squares orthogonally, followed by one square orthogonally at right angles to the first direction, and able to jump over any intervening pieces), which is different from both pattern (a) and pattern (b), and able to capture any opponent's pieces landed upon in eight possible locations by displacement of the opponent's piece from the board and occupation of that position.

(d) First-duplex playing piece: by alternative pattern (a) and (b), (e) Second-duplex playing piece: by alternative pattern (a) and (c), (f) Third-duplex playing piece: by alternative pattern (b) and (c), (2) Alternate turns:

(a) one player has the first move, (b) players can arrange starting positions in any agreed upon order, (c) alternatively, players may take alternate turns to select any piece and to place it on any square on their own side of the board, this procedure continues until all pieces are positioned on the gameboard, and (d) players continue to take alternate turns moving one piece at a time in order to change the position of a piece and to capture an opponent's piece,

[1] during a turn, a player touching any of their own pieces, must move that piece if possible,

[2] during a turn, a player touching any of their opponent's pieces, must capture that piece if possible.

(3) Winning and scoring the game (V1):

(a) a player wins by the "elimination" of all of an opponent's pieces from the board, and the winner is awarded one point, and alternatively, the winner is awarded the total number of points of all the winner's playing pieces remaining on the board (according to the point system below), (b) alternatively, at any time after the at least one piece has been taken, if no pieces are taken for thirty moves, a "truce" is declared and the game is terminated, and each player is awarded one-half point, and alternatively, each player is awarded the total number of points of their own playing pieces remaining on the board (according to the point system below), and (c) alternatively, if a player "resigns" or "surrenders", then the opponent wins and is awarded one point, and alternatively, the opponent is awarded the total number of points of all pieces remaining on the board, according to the following "point system":

[1] knights=3 pts.,

[2] bishops=4 pts.,

[3] rooks=5 pts.,

[4] archbishops=7 pts.,

[5] crown-princes=8 pts.,

[6] princesses=9 pts., and (d) for contests involving a series of games, the player having the highest average score wins the contest.

(4) Significance of the game:

(a) simplicity: there are fewer pieces and less squares to move around on than in conventional chess, but the game provides experience with the basic simplex and duplex playing pieces in the simplest context.

(b) complexity: the three powerful duplex playing pieces increase the interactive potential of the two opposing forces which promotes greater interest in the game.

(c) duration: usually much shorter and seldom have drawn games, as frequently occurs with conventional-chess, and players can play more games in the same period of time.

B) The Second-Versions of the Chess-Type Strategy Game (V2*a*, and V2*b*):

(FIGS. 1; 2A, 2B, 2C; 3A, 3B, 3C; 4A, 4B, 4C; 5A, 5B, 5C; 6A, 6B, 6C; 7A, 7B, and 7C).

The second versions (V2*a* and V2*b*) differ from the first versions (V1*a* and V1*b*) by having double the number of simplex playing pieces, providing a better balance of pieces on the board by helping to offset the overwhelming power of the duplex pieces. The checkered gameboard size also has been increased by 78% (for V2*b*) which increases the range for the pieces with extended movement (rooks, bishops and all duplex pieces), and also some new rules have been added.

1) The Gameboards (for V2*a* and V2*b*):

There are no fixed starting positions assigned to the gameboard for the two second-versions of the game. The two second-versions of the game can be played on the multiple-concentric-perimeter gameboard, as in FIG. 1, by using:

a) for V2*a*: thirty-six squares, using the (yellow) square third-perimeter 12 as outside playing limits, and b) for V2*b*: sixty-four squares, using the (green) square fourth-perimeter 14, as outside playing limits.

2) The Playing Pieces (for V2*a*, and V2*b*):

a) The Number of Pieces, Composition and Relative Strengths: The various letters given below are abbreviations for playing pieces. The numbers in parentheses indicate the number of specific pieces per player. The letters in parentheses indicate a duplex configuration composition. The numbers in brackets indicate the relative strength of pieces based on the number of squares a particular type of piece can reach from a central square on an empty sixty-four square gameboard. The same number of playing pieces are used for both V2*a* and V2*b*. When utilizing a sixty-four square gameboard for V2*b* as in (FIG. 1), the number, composition, and relative strength of the various playing pieces are as follows:

R=rooks (2):[14]

B=bishops (2):[13]

N=knights (2):[8]

S=princess (1):(B / R):[27]

P=crown-prince (1):(N / R):[22]

A=archbishop (1):(B / N):[21]

b) Detailed Description of the Representational Style Playing Pieces (-R):

(1) rooks (two): same as described for V1 above.

(2) bishops (two): same as described for V1 above.

(3) knights (two): same as described for V1 above.

(4) princess: same as described for V1 above.

(5) crown-prince: same as described for V1 above.

(6) archbishop: same as described for V1 above.

3) The Method of Play (V2):

A methodology for playing the second-versions (V2*a*, and V2*b*) of the chess-type game is as follows:

a) Provide the following elements:

(1) Gameboards (FIG. 1):

(a) for V2*a*: a six-by-six checkered gameboard having thirty-six squares, and (b) for V2*b*: alternatively, an eight-by-eight checkered gameboard having sixty-four squares, (2) Playing Pieces: two sets of contrasting pieces, each set having:

(a) three pairs of three different types of simplex playing pieces (two rooks, two bishops, and two knights), each different type of simplex piece comprising a simplex configuration having a different specific potential type of movement and capturing potential;

(b) three different types of duplex playing pieces (a princess, a crown-prince, and an archbishop), with each different type of duplex piece having a composite construction of two of three different types of simplex configurations and each duplex piece having the alternative different specific potential movement and capturing patterns of either of their two simplex components:

b) Move the playing pieces on the gameboard according to the following rules:

(1) Move individual pieces:

(a) first-simplex playing pieces (rooks): extended movement orthogonally (along ranks or files), in four possible directions and able to capture (captivate or take captive) the first of any opponent pieces encountered in its path by displacement of the opponent's piece from the board (keeping the captured piece off the board in an upright position, which indicates the potential to return to the board, if liberated later) and occupation of that position, by pattern (a), (b) second-simplex playing pieces (bishops): extended movement diagonally, in four possible directions and able to capture the first of any opponent pieces encountered in its path by displacement of the opponent's piece from the board (keeping the captured piece off the board in an upright position, which indicates the potential to return to the board, if liberated later) and occupation of that position, by pattern (b), (c) third-simplex playing pieces (knights): a jumping single-dog-leg move in eight possible directions, by moving either one square orthogonally followed by two squares orthogonally at right angles to the first square moved, or by moving one square orthogonally followed by two squares orthogonally at right angles to the first square moved; can jump over any intervening pieces and capture (annihilate or destroy) any opponent's piece it lands on, by displacement of the opponent's piece from the board (keeping the captured piece off the board in a recumbent position, which indicates the inability to return to the board, for the remainder of the contest) and occupation of that position, by pattern (c), (d) first-duplex playing pieces (princesses): move and capture (captivate) as either first-simplex or second-simplex pieces (rooks and bishops) as described above, by alternate pattern (a), and (b), (e) second-duplex playing pieces (crown-princes): move and capture (captivate and annihilate) as either first-simplex or third-simplex pieces (rooks and knights), respectively, as described above, by alternate pattern (a), and (c), and (f) third-duplex playing pieces (archbishops): move and capture (captivate and annihilate) as either second-simplex or third-simplex pieces (bishops and knights), respectively, as described above, by alternate pattern (b), and (c).

(2) Alternate turns:

(a) same as for version-one (V1), as described above, and additionally, (b) each player must initially place their bishops on two different contrasting squares of the gameboard, (c) capture of playing pieces: previously described conventional chess-type of captures are now separated into two different categories having different consequences:

[1] captivation: rooks, bishops, or composite pieces using their rook or bishop components to take or capture an opponent's playing piece are considered to have captivated (taken captive) the opponent's piece; and in this event, the captive playing piece is removed from the board, but left in an upright position, indicating that this piece can be liberated from captivity later and returned to the board during that particular game by any liberating piece, and

[2] annihilation: knights, and composite pieces using their knight components to take or capture an opponent's playing piece are considered to have annihilated (destroyed) the opponent's piece; and in this event, the annihilated piece is removed from the board and turned upon it's side in the recumbent state, indicating that this piece cannot be returned to the board during that particular game by any liberating piece, and (d) liberation: only knights can liberate any previously captivated piece (simplex or duplex) by reaching either of the two corner squares on the last ranks (but annihilated pieces cannot be liberated):

[1] the selected liberated piece is placed on the corner square of the last rank after removing the liberating knight from that square, and

[2] the liberating knight is returned to any knight starting position, which are recorded at the start of each game, but if all of these squares are occupied, then the liberating knight cannot be returned to the board, and is then considered as being captivated in the process of liberating another piece, and is removed from the board until liberated by another knight.

(3) Winning and scoring the game: the game is won by the same criterion as stated for the first-versions (V1*a* and V1*b*), as stated above.

(3) Winning and scoring the game:

(a) same as for version-one (V1), but further including:

(b) after at least one playing piece has been taken, if no further pieces are taken for thirty moves, a "truce" is declared and the game is terminated, and each player is awarded one-half point, and alternatively, each player is awarded the total number of points of their own playing pieces remaining on the board, plus the total number of points of their own playing pieces that had been captivated during the game, according to the following point system,

[1] knights=3 pts.,

[2] bishops=4 pts.,

[3] rooks=5 pts.,

[4] archbishops=7 pts.,

[5] crown-princes=8 pts.,

[6] princesses=9 pts., and (4) The significance of the game:

(a) the game provides a better balance of playing pieces, so that two similar simplex pieces can support each other, which makes them more formidable against opponent duplex pieces, and the two bishops can now cover the entire playing surface, (b) duplex pieces are now more vulnerable due to the increased numbers of simplex pieces, which usually creates a more interesting and more complex game than the generic first-version game, and (c) knights have been given a liberating potential which creates a much more interesting and dynamic game, since previously captivated pieces can sometimes be released from captivity and suddenly shift the balance of power between the two sides and reverse an apparently losing game posture.

C) The Third-Version of the Chess-Type Strategy Game (V3):

(Gameboard, Playing Pieces, and Method): (FIGS. 1; 2A, 2B, 2C; 3A, 3B, 3C; 4A, 4B, 4C; 6A, 6B, 6C; 7A, 7B, 7C; 8; 9A, 9B, 9C; 10A, 10B, 10C; 11A, 11B, and 11C).

The third-version of the chess-type game is the closest relative to conventional chess because it includes both pawns and kings. Although the first two games lacked kings, they possess some characteristics of chess, such as some similar pieces, movements and capturing powers. However, all of these different games have something more which goes beyond conventional chess, namely two new pieces providing a better balanced hierarchy of playing pieces, which greatly enhances the strategic potential of the various different versions of the games. Furthermore, playing the simpler forms of the game first, may better prepare a beginning player for each next stage of complexity without overwhelming or demoralizing them.

The third game has a 56% larger board and two more pawns than conventional chess, and also has two new major playing pieces (crown-prince and archbishop) which rival the queen (which replaces the princess in the third-version) for power. Some of the rules of chess have been changed and some new rules have been added.

The distinction is continued in the status of pieces which are captured in the conventional manner of chess:

Kings and queens join with rooks, bishops, and duplex pieces which use their rook and bishop components to "take" or capture opposing pieces and are considered as "captivators" or pieces which capture and hold opposing pieces as "captives". These "captive" pieces are left in an upright position, when captured and removed from the board, but have the potential to be returned to the board, if and when they can be "liberated" by either pawns reaching any square on the last ranks, or knights reaching corner squares on the last ranks.

Pawns join with knights and duplex pieces which use their knight components to "take" or capture opposing pieces, as "annihilators" or pieces which "destroy" opposing pieces. These "annihilated" pieces are left in the recumbent position when captured and removed from the board and cannot be returned to the board for the remainder of the game, except when pawns are "knighted" (exchanged for annihilated knights) for reaching the last ranks and liberating another playing piece.

The third-version chess-type strategy game (V3) is played on a ten-by-ten, one hundred square checkered gameboard. Each of two players start the game with twenty playing pieces: two rooks, two bishops, two knights, one queen, one crown-prince, one archbishop, one king, and ten pawns.

1) The Gameboard (V3):

(FIGS. 1, 8, and 12): The third-version (V3) chess-type strategy game can be played on any of the composite multiple-concentric-perimeter checkered gameboards of FIGS. 1, 8, and 12, respectively, using the square fifth-perimeter 16 of these three different types of gameboards, as one hundred square playing surface limits. The starting positions may be assigned to the various playing pieces on the one hundred square gameboard, as indicated in FIG. 8.

Figure 8:
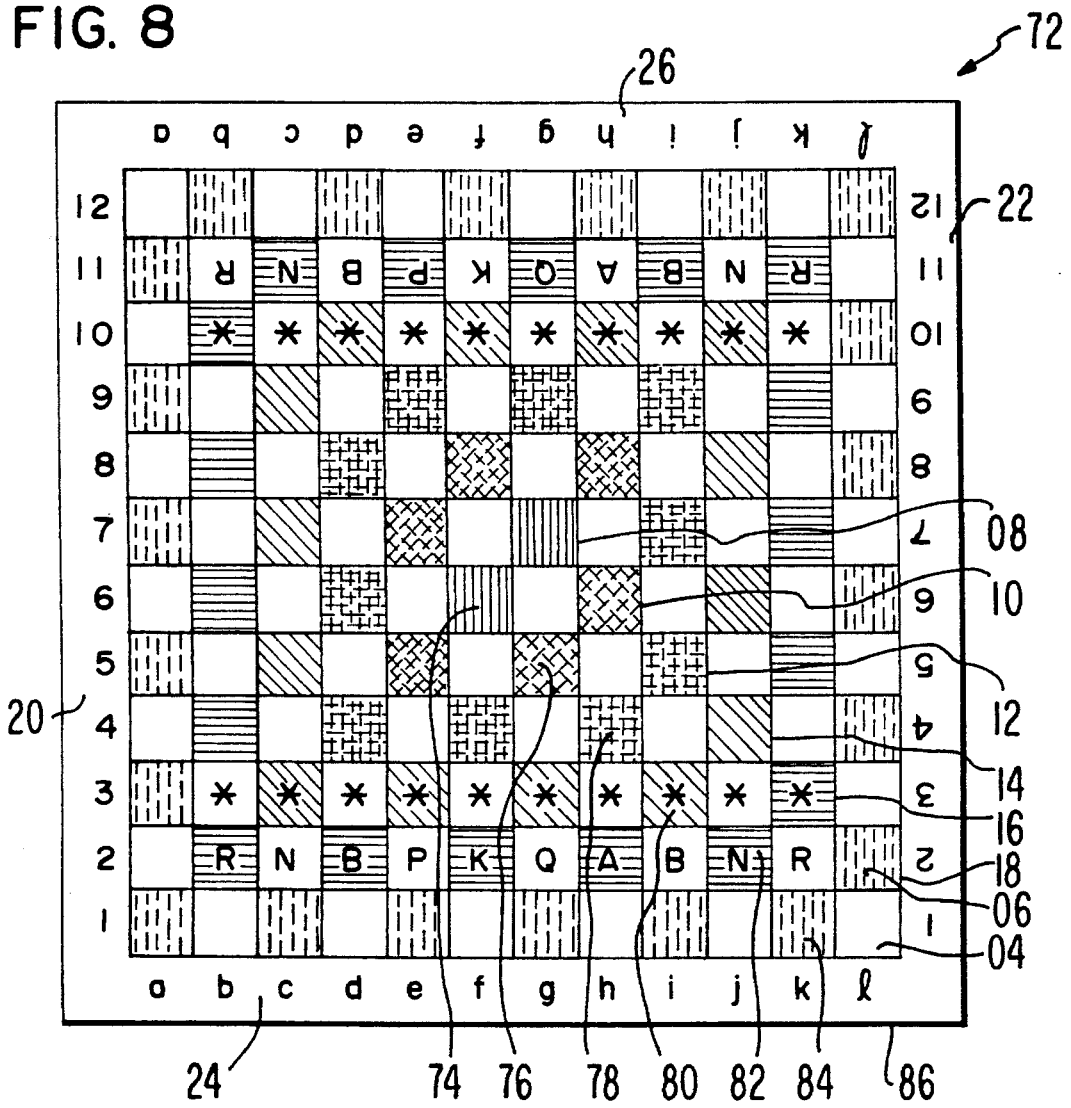

FIG. 8 shows a composite, symmetrical, square, first-alternative multiple-concentric-perimeter checkered gameboard playing surface 72, comprised of several square-shaped concentric checkered playing surfaces, of alternate contrasting squares of several different colors and other humanly sensible indicia, for use with all versions of the present invention. It comprises alternating light squares or non-colored squares 04 and dark squares or colored squares 06. It begins with four central alternately colored squares, the outer edges of which define a central square first-perimeter 08, two of these four alternately colored squares are of a first-color square 74 (red). The central four squares are enclosed by an additional twelve alternately colored squares, six of which are of a second-color square 76 (orange), the outer edges of which define a square second-perimeter 10 which enclose sixteen squares. The central sixteen squares are enclosed by an additional twenty alternately colored squares, ten of which are of a third-color square 78 (yellow) the outer edges of which define a square third-perimeter 12 which enclose thirty-six squares. The central thirty-six squares are enclosed by an additional twenty-eight alternately colored squares, fourteen of which are of a fourth-color square 80 (green) the outer edges of which define a square fourth-perimeter 14 which enclose sixty-four squares. The central sixty-four squares are enclosed by an additional thirty-six alternately colored squares, eighteen of which are of a fifth-color square 82 (blue) the outer edges of which define a square fifth-perimeter 16 which enclose one hundred squares. The central one hundred squares are enclosed by an additional forty-four alternately colored squares, twenty-two of which are of a sixth-color square 84 (violet) the outer edges of which define a square sixth-perimeter 18 which enclose one hundred forty-four squares. The various different colored squares (74, 76, 78, 80, 82, and 84) alternate with the non-colored or light squares 04 to create a checkerboard pattern. The outermost square sixth-perimeter 18 is surrounded by a left-margin with numerical indicia from "1" to "12" 20, and a right-margin with numerical indicia from "1" to "12" 22, identifying ranks; and a lower-margin with alphabetical indicia from "a" to "1" 24, and an upper-margin with alphabetical indicia from "a" to "1" 26, identifying files. These marginal indicia enable any specific square to be located algebraically by a letter, designating the file, followed by a number, designating the rank. The margins are limited by a first-alternative gameboard margin-perimeter 86.

Different symmetrical checkered gameboard sizes can be distinguished by the perimeters established by connecting the outer marginal lines of all squares having the same color, creating a square block of squares within the outer edges of similarly colored alternate squares, and thereby defining a square first-perimeter 08, a square second-perimeter 10, a square third-perimeter 12, a square fourth-perimeter 14, a square fifth-perimeter 16, and a square sixth-perimeter 18. This design defines the borders of each of all progressively larger playing surfaces by color-coding. Thus for the generic first-versions (V1*a*, and V1*b*), the outer edges (square second-perimeter 10, and square third-perimeter 12) of the second-color squares 76 (orange), and the third-color squares 78 (yellow), respectively, define the limits of the playing surface. For the second-versions (V2*a*, and V2*b*), the outer edges (square third-perimeter 12, and square fourth-perimeter 14) of the third-color squares 78 (yellow) , and the fourth-color squares 80 (green), respectively, define the limits of the playing surface. For the third-version (V3), the outer edges (square fifth-perimeter 16) of the fifth-color squares 82 (blue) define the limits of the playing surface. For the fourth-versions (V4*a*, and V4*b*), the outer edges (square fifth-perimeter 16, and square sixth-perimeter 18) of the fifth-color squares 82 (blue), and the sixth-color squares 84 (violet), respectively, define the limits of the playing surface. For the fifth-version (V5), the outer edges (square sixth-perimeter 18) of the sixth-color squares 84 (violet) define the limits of the playing surface.

2) The Playing Pieces (for V3):

a) Number, Composition and Relative Strength:

The various letters given below are abbreviations for playing pieces. The numbers in parentheses indicate the number of specific pieces per player. The letters in parentheses indicate a duplex configuration composition. The numbers in brackets indicate the relative strength of pieces based on the number of squares a particular type of piece can reach from a central square on an empty sixty-four square gameboard.

R=rooks (2):[18]

N=knights (2):[8]

B=bishops (2):[17]

P=crown prince (1):(N / R):[26 ]

K=king (1):[8]

Q=queen (1):(B / R):[35]

A=archbishop (1):(B / N):[25]

Figure 9A:
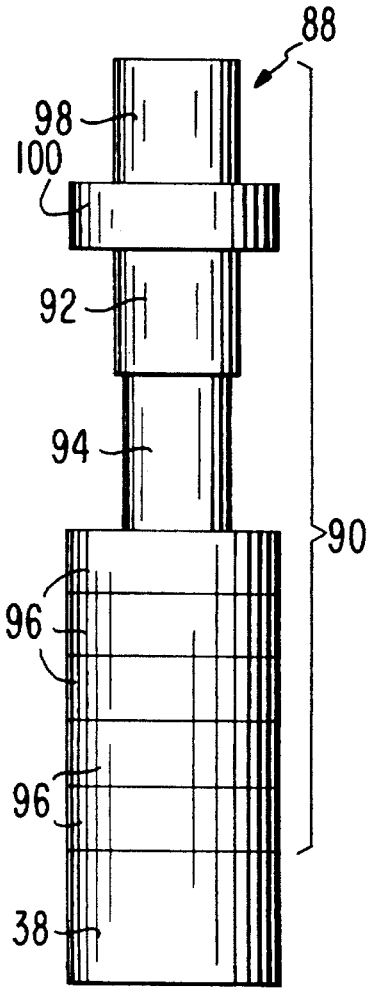
Figure 9B:
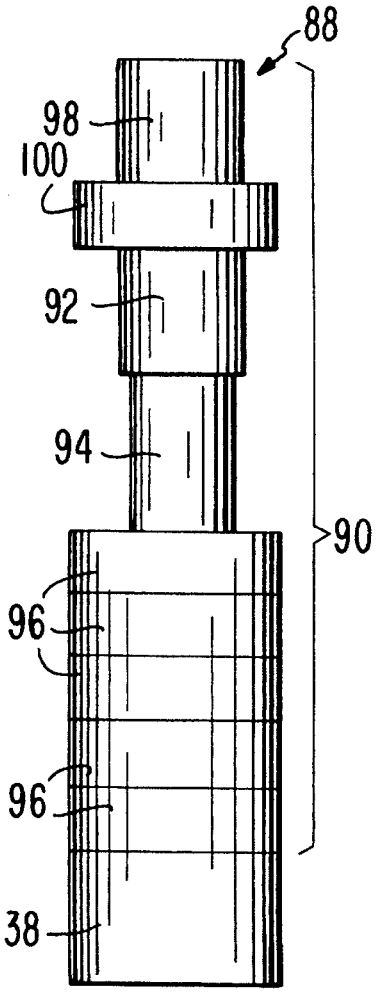
Figure 9C:
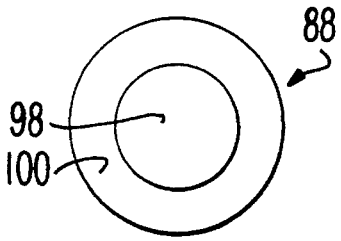
Figure 10A:
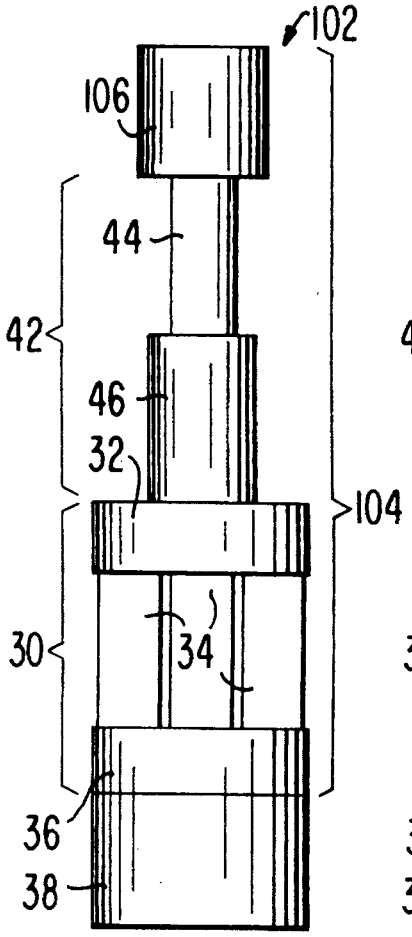
Figure 10B:
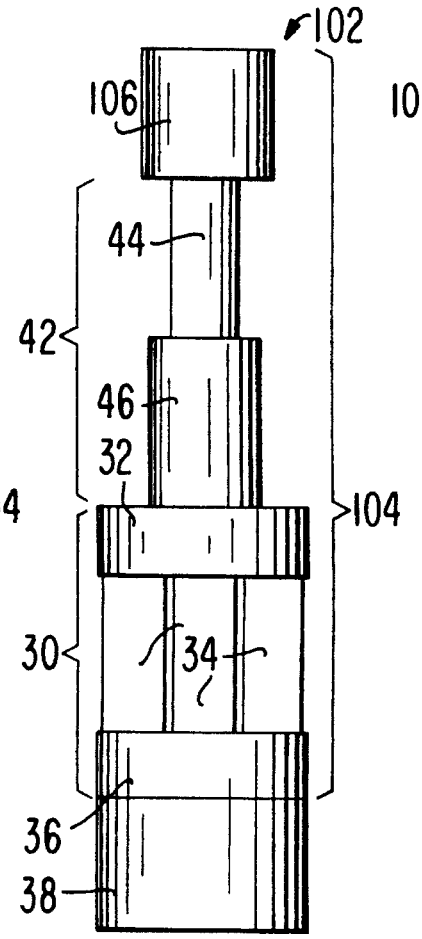
Figure 10C:
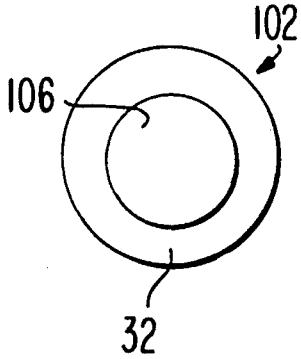
Figure 11A:
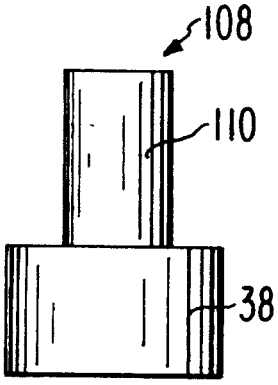
Figure 11B:
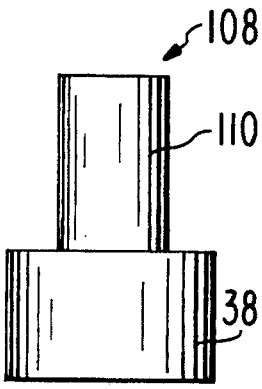
Figure 11C:
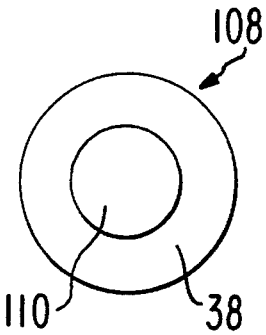

*=pawns (10):[2–4]

b) The Starting Positions of the Playing Pieces (for V3):

(1) as with V2, players may take alternate turns to select any piece and to place it on any square on their own side of the board, this procedure continues until all pieces are positioned on the gameboard, or (b) alternatively, at the beginning of a game the light colored (or otherwise discriminated) playing pieces are positioned as the second and third ranks of the first-alternative multiple-concentric-perimeter checkered gameboard playing surface 72, as shown in FIG. 8, and the dark colored (or otherwise discriminated) pieces are positioned on the tenth and eleventh ranks as indicated by the letters and the asterisks, which represent the abbreviations given above for the various pieces.

c) Detailed Description of the Representational Style Playing Pieces (-R):

The third-version of the chess-type game utilizes all of the generic playing pieces except for the princess, because the queen is substituted for this piece (the operation of the two pieces are identical, the only difference being that the queen has an added tiara). Each player starts with two rooks, two knights, two bishops, one crown-prince, one archbishop, and three new pieces are added: one king, one queen (replacing the princess) and ten pawns.

a) rooks: same as described for V1 above.

b) bishops: same as described for V1 above.

c) knights: same as described for V1 above.

d) a crown-prince: same as described for V1 above.

e) an archbishop: same as described for V1 above.

f) a king: FIGS. 9A, 9B and 9C illustrate an objective representational playing piece or king 88 having an objective representational configuration or objective-structure or king configuration 90 comprising a medium-diameter cylindrical king-head section 92 mounted on a smaller diameter cylindrical king-neck section 94, which is centered and mounted vertically upon five short, large-diameter cylindrical king-torso sections 96. The king configuration 90 further includes a medium-diameter cylindrical crown section 98, which is centered on top of a short, larger diameter cylindrical crown-brim section 100, which is centered and mounted upon the king-head section 92. The complete king configuration 90 is mounted permanently, vertically, and concentrically upon a large-diameter cylindrical pedestal section 38.

g) A queen: FIGS. 10A, 10B and 10C illustrate a substitute-first-duplex representational playing piece or queen 102 comprising a substitute-first-duplex representational configuration or substitute-first-double-tier configuration or queen configuration 104 comprising a queen-tiara section 106 mounted upon an upper-tier bishop configuration 42 mounted permanently and vertically upon a lower-tier rook configuration 30. The upper-tier bishop configuration 42 comprising a tall, small-diameter cylindrical headdress section 44 which is centered and mounted vertically on a medium-diameter cylindrical bishop-torso section 46. The lower-tier rook configuration 30 comprising a short, large-diameter cylindrical parapet section 32 supported horizontally by four solid-rectangular column sections 34 mounted vertically and positioned radially and equidistantly around the circumference of a short, large-diameter cylindrical foundation section 36. This composite structure is crowned with a medium-diameter queen-tiara section 106 mounted permanently, vertically, and concentrically upon the upper end of the headdress section 44. The complete queen configuration 104 is mounted permanently, vertically and concentrically upon a large-diameter cylindrical pedestal section 38. The queen configuration 104 is essentially a princess configuration 62 plus a queen-tiara section 106.

h) Pawns: FIGS. 11A, 11B and 11C illustrate a minimal representational playing piece or pawn 108 having a simple minimal representational configuration or minimal-structure or pawn configuration 110 comprising a medium-diameter cylindrical segment. The pawn configuration 110 being mounted permanently, vertically and concentrically upon a large-diameter cylindrical pedestal section 38.

3) The Method of Play (V3)

A methodology for playing the third-version of the chess-type game is as follows:

a) provide the following elements:

(1) a ten-by-ten checkered gameboard (FIGS. 1 and 8) having one hundred squares, (2) two sets of contrasting pieces, each set having twenty pieces:

(a) pairs of three different types of simplex playing pieces (two rooks, two bishops and two knights) with each different type of simplex playing piece comprising a different simplex configuration representing a different type of movement and capturing potential, (b) three different types of duplex playing pieces (a queen, a crown-prince, and an archbishop), with each different type of duplex playing piece comprising a different duplex configuration derived from two of three different types of simplex configurations, with each duplex configuration representing the two alternative potential movement and capturing patterns of their two simplex components:

[1] queen=bishop, and rook,

[2] crown-prince=knight, and rook,

[3] archbishop=bishop, and knight, (c) one objective playing piece (king) having a singular type of movement and capturing potential;

(d) ten minimal playing pieces (pawns) having a different type of movement and a different capturing potential;

b) move the forty playing pieces on the one hundred square gameboard according to the following rules:

(1) move individual pieces:

(a) first-simplex playing pieces (rooks): by extended movement orthogonally (along ranks or files), in four possible directions and able to capture (captivate or take captive) the first of any opponent pieces encountered in its path by displacement of the opponent's piece from the board, (keeping the captive piece in an upright position off the board), and occupation of the captive piece's former position, whereby any piece "captivated" by rooks can be "liberated" by either pawns reaching any square on the last ranks, or by knights reaching any square on the last rank which is the same color as their queen's starting position square, (b) Second-simplex playing pieces (bishops): by extended movement diagonally, in four possible directions and being able to capture (captivate or take captive) the first of any opponent pieces encountered in its path by displacement of the opponent's piece from the board, (keeping the captive piece in an upright position off the board), and occupation of the captive piece's former position, whereby any piece "captivated" by bishops can be "liberated" by either pawns reaching any square on the last ranks, or by knights reaching any square on the last rank which is the same color as their queen's starting position square, (c) third-simplex playing pieces (knights): by a jumping single-dog-leg movement in one of eight possible directions, by moving two squares orthogonally, followed by one square orthogonally at right angles to the first squares moved, either left or right and can jump over any intervening pieces and capture (annihilate or destroy) any opponent's piece it lands on, by displacement of the opponent's piece from the board, (turning the annihilated piece into the recumbent position upon it's side for the duration of the game), and occupation of that piece's former position, but any piece "annihilated" by a knight cannot be "liberated" by either pawns or knights reaching the last ranks, and knights can liberate only "captivated" pieces by reaching any square on the last rank having the same color as their queen' s starting position square, by exchanging places with the liberated piece, and returning the knight piece to any knight starting position, recorded at the start of each game, but if all of these squares are occupied then the knight is considered captured in the process of liberating another piece and cannot return to the gameboard unless liberated later by another knight or pawn, (d) substitute-first-duplex playing pieces (queens): move and capture (captivate) as either first-simplex or second-simplex playing pieces (either rooks or bishops) as described above, whereby pieces "captivated" by either rook components or bishop components are capable of being "liberated" by either pawns reaching any square on the last ranks, or by knights reaching any square on the last rank which is the same color as their queen' s starting position square, (e) second-duplex playing pieces (crown-princes): move and capture (either captivate or annihilate) as either first-simplex or third-simplex playing pieces (either rooks or knights) as described above, whereby pieces "captivated" by rook components can be "liberated" by either pawns reaching any square on the last ranks, or by knights reaching any square on the last rank which is the same color as their queen's starting position square, but pieces "annihilated" by knight components cannot be liberated for the duration of the game, (f) third-duplex playing pieces (archbishops): move and capture (either captivate or annihilate) as either second-simplex or third-simplex pieces (either bishops or knights) as described above, whereby pieces "captivated" by bishop components can be "liberated" by either pawns reaching any square on the last ranks, or by knights reaching any square on the last rank which is the same color as their queen's starting position square, but pieces "annihilated" by knight components cannot be liberated for the duration of the game, (g) objective playing pieces (kings):

[1] by movement and capturing pattern (e): by movement either one square orthogonally or one square diagonally, in any of eight directions; and can capture (captivate) any opponent's piece so encountered by displacement of the opponent's piece from the board, keeping the captive piece in an upright position off the board, and occupation of the captive piece' s former position, whereby pieces "captivated" by kings can be "liberated" by either pawns reaching any square on the last ranks, or by knights reaching any square on the last rank which is the same color as their queen's starting position square,

[2] "castles" by moving three squares either left or right and the castling rook is brought around to the opposite side of the king, providing:

[a] there are no intervening pieces between the king and the rook,

[b] the king has not been moved previously,

[c] the king is not already "vulnerable" by being in immediate danger of capture (either captivation or annihilation) because of being born upon by an opponent's piece or pieces,

[d] while castling the king does not pass through a square that is born upon by an opponent's piece;

[3] cannot move the king into a "vulnerable" position, that is to any square born upon by an opponent's piece that could capture the king on the next move,

[4] whenever the king is made "vulnerable" by an opponent's piece, the king must be taken out of the "vulnerable" position immediately on the next move, by:

[a] moving the king to a "non-vulnerable" position,

[b] interposition of another piece to block an opponent's "threatening piece", or

[c] capturing the "threatening piece",

[5] if a king is unable to escape from a "vulnerable" position, a player must still move and the king may be either "captivated" (held captive), or "annihilated" (destroyed), and:

[a] if a player' s king is then "annihilated", that is, taken by a pawn, a knight or a composite piece utilizing it's knight component, and if the player's crown-prince is still on the board, then the player can elect to continue the battle by having crown-prince proclaimed a "new-king", and {1} the king piece is then transferred to the square that the crown-prince piece was on at the time of the king's annihilation, and {2} the crown-prince piece is then removed from the board, and since in this case the crown-prince has not been captured, but instead has been transformed into a "new-king", the crown-prince piece is laid upon it's side to indicate that it cannot be liberated by a pawn or a knight for the duration of the game, and {3} following the transposition of the king and crown-prince pieces described in {1} and {2} above, this same player also has the next move, or has the option to surrender, and

[b] if a player's crown-prince is no longer on the board, and if that player's "king", or "new-king" is either "annihilated", or "captivated", then the contest is lost for that player and the game is terminated, (h) ten minimal playing pieces (pawns): by movement and capturing pattern (f):

[1] movement of either one or two squares forward, without capturing, during any turn from any rank on the board,

[2] capture ("annihilate") by moving one square diagonally forward, either left or right, displacing any opponent's piece from the board (turning the annihilated piece upon it's side off of the board for the duration of the game), and occupying the annihilated piece's former position,

[3] whenever an opposing pawn, on an adjacent file to any given pawn, is moved two squares to a square on the same rank as the given pawn, the opposing pawn may be captured ("annihilated"), according to the en passant rule (annihilated "in passing"), as if the opposing pawn had moved only one square, and could have been "taken" by the given pawn on the next move, or alternatively, the opposing pawn may be allowed to pass,

[4] pawns that are advanced to any square on the last ranks:

[a] can "liberate" from captivity any previously "captivated" piece, but not previously "annihilated" pieces,

[b] any "liberated piece" is returned to the board on the same square where the "liberating pawn" entered the last rank,

[c] if no pieces have been captivated except for other pawns, the pawn must remain at the last rank until it can liberate a subsequently captivated piece,

[d] the "liberating pawn" is returned to any pawn starting position, but if all these squares are occupied, then the pawn is considered captured in the process of liberating another piece and is removed from the gameboard for the remainder of the game, and

[e] the "liberating pawn" can be "knighted" or promoted to a knight, but only if a knight has been previously "annihilated", otherwise the pawn remains a pawn.

Figure 12:
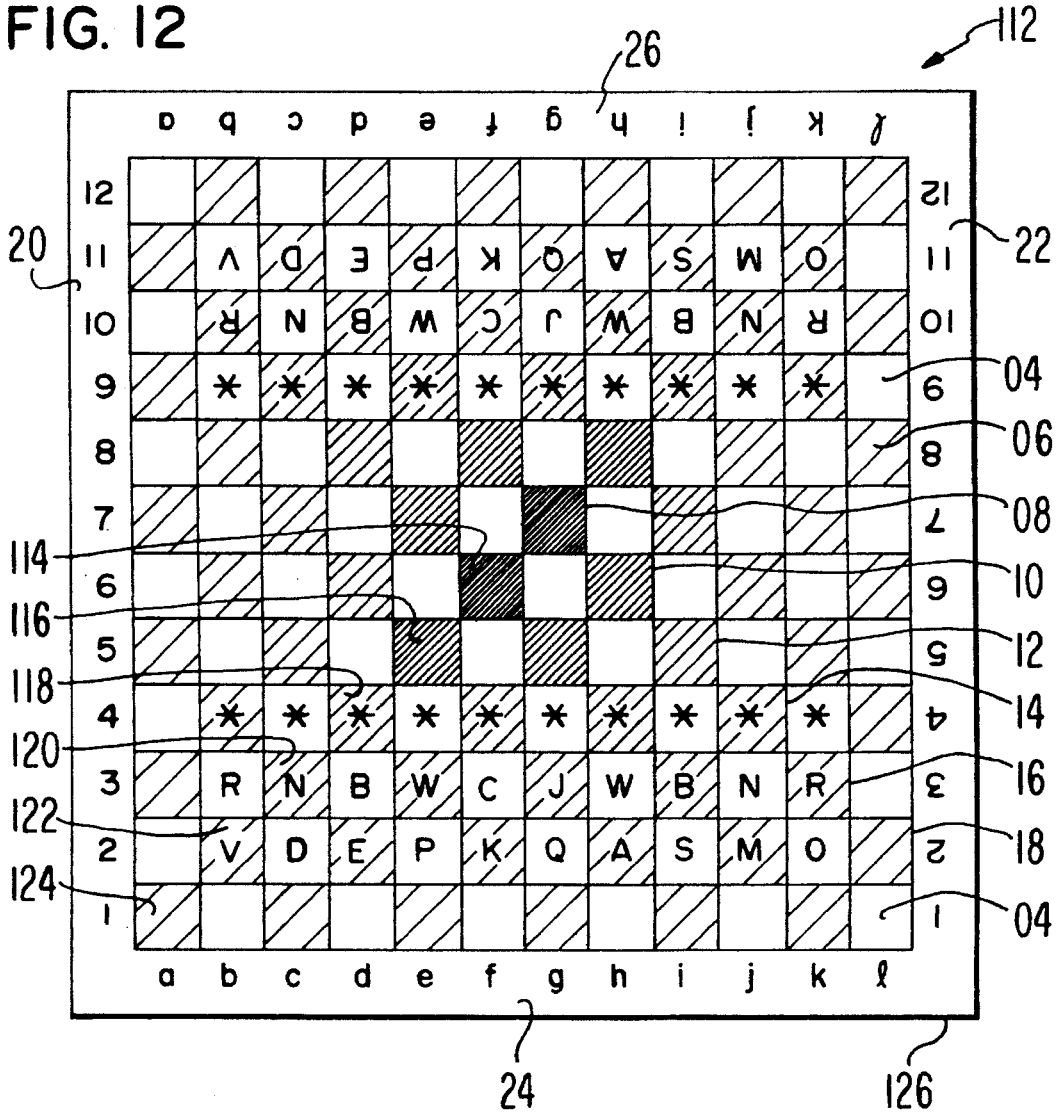

(2) alternate turns:

(a) players can either take alternate turns to select any piece and to place it on any square on their own side of the board, this procedure continues until all pieces are positioned on the game-board, and in addition each player must place their two bishops on opposite colored squares of the gameboard, and (b) alternatively, the playing pieces may have specific assigned starting positions, for example as indicated by the abbreviations designated on the composite first-alternative multiple-concentric-perimeter checkered gameboard playing surface 72, as illustrated in FIG. 8, which also can be used with the gameboards shown in FIG. 1, and FIG. 12.

(c) the player having the light (or otherwise discriminated) pieces has the first turn, (d) players take alternate turns moving one piece at a time in order to:

[1] change the position of a piece,

[2] capture by "captivating" or "taking captive" an opponent's piece,

[3] capture by "annihilating" or "destroying" an opponent's piece,

[4] "liberate" a "captivated" piece, or

[5] "trap and capture" (either trap and "captivate" or trap and "annihilate") the opponent's king.

(3) Winning and scoring games: same as for version-two (V2), but further including:

(a) if a player "captivates" an opponent's king, whether the opponent's crown-prince remains on the board or not, the game is finished, and the winning player is awarded one point, and alternatively, the winning player is awarded the total number of points of all the pieces remaining on the board plus all the points of the captivated pieces belonging to both players, according to the point system below, (b) alternatively, if a player "annihilates" an opponent's king and the opponent's crown-prince is no longer on the board, then the game is also finished and the winning player is awarded one point, and alternatively, the winning player is awarded the total number of points of all pieces remaining on the board plus the points of all the captivated pieces belonging to the losing player, according to the point system below, (c) alternatively, if a player "annihilates" an opponent's king and the opponent's crown-prince remains on the board, then the game is not ended yet, because the opponent's crown-prince can become said new-king by transposition of the king and the crown-prince, (d) alternately, if a player's king is "stalemated" (when a king is not immediately vulnerable to an opposing piece, and the king is the only piece that can be moved, but can only be moved into an immediately vulnerable position), then the game is terminated, and each player is awarded one-half point, and alternatively, each player is awarded the total number of points of their opponent's pieces remaining upon the board, plus the total points of their opponent's pieces captivated during the game, according to the point system below:

[1] pawn=1 point,

[2] knight=3 pts.,

[3] bishop=4 pts.,

[4] rook=5 pts.,

[5] archbishop=7 pts.,

[6] crown-prince=8 pts.,

[7] queen=9 pts.,

[8] king=25 pts., (e) for contests involving a series of games, the player having the highest average score per game (total score divided by the total number of games played), by any of the above means, wins the contest.

(4) Significance of the game: This game is dynamically far superior to conventional chess. The playing pieces are more diverse and better balanced with respect to each other. The two new duplex pieces together with the queen, perfectly counter-balance each other's power, since they are all equally vulnerable to each other. The addition of these pieces greatly multiplies the strategic possibilities of the game. One critical change in the rules provides potentially either a single or a double move for pawns during any move, while simultaneously utilizing the en passant rule over the entire symmetrical one hundred square board. The increased size of the board also justifies allowing knights to share piece liberating powers with pawns, as described previously in version-two. These, as well as the other innovations mentioned above, create a far more interesting game that also progresses to end games and to drawn games less frequently than conventional chess.

D) The Fourth-Versions of the Chess-Type Strategy Game (V4*a*, and V4*b*):

(Gameboard, Playing Pieces, and Method): (FIGS. 1; 2A, 2B, 2C; 3A, 3B, 3C; 4A, 4B, 4C; 5A, 5B, 5C; 6A, 6B, 6C; 7A, 7B, 7C; 11A, 11B, 11C; 12; 13A, 13B, 13C; 14A, 14B, 14C; 15A, 15B, 15C; 16A, 16B, 16C; 17A, 17B, 17C; 18A, 18B, 18C; 19A, 19B, 19C; 20A, 20B, 20C; 21A, 21B, 21C; 22A, 22B, and 22C).

The fourth-versions of the chess-type game utilize all of the generic playing pieces (including the princess) and the pawns of the third-version. A king-II and a queen-II utilized in these games replace the original king and original queen used in the third-version. The queen-II is now a triplex playing piece and there are three other triplex playing pieces: a crown-prince-II, a counsellor and an archbishop-II. There are six duplex playing pieces: the princess, a duke (formerly called the crown-prince of the first, second, and third versions), an earl (formerly called the archbishop of the first, second, and third versions), and three new duplex playing pieces: a marquess, a viscount and a baron. There are now four types of simplex playing pieces: two rooks, two bishops, two knights, and two new bowmen. There is also a singular court-jester. Each player has a total of thirty playing pieces. This game can be played upon either (a) a one hundred square board (for V4*a*), or (*b*) a one hundred forty-four square board (for V4*b*) which is 44% larger than the gameboard for V3 and V4*a*.

1) The Gameboards (of V4*a* and V4*b*): (FIGS. 1, 8, and 12):

a) Variation "a" of the fourth-version (V4), (or chess-type strategy game V4*a*) can be played upon any of the various composite multiple-concentric-perimeter checkered gameboard playing surfaces illustrated in FIGS. 1, 8, and 12, respectively, using the square fifth-perimeter 16 of any of the various multi-concentric-perimeter gameboards as a one hundred square playing surface limit. The starting positions assigned to the various playing pieces on a one hundred square gameboard for the fourth-version-variation-"a" (or chess-type strategy game V4*a*) are shown in FIG. 12. In this variation of the game, the outside rows of squares and outside files of squares, totaling forty-four squares, cannot be used by either player for placement of any pieces during the game.

b) Variation "b" of the fourth-version (V4), (or chess-type game V4*b*) can be played on any of the composite multiple-concentric-perimeter checkered gameboard playing surfaces illustrated in FIGS. 1, 8, and 12 by using the square sixth-perimeter 18 (violet) of the various gameboards as a one hundred forty-four square playing surface limit. The starting positions assigned to the various playing pieces on a one hundred forty-four square gameboard for the fourth-version-variation-"b" (or chess-type strategy game V4*b*) are shown in FIG. 12. In this variation of the game the entire board can be used by either player for placement of pieces during the game.

FIG. 12 shows a composite, symmetrical, second-alternative multiple-concentric-perimeter checkered gameboard playing surface 112, comprising several square-shaped concentric checkered playing surfaces, of alternate contrasting squares of several different shades of color and other humanly sensible indicia, for use with all versions of the present invention. It comprises alternating light squares or non-shaded squares 04 and dark squares or shaded squares 06, respectively. The central four alternate contrasting squares are enclosed by a square first-perimeter 08, two of these alternate contrasting squares are a first-shade square 114 (first-darkest). The central four squares are enclosed by an additional twelve alternate contrasting squares, six of which are a second-shade square 116 (second-darkest), the outer edges of which define a square second-perimeter 10 which enclose a gameboard of sixteen squares. The central sixteen squares are enclosed by an additional twenty alternate contrasting squares, ten of which are a third-shade square 118 (third-darkest) the outer edges of which define a square third-perimeter 12 which enclose a gameboard of thirty-six squares. The central thirty-six squares are enclosed by an additional twenty-eight alternate contrasting squares, fourteen of which are a fourth-shade square 120 (third-lightest) the outer edges of which define a square fourth-perimeter 14 which enclose a gameboard of sixty-four squares. The central sixty-four squares are enclosed by an additional thirty-six alternate contrasting squares, eighteen of which are a fifth-shade square 122 (second-lightest) the outer edges of which define a square fifth-perimeter 16 which enclose a gameboard of one hundred squares. The central one hundred squares are enclosed by an additional forty-four alternate contrasting squares, twenty-two of which are a sixth-shade square 124 (first-lightest) the outer edges of which define a square sixth-perimeter 18 which enclose a gameboard of one hundred forty-four squares. The various different graded shades of squares (114, 116, 118, 120, 122, and 124) alternate with the light squares or non-shaded squares 04 to create a checkerboard pattern. The square sixth-perimeter 18 is surrounded by a left-margin with numerical indicia from "1" to "12" 20, and a right-margin 22 with numerical indicia from "1" to "12" 22, indicating rows or ranks; and a lower-margin with alphabetical indicia from "a" to "1" 24, and an upper-margin with alphabetical indicia from "a" to "1" 26, indicating columns or files. These marginal indicia enable any given square to be located or designated algebraically by a letter, the file, followed by a number, the rank. The margins are limited by a second-alternative gameboard margin perimeter 126.

Different checkered gameboard sizes can be distinguished by the various concentric perimeters established by the outer marginal lines of those squares having the same shade of squares. This design defines the borders of each of the six progressively larger playing surfaces by shade-coding. Thus for the generic first-versions (V1*a*, and V1*b*), the outer edges (square second-perimeter 10) of the second-darkest squares or second-shade squares 116 (for V1*a*), and alternatively, the outer edges (square third-perimeter 12) of the third-darkest squares or fourth-shade squares 118 (for V1*b*), define the limits of the playing surface. For the second-versions (V2*a*, and V2*b*), the outer edges (square third-perimeter 12) of the third-darkest squares or third-shade squares 118 (for V2*a*), and alternatively, the outer edges (square fourth-perimeter 14) of the third-lightest squares or fourth-shade squares 120 (for V2*b*) define the limits of the playing surface. For the third-version (V3), the outer edges (square fifth-perimeter 16) of the second-lightest squares or fifth-shade squares 122 define the limits of the playing surface. For the fourth-versions (V4*a*, and V4*b*), the outer edges (square fifth-perimeter 16) of the second-lightest squares or fifth-shade squares 122 (for V4*a*), and alternatively, the outer edges (square sixth-perimeter 18) of the first-lightest squares or sixth-shade squares 124 (for V4*b*) define the limits of the playing surface. For the fifth-version (V5) the outer edges (square sixth-perimeter 18) of the first-lightest squares or sixth-shade squares 124 define the limits of the playing surface.

2) The Playing Pieces (for V4*a*, and V4*b*):

a ) Number, Composition, and Relative Strength:

Abbreviations for the names of the various playing pieces are as listed below. The numbers in parentheses indicate the number of those pieces per player. The letters in parentheses indicate duplex and triplex composition. The numbers in braces indicate the relative strengths of the pieces based on the number of squares that a particular type of piece can reach from a central square on an empty one hundred forty-four square gameboard (for V4*b*). The same number of playing pieces are used for both V4*a* and V4*b*.

R=rooks (2):[22]

N=knights (2):[8]

B=bishops (2):[21]

W=bowmen (2):[8–16]

V=viscount (1):(B / W):[16]

D=duke (1):(R / N):[30]

E=earl (1):(B / N):[29]

P=crown-prince-II (1):(W / N / R):[38]

J=court jester (1):[8–16]

Q=queen-II (1):(B / N / R):[51]

K=king-II (1):[8]

A=archbishop-II (1):(B / W / N):[37]

C=counsellor (1):(B / W / R):[51]

S=princess (1):(B / R):[43]

M=marquess (1):(W / R):[30]

O=baron (1):(W / N):[16]

*=pawns (10):(2–4)

b) The Starting Positions of the Playing Pieces (V4*a* and V4*b*):

(1) either the players can take alternate turns to select any piece and to place it on any square on their own side of the board, and this procedure continues until all pieces are positioned on the gameboard, or (2) alternatively, the playing pieces may have assigned starting positions. FIG. 12 shows a composite second-alternate multiple-concentric-perimeter gameboard playing surface 112 as previously described but also shows the relative starting positions of the various playing pieces when utilizing this gameboard for the fourth-versions (V4*a* and V4*b*) of the game. At the beginning of a game the light colored (or otherwise discriminated) playing pieces are positioned on the second, third, and fourth ranks and the dark colored (or otherwise discriminated) pieces are positioned on the ninth, tenth, and eleventh ranks of the gameboard playing surface 112 of FIG. 12, as indicated by the letters and the asterisks.

The fourth-versions (V4*a*, and V4*b*) can also be played on gameboard 02 of FIG. 1, and gameboard 72 of FIG. 8.

C) Detailed Description of the Representational Style Playing Pieces (for V4*a* and V4*b*):

The fourth-versions of the chess-type game utilize all of the playing pieces of V3, (except the king and queen), a pair of additional minimal playing pieces (pawns), a pair of new fourth-simplex playing pieces (bowmen), three additional new duplex pieces, four new triplex pieces, a substitute king and substitute queen, and a new singular playing piece. Each player starts with two rooks, two bishops, two knights, two bowmen, a princess, a duke, a marquess, an earl, a viscount, a baron, a queen-II, a crown-prince-II, a counsellor, an archbishop-II, a king-II, a court-jester, and ten pawns:

(1) rooks: same as described for V1 above.

(2) bishops: same as described for V1 above.

(3) knights: same as described for V1 above.

Figure 13A:
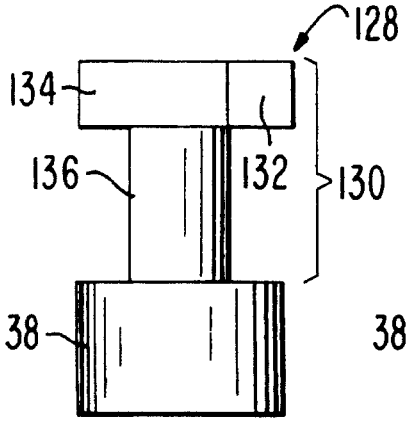
Figure 13B:
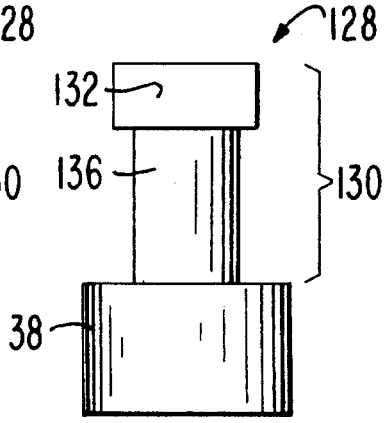
Figure 13C:
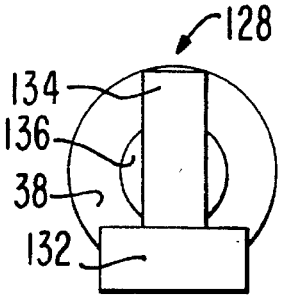

(4) bowmen: FIGS. 13A, 13B and 13C illustrate a fourth-simplex representational playing piece or bowman 128 comprising a fourth-simplex representational configuration or fourth-single-tier configuration or bowman configuration 130 comprising a horizontal solid-rectangular crossbow section 132 joined at right angles at its midsection to one end of another solid-rectangular stock and arrow section 134 mounted horizontally on a vertical medium-diameter cylindrical bowman-torso section 136; the complete bowman configuration 130 being mounted permanently, vertically and concentrically upon a large-diameter solid cylindrical pedestal section 38.

(5) a princess: same as previously described in V1 above.

(6) a duke: same as previously described for crown-prince in V1 above.

Figure 14A:
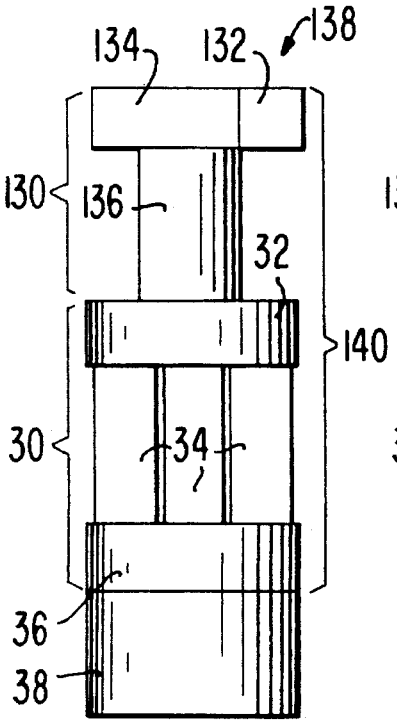
Figure 14B:
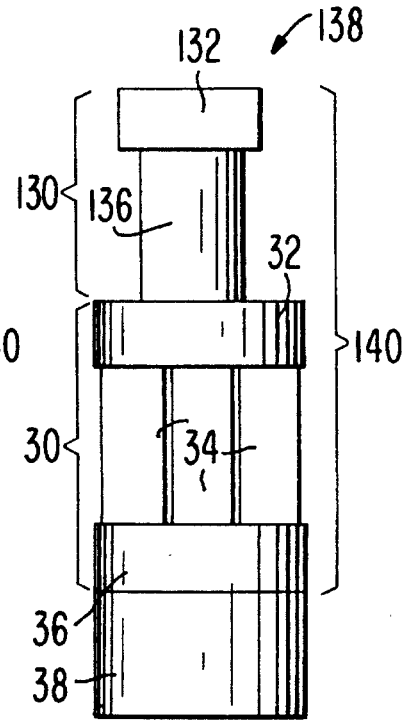
Figure 14C:
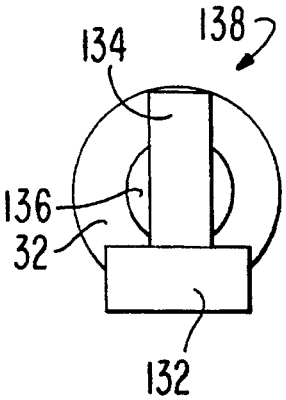

(7) a marquess: FIGS. 14A, 14B and 14C illustrate a fourth-duplex representational playing piece or marquess 138 comprising a fourth-duplex representational configuration or fourth-double-tier configuration or marquess configuration 140 comprising an upper-tier bowman configuration 130 having a horizontal solid-rectangular crossbow section 132 joined at right angles at its midsection to one end of a solid-rectangular stock and arrow section 134 mounted horizontally on a vertical medium-diameter cylindrical bowman-torso section 136; the upper-tier bowman configuration 130 being mounted permanently and vertically upon a lower-tier rook configuration 30 comprising a short, large-diameter cylindrical parapet section 32 supported horizontally by four solid-rectangular column sections 34 mounted vertically and positioned radially and equidistantly around the circumference of a short, large-diameter cylindrical foundation section 36; the complete marquess configuration 140 being mounted permanently, vertically and concentrically upon a large-diameter cylindrical pedestal section 38.

(8) an earl: same as described for archbishop in V1 above.

Figure 15A:
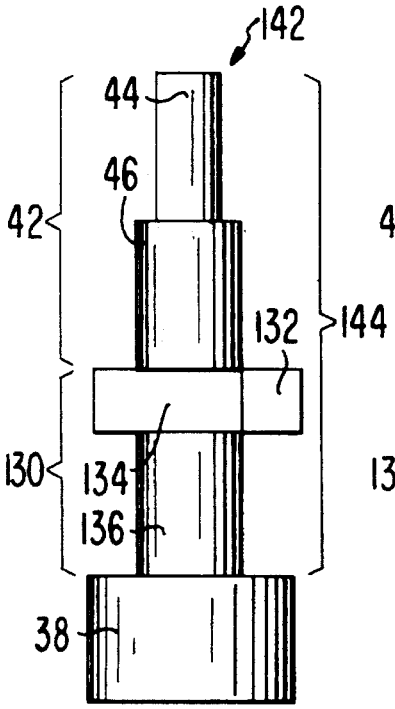
Figure 15B:
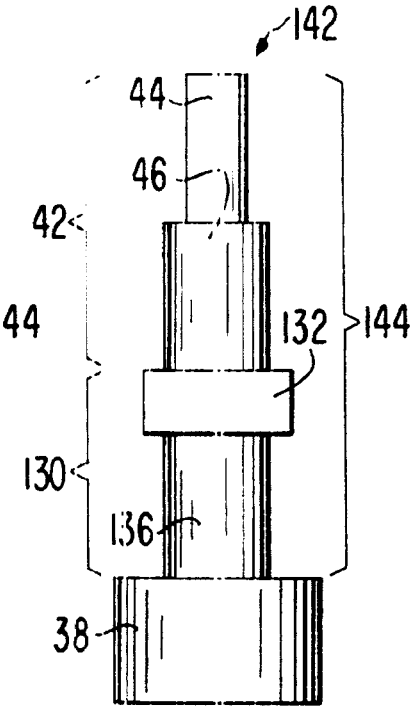
Figure 15C:
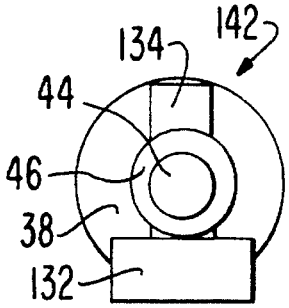

(9) a viscount: FIGS. 15A, 15B and 15C illustrate a fifth-duplex representational playing piece or a viscount 142 comprising a fifth-duplex representational configuration or fifth-double-tier configuration or viscount configuration 144 comprising an upper-tier bishop configuration 42 comprising a tall, small-diameter cylindrical headdress section 44 which is centered and mounted vertically on a medium-diameter cylindrical bishop-torso section 46; the upper-tier bishop configuration 42 being mounted permanently and vertically upon a lower-tier bowman configuration 130 comprising a horizontal solid-rectangular crossbow section 132 joined at right angles at its midsection to one end of another solid-rectangular stock and arrow section 134 mounted horizontally on a vertical medium-diameter cylindrical bowman-torso section 136; the complete viscount representational configuration 144 being mounted permanently, vertically and concentrically upon a large-diameter cylindrical pedestal section 38.

Figure 16A:
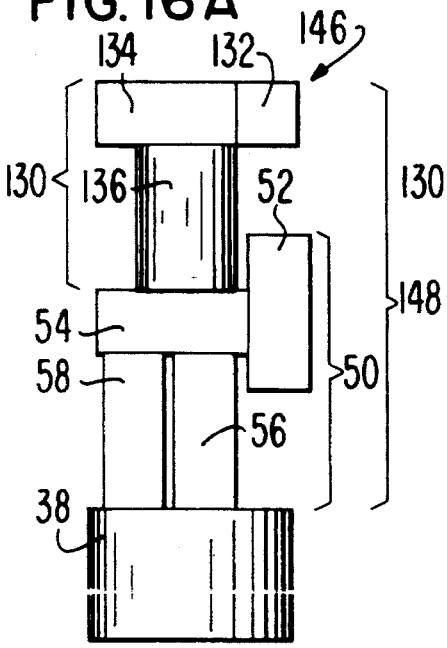
Figure 16B:
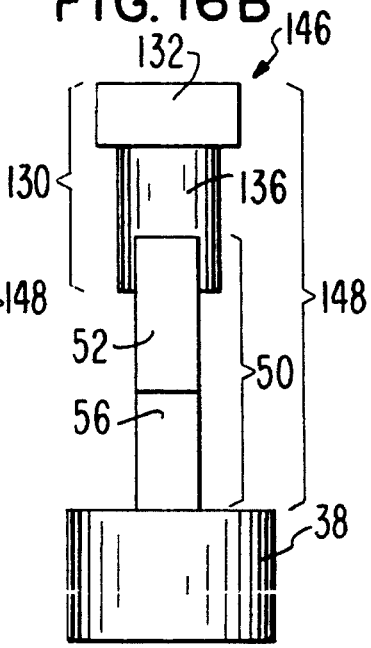
Figure 16C:
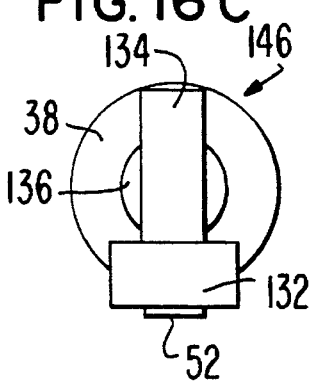

(10) a baron: FIGS. 16A, 16B and 16C illustrate a sixth-duplex representational playing piece or baron 146 comprising a sixth-duplex representational configuration or sixth-double-tier configuration or baron configuration 148 comprising an upper-tier bowman configuration 130 comprising a horizontal solid-rectangular crossbow section 132 joined at right angles at its midsection to one end of another solid-rectangular stock and arrow section 134 mounted horizontally on a vertical medium-diameter cylindrical bowman-torso section 136; the upper-tier bowman configuration 130 being mounted permanently and vertically upon a lower-tier knight configuration 50 comprising a vertical solid-rectangular horse-head section 52 connected at its midsection at right angles to one end of a horizontal solid-rectangular horse-body section 54 supported near both ends by two parallel solid-rectangular leg segments, front-legs section 56 and hind-legs section 58; the complete baron configuration 148 being mounted permanently, vertically and concentrically upon a large-diameter cylindrical pedestal section 38.

Figure 17A:
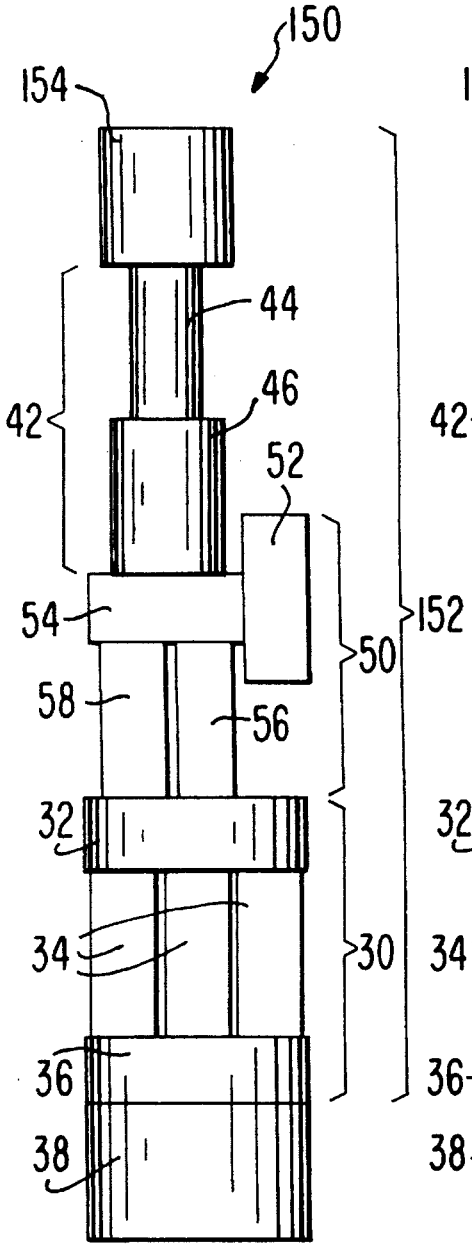
Figure 17B:
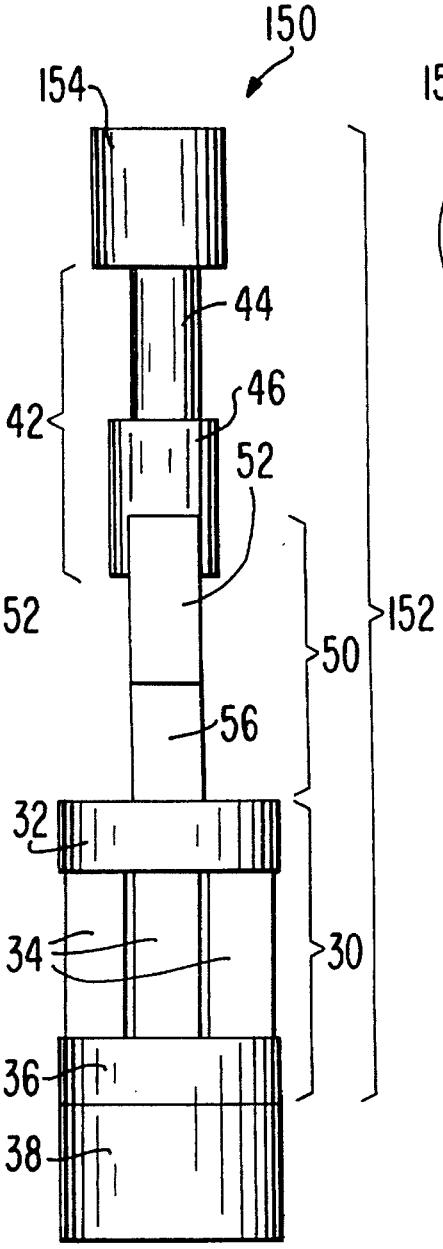
Figure 17C:
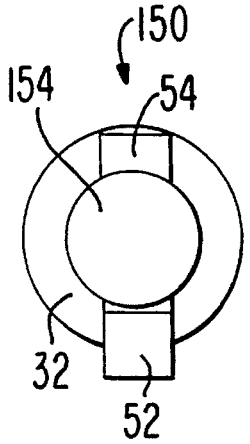

(11) A queen-II: FIGS. 17A, 17B, and 17C illustrate a first-triplex representational playing piece or queen-II 150 comprising a first-triplex representational configuration or first-triple-tier configuration or queen-II configuration 152 comprising an upper-tier bishop configuration 42 comprising a tall, small-diameter cylindrical headdress section 44 which is centered and mounted vertically on a medium-diameter cylindrical bishop-torso section 46; the upper-tier bishop configuration 42 being mounted permanently and vertically upon a middle-tier knight configuration 50 comprising a vertical solid-rectangular horse-head section 52 connected at its midsection at right angles to one end of a horizontal solid-rectangular horse-body section 54 supported near both ends by two parallel solid-rectangular leg segments, front-legs section 56 and hind-legs section 58; the middle-tier knight configuration 42 being mounted permanently and vertically upon a lower-tier rook configuration 30 comprising a short, large-diameter cylindrical parapet section 32 supported horizontally by four solid-rectangular column sections 34 mounted vertically and positioned radially and equidistantly around the circumference of a short, large-diameter cylindrical foundation section 36; and being crowned with a medium-diameter tiara section 154 mounted permanently, vertically and concentrically upon the upper end of the headdress section 44; the complete queen-II configuration 152 being mounted permanently, vertically and concentrically upon a large-diameter cylindrical pedestal section 38.

Figure 18A:
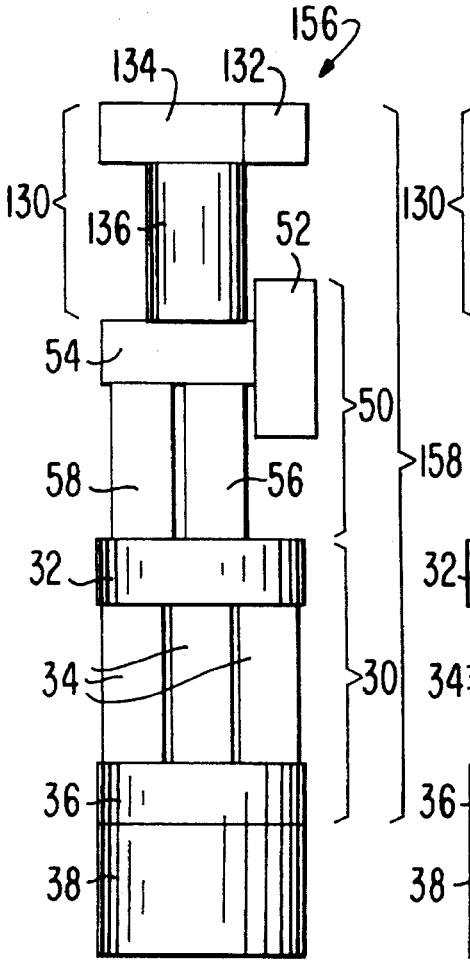
Figure 18B:
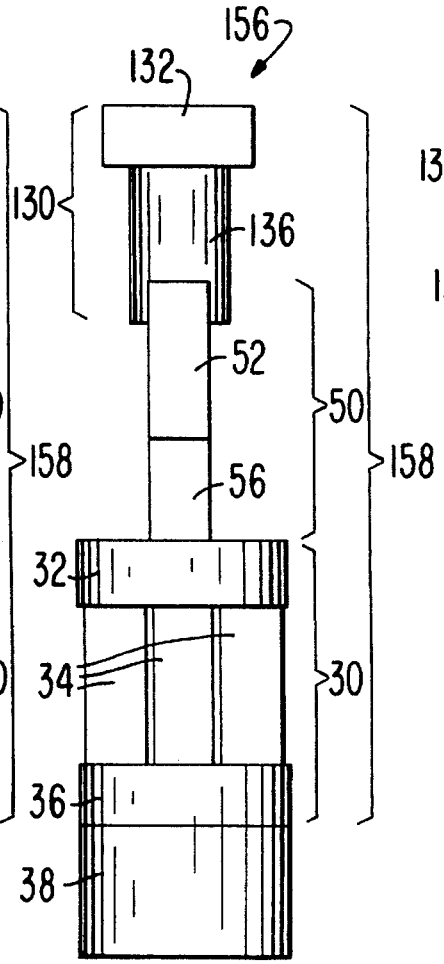
Figure 18C:
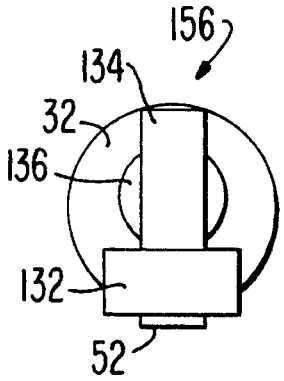

(12) A crown-prince-II: FIGS. 18A, 18B, and 18C illustrate a second-triplex representational playing piece or crown-prince-II 156 comprising a second-triplex representational configuration or second-triple-tier configuration or crown-prince-II configuration 158 comprising an upper-tier bowman configuration 130 comprising a horizontal solid-rectangular crossbow section 132 joined at right angles at its midsection to one end of another solid-rectangular stock and arrow section 134 mounted horizontally on a vertical medium-diameter cylindrical bowman-torso section 136; the upper-tier bowman configuration 130 being mounted permanently and vertically upon a middle-tier knight configuration 50 comprising a vertical solid-rectangular horse-head section 52 connected at its midsection at right angles to one end of a horizontal solid-rectangular horse-body section 54 supported near both ends by two parallel solid-rectangular leg segments, a front-legs section 56 and a hind-legs section 58; the middle-tier knight configuration 42 being mounted permanently and vertically upon a lower-tier rook configuration 30 comprising a short, large-diameter cylindrical parapet section 32 supported horizontally by four solid-rectangular column sections 34 mounted vertically and positioned radially and equidistantly around the circumference of a short, large-diameter cylindrical foundation section 36; the complete crown-prince-II configuration 158 being mounted permanently, vertically and concentrically upon a large-diameter cylindrical pedestal section 38.

Figure 19A:
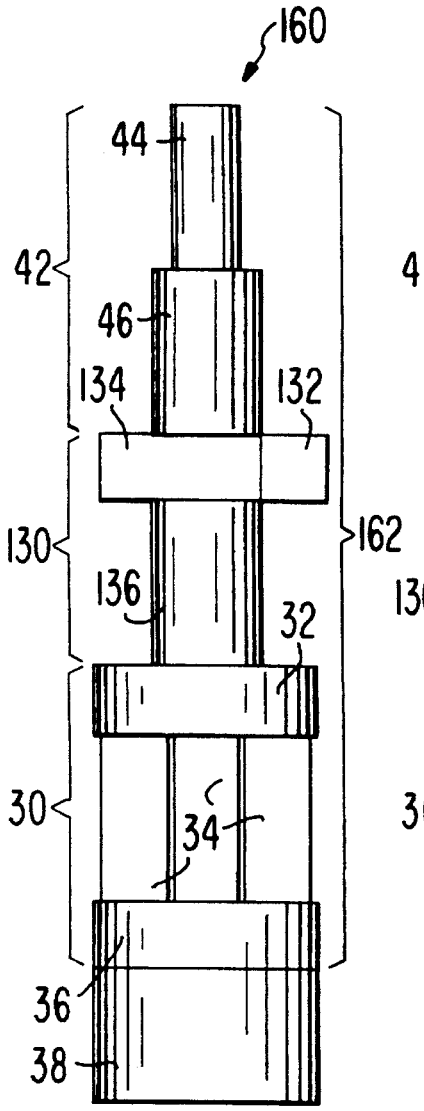
Figure 19B:
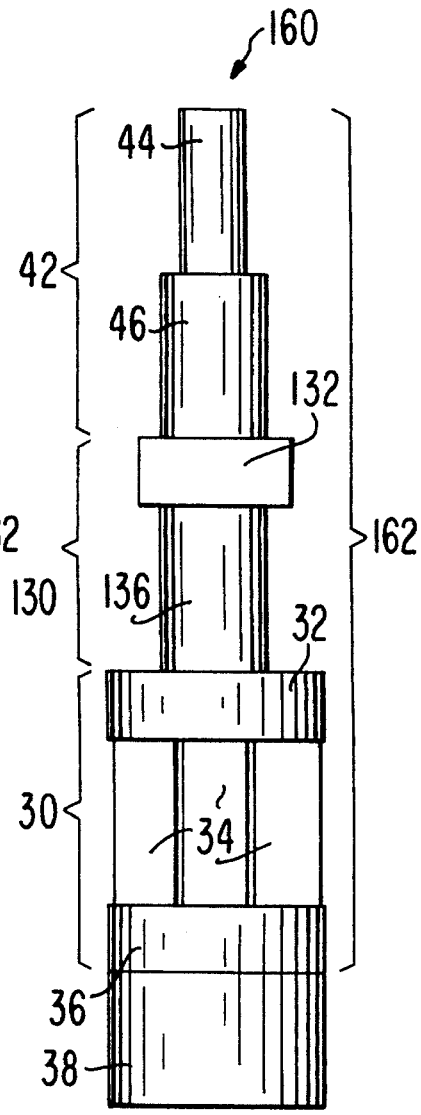
Figure 19C:
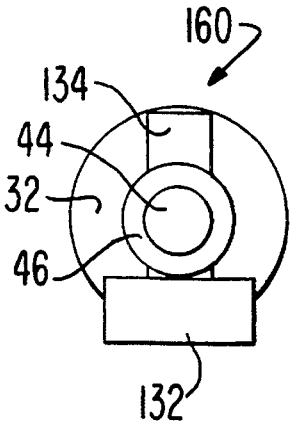

(13) a counsellor: FIGS. 19A, 19B, and 19C illustrate a third-triplex representational playing piece or counsellor 160 comprising a third-triplex representational configuration or third-triple-tier configuration or counsellor configuration 162 comprising an upper-tier bishop configuration 42 comprising a tall, small-diameter cylindrical headdress section 44 which is centered and mounted vertically on a medium-diameter cylindrical bishop-torso section 46; the upper-tier bishop configuration 42 being mounted permanently and vertically upon a middle-tier bowman configuration 130 comprising a horizontal solid-rectangular crossbow section 132 joined at right angles at its midsection to one end of another solid-rectangular stock and arrow section 134 mounted horizontally on a vertical medium-diameter cylindrical bowman-torso section 136; the middle-tier bowman configuration 130 being mounted permanently and vertically upon a lower-tier rook configuration 30 comprising a short, large-diameter cylindrical parapet section 32 supported horizontally by four solid-rectangular column sections 34 mounted vertically and positioned radially and equidistantly around the circumference of a short, large-diameter cylindrical foundation section 36; the complete counsellor configuration 162 being mounted permanently, vertically and concentrically upon a large-diameter cylindrical pedestal section 38.

Figure 20A:
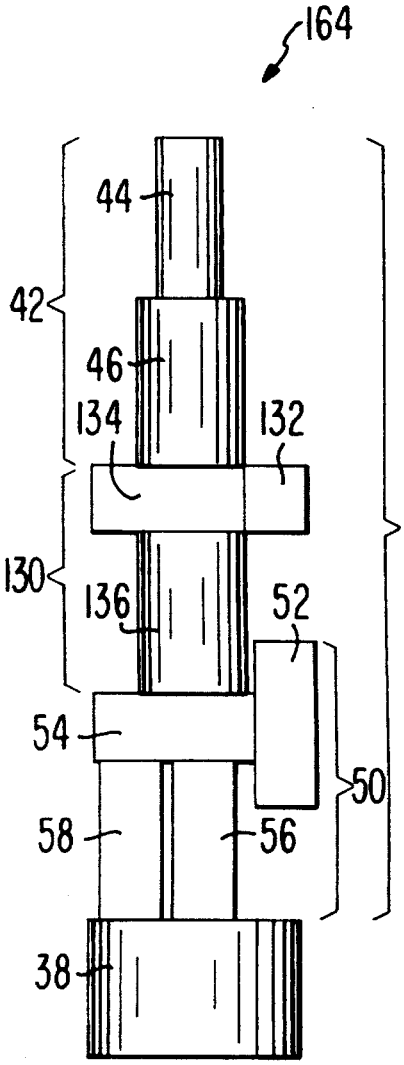
Figure 20B:
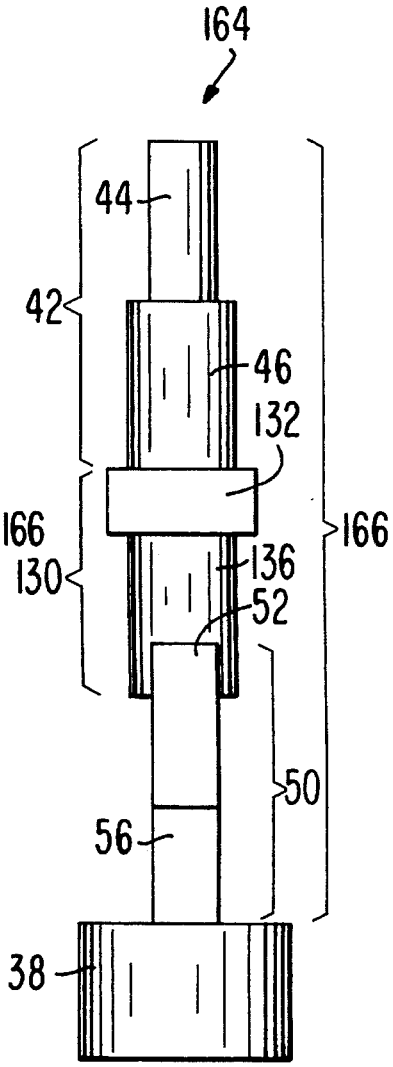
Figure 20C:
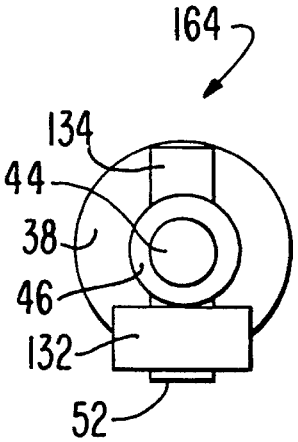

(14) An archbishop-II: FIGS. 20A, 20B, and 20C illustrate a fourth-triplex representational playing piece or archbishop-II 164 comprising a fourth-triplex representational configuration or fourth-triple-tier configuration or archbishop-II configuration 166 comprising an upper-tier bishop configuration 42 comprising a tall, small-diameter cylindrical headdress section 44 which is centered and mounted vertically on a medium-diameter cylindrical bishop-torso section 46; the upper-tier bishop configuration 42 being mounted permanently and vertically upon a middle-tier bowman configuration 130 comprising a horizontal solid-rectangular crossbow section 132 joined at right angles at its midsection to one end of another solid-rectangular stock and arrow section 134 mounted horizontally on a vertical medium-diameter cylindrical bowman-torso section 136; the middle-tier bowman configuration 130 being mounted permanently and vertically upon a lower-tier rook configuration 30 comprising a short, large-diameter cylindrical parapet section 32 supported horizontally by four solid-rectangular column sections 34 mounted vertically and positioned radially and equidistantly around the circumference of a short, large-diameter cylindrical foundation section 36; the complete archbishop-II configuration 166 being mounted permanently, vertically and concentrically upon a large-diameter cylindrical pedestal section 38.

Figure 21A:
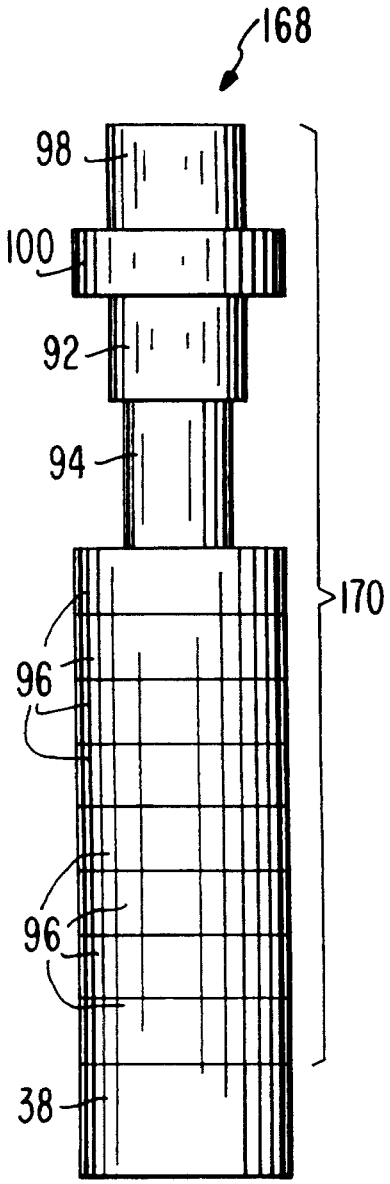
Figure 21B:
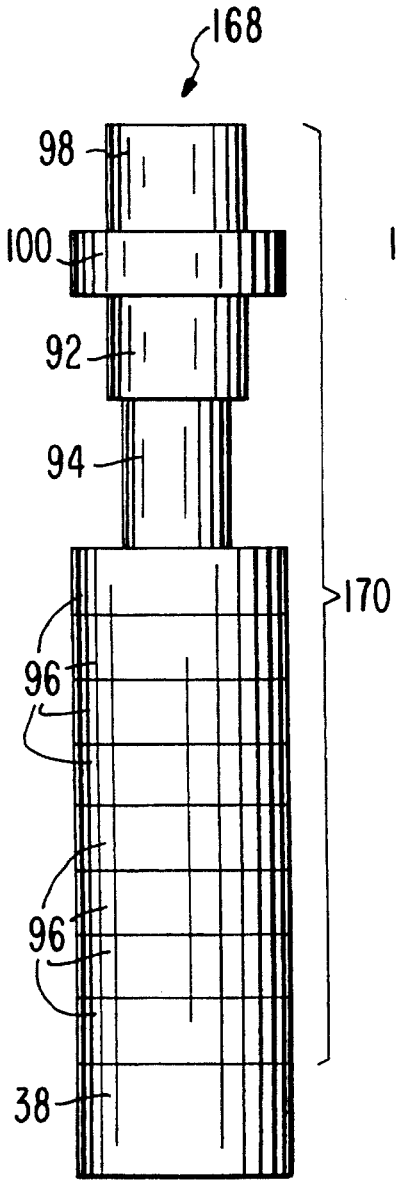
Figure 21C:
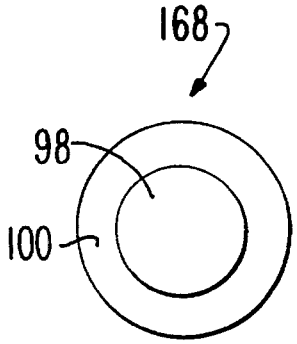

(15) A king-II: FIGS. 21A, 21B and 21C illustrate the substitute-objective representational playing piece or king-II 168 having a unique substitute-objective configuration or substitute-objective-structure or king-II configuration 170 comprising a medium-diameter cylindrical king-head section 92 mounted on a smaller diameter cylindrical king-neck section 94, which is centered and mounted vertically upon eight vertically stacked short, large-diameter cylindrical king-II-torso sections 96', the king-II having three more vertically stacked torso sections than the original king; the king-II configuration 170 further includes a medium-diameter cylindrical crown section 98, which is centered on top of a short, larger diameter cylindrical crown-brim section 100, which is centered and mounted upon the king-head section 92; the entire king-II configuration 170 being mounted permanently, vertically and concentrically upon a large-diameter cylindrical pedestal section 38.

Figure 22A:
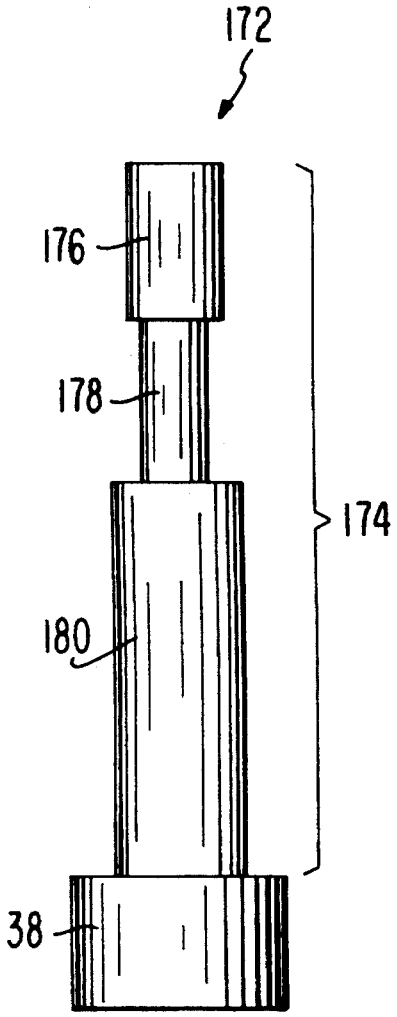
Figure 22B:
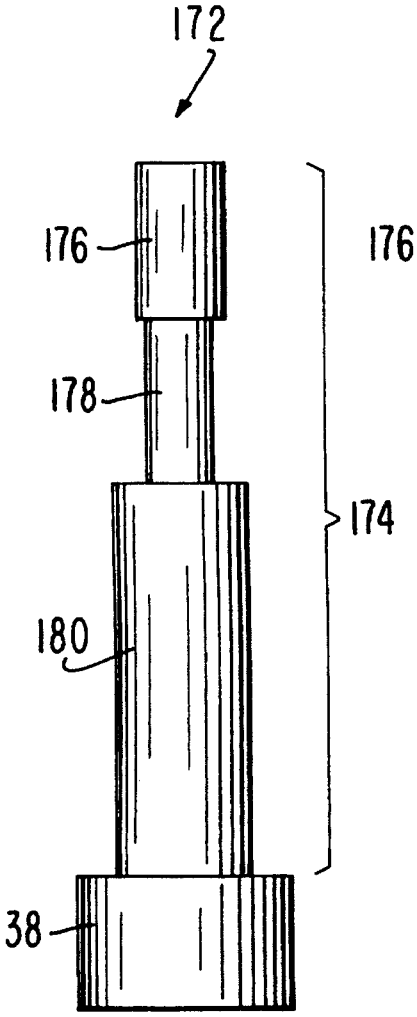
Figure 22C:
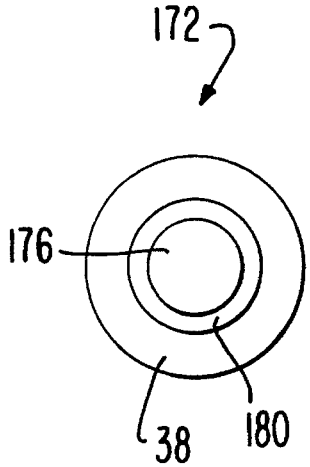

(16) a court-jester: FIGS. 22A, 22B and 22C illustrate a singular representational playing piece or court-jester 172 having a singular representational configuration or singular-structure or court-jester configuration 174 comprising a medium-diameter cylindrical court-jester-head section 176 mounted vertically and concentrically on a smaller diameter cylindrical court-jester-neck section 178 mounted vertically and concentrically on a tall, medium-diameter cylindrical court-jester-torso section 180; the complete court-jester configuration 174 being mounted permanently, vertically and concentrically upon a large-diameter cylindrical pedestal section 38.

3) The Method of Play: (for V4*a*, and V4*b*)

A methodology for playing the fourth-versions (V4*a*, and V4*b*) of the chess-type game is as follows:

a) provide the following elements:

(1) the gameboards: (FIGS. 1, 8, and 12)

(a) a ten-by-ten checkered gameboard having one hundred squares, for V4*a*, and (b) alternatively, a twelve-by-twelve checkered gameboard having one hundred forty-four squares, for V4*b*, (2) two sets of contrasting pieces, each set having:

(a) four different types of simplex playing pieces (two rooks, two bishops, two knights and two bowmen) with each different type of simplex playing piece comprising a different simplex configuration representing a specific potential movement and capturing pattern for each different type of simplex playing piece, and (b) six different types of duplex playing pieces (a princess, a duke, a marquess, an earl, avis-count, and a baron) with each different type of duplex playing piece comprising a different composite duplex configuration having two different types of simplex configurations representing two alternative potential movement and capturing (captivating and annihilating) patterns for each different type of duplex playing piece:

[1] princess=bishop / rook,

[2] duke=knight / rook,

[3] marquess=bowman / rook,

[4] earl=bishop / knight,

[5] viscount=bishop / bowman,

[6] baron=bowman / knight.

(c) four different types of triplex playing pieces (a queen-II, a crown-prince-II, a counsellor, and an archbishop-II) with each different type of triplex playing piece comprising a different composite triplex configuration having three different types of simplex configurations representing three alternative potential movement and capturing (captivating and annihilating) patterns for each different type of triplex playing piece:

[1] queen-II=bishop / knight / rook,

[2] crown-prince-II=bowman / knight / rook,

[3] counsellor=bowman / bishop rook,

[4] archbishop-II=bishop / bowman / knight, (d) a substitute-objective playing piece (king-II) having a limited type of movement and capturing potential;

(e) ten minimal playing pieces (ten pawns), each having the same different type of movement and different type of capturing potential;

(f) a singular playing piece (a court-jester) having three different and unusual types of movement and capturing potential;

b) moving the sixty playing pieces on the one hundred, and the one hundred forty-four square gameboards according to the following rules:

(1) move individual pieces:

(a) first-simplex playing pieces (rooks): same as described for V3 above, by pattern (a), (b) second-simplex playing pieces (bishops): same as described for V3 above, by pattern (b), (c) third-simplex playing pieces (knights): same as described for V3 above, by pattern (c), (d) fourth-simplex playing pieces (bowmen), by a movement and capturing pattern identified as a pattern (d), as follows:

[1] a movement without capturing: by moving one non-jumping, non-capturing dog-leg, or moving one square orthogonally, followed by one square diagonally, at forty-five degrees deviation from the first direction moved, and alternatively, movement of one square diagonally, followed by one square orthogonally, at forty-five degrees deviation from the first direction moved, to one of eight possible locations describing a small-circle around the initial position of the fourth-simplex playing piece for that move, but without jumping ability or capturing potential, and

[2] a movement with capturing (annihilation): by moving to and displacing any opponent's playing piece located exactly two-linear dog-legs distant or moving two jumping dog-legs in the same direction, to one of eight possible locations describing a large-circle around the initial position of the fourth-simplex playing piece for that move, and provided that no playing piece is interposed at the end square of the first dog-leg, thereby obstructing the targeted piece and preventing the annihilation, (e) first-duplex playing pieces (princesses): move and capture (captivate) as either first-simplex or second-simplex pieces (rooks and bishops) as described above, by alternative patterns (a) and (b), (f) second-duplex playing pieces (dukes): move and capture (captivate and annihilate) as either first-simplex or third-simplex pieces (rooks and knights) as described above, by alternative patterns (a) and (c) , (g) third-duplex playing pieces (marquesses): move and capture (captivate and annihilate) as either first-simplex or fourth-simplex pieces (rooks and bowmen) as described above, by alternative patterns (a) and (d), (h) fourth-duplex playing pieces (earls): move and capture (captivate and annihilate) as either second-simplex or third-simplex pieces (bishops and knights) as described above, by alternative patterns (b) and (c), (i) fifth-duplex playing pieces (viscounts): move and capture (captivate and annihilate) as either second-simplex or fourth-simplex pieces (bishops and bowmen) as described above, by alternative patterns (b) and (d), (j) sixth-duplex playing pieces (barons): move and capture (annihilate) as either third-simplex or fourth-simplex pieces (knights and bowmen) as described above, by alternative patterns (c) and (d), (k) first-triplex playing pieces (queens-II): move and capture (captivate and annihilate) as either first-simplex, second-simplex, or third-simplex pieces (rooks, bishops, and knights) as described above, by alternative patterns (a), (b), and (c), (1) second-triplex playing pieces (crown-princes-II): move and capture (captivate and annihilate) as either first-simplex, third-simplex, or fourth-simplex pieces (rooks, knights and bowmen) as described above, by alternative patterns (a), (c), and (d), (m) third-triplex playing pieces (counsellors): move and capture (captivate and annihilate) as either first-simplex, second-simplex or fourth-simplex pieces (rooks, bishops, and bowmen) as described above, by alternative patterns (a), (b), and (d), (n) fourth-triplex playing pieces (second-archbishops-II): move and capture (captivate and annihilate) as either second-simplex, third-simplex, or fourth-simplex pieces (bishops, knights, and bowmen) as described above, by alternative patterns (b), (c), and (d), (o) substitute-objective playing pieces (kings-II):

[1] move and capture (captivate) as described for version-three (V3) above, by pattern (e), but

[2] cannot castle as in version-three (V3); (however the court-jester can exchange places with the king by "masquerading" as the king, as described later below), (p) minimal playing pieces (pawns):

[1] move and capture (annihilate) as described for version-three (V3) above, by pattern (f), and

[2] "liberate" captivated pieces as described for version-three (V3) above, (q) singular playing pieces (court-jester): moves and captures (captivates) by pattern (g):

[1] pattern (g1): moving one square orthogonally or diagonally, like a king as pattern (e)= (f1), or

[2] pattern (g2): jumping over an adjacent piece, by moving two squares either orthogonally or diagonally, and

[3] pattern (g3): can masquerade as another piece by exchanging positions with any like-colored piece, even the king, by either of the two maneuvers a) and b) above, but cannot masquerade as any piece if that piece is immediately "vulnerable" or born upon by an opponent's piece, but can do so at any other time when that piece is not born upon by an opponent's piece, and can "masquerade" repeatedly during a game, (2) alternate turns: same as for version-three (V3), as described above, (3) winning and scoring games:

(a) criteria same as for version-three (V3), as described above, and further including (b) an amended point scoring system: as listed below:

[1] pawn=1 point,

[2] bowman=2 pts.,

[3] knight=3 pts.,

[4] bishop=4 pts.,

[5] rook=5 pts.,

[6] baron=5 pts.

[7] viscount=6 pts.,

[8] earl=7 pts. ( formerly archbishop),

[9] marquess=7 pts.,

[10] duke=8 pts. (formerly crown-prince),

[11] princess=9 pts.,

[12] archbishop-II=9 pts.,

[13] counsellor=11 pts.,

[14] crown-prince-II=10 pts.

[15] queen-II=12 pts.,

[16] king-II=50 pts., and

[17] court-jester=6 pts., (4) Significance of the game (V4):

(a) An entirely new simplex playing piece has been introduced, the bowman, which adds a new dimension to the game. This piece also contributes it's unusual movement and annihilating ability to several duplex and triplex pieces as well. The bowman's movement and capturing potential fits appropriately into the essence of the game. The bowman is a very stealthy piece capable of long distance forking action which is frequently overlooked.

(b) The novel court-jester adds a new twist to this chess-type strategy game, which more than replaces the utility of castling. The skillful and timely use of this piece can often avoid potential entrapment and possible capture (captivation and annihilation) of the king. The transpositional ability of this piece (masquerading), with other like-discriminated (colored) pieces besides the king, creates many intriguing strategic possibilities.

(c) Moreover, the complexity of this game has been expanded exponentially beyond that of the previous game (V3), which was already more complex than conventional chess. The fourth-version (V4) has profoundly complicated interactive potentialities when considering the following: sixteen simplex, twelve duplex, and eight triplex playing pieces, plus twenty pawns, two kings, and two court-jesters all upon a one hundred forty-four square board.

E) The Fifth-Version of the Chess-Type Strategy Game (V5):

(Gameboard, Playing Pieces, and Method): (FIGS. 1; 2A, 2B, 2C; 3A, 3B, 3C; 4A, 4B, 4C; 5A, 5B, 5C; 6A, 6B, 6C; 7A, 7B, 7C; 11A, 11B, 11C; 12; 13A, 13B, 13C; 14A, 14B, 14C; 15A, 15B, 15C; 16A, 16B, 16C; 17A, 17B, 17C; 18A, 18B, 18C; 19A, 19B, 19C; 20A, 20B, 20C; 21A, 21B, 21C; 22A, 22B, and 22C).

The fifth-version of the chess-type game utilizes all of the playing pieces of the fourth-versions (V4*a*, and V4*b*), but each set of the two contrasting sets of playing pieces also includes: two additional pawns, two additional knights, and two additional bowmen. There are a total of thirty-six playing pieces for each set and seventy-two playing pieces per two contrasting sets upon a gameboard of one hundred forty-four squares. The method of play is essentially the same as for the fourth-version (V4*b*). The fifth-version (V5) and starting positions are described later in greater detail under the computer versions of the game.

F) Summary of Representational Playing Piece Design Concept

1) The Simplex Symmetrical Geometric Representational Configurations:

Each of the four simplex representational configurations (rook configuration 30, bishop configuration 42, knight configuration 50 and bowman configuration 130) have a different single-tier structural design, which is suggestive of the different moves each piece can make:

a) the rook configuration 30 comprising an upper cylindrical parapet section 32 supported horizontally by four solid-rectangular column sections 34 arranged orthogonally, mounted vertically, and positioned equidistantly around the circumference of a lower cylindrical foundation section 36; by which means the first-simplex playing piece represents a rook playing piece having an orthogonal arrangement of four solid-rectangular columns as a structural mnemonic device suggestive of an orthogonal movement and capturing pattern in four possible directions upon the gameboard playing surface, b) the bishop configuration 42 comprising an upper cylindrical headdress section 44 which is centered and mounted vertically on a wider lower cylindrical bishop-torso section 46, thereby providing a cylindrical pyramidal shape having a conical tangential slope; by which means the second-simplex playing piece represents a bishop playing piece having a pyramidal shape with a tangential slope as a structural mnemonic device suggestive of a diagonal movement and capturing pattern in any possible direction upon the gameboard playing surface, c) the knight configuration 50 comprising a vertical solid-rectangular horse-head section 52 connected at its midsection at right angles to one end of a horizontal solid-rectangular horse-body section 54 supported near both ends by parallel vertical solid-rectangular segments, front-legs section 56 and hind-legs section 58; by which means the third-simplex playing piece represents a knight (horse) playing piece having a T-shaped form of head and horse-body supported on legs as a structural mnemonic device suggestive of a movement and capturing pattern of a jumping single-dog-leg of two squares orthogonally, followed by one square orthogonally at right angles, alternatively left and right, to one of eight possible locations describing a small-circle upon the gameboard playing surface, d) the bowman configuration 130 comprising a horizontal solid-rectangular crossbow section 132 joined at right angles at its midsection to one end of another solid-rectangular stock and arrow section 134 mounted horizontally on a vertical cylindrical bowman-torso section 136; by which means the fourth-simplex playing piece represents a bowman playing piece having a T-shaped form of crossbow, sheath and arrow supported on a single torso section without legs, as a structural mnemonic device suggestive of 1) a movement pattern of a non-jumping single-dog-leg of one square orthogonally, followed by one square diagonally at forty-five degrees to the first direction moved, and alternatively, one square diagonally, followed by one square orthogonally, at forty-five degrees to the first direction moved, to one of eight possible locations describing a small circle around the square of origin of the bowman piece for that move upon the gameboard playing surface, and 2) a capturing ("annihilation") pattern of a linear double-dog-leg or two jumping dog-legs in a straight line to one of eight possible locations describing a large-circle around the initial position of the fourth-simplex playing piece for that turn, upon the gameboard playing surface, provided that the end square or the first dog-leg is not occupied, thereby obstructing the sighting of the targeted piece and preventing the annihilation.

Once the various movement and capturing (captivating and annihilating) patterns signified by the simplex representational configurations of the simplex playing pieces have been learned, all of the more complex movement and capturing (captivating and annihilating) patterns of the duplex and triplex playing pieces become quite obvious, since the more complex (duplex and triplex) pieces are fundamentally composites of two or three simplex representational configurations. Thus the structural design of the simplex playing pieces greatly facilitates not only the recognition of the identity of the more complex duplex and triplex playing pieces, but also help to suggest the types of moves that they make.

2) The Duplex Symmetrical Geometric Representational Configurations:

Each of the seven duplex representational configurations are designed and constructed as double-tier composites of two of four different simplex representational configurations, and are taller than the simplex representational configurations:

a) The princess configuration 62 (of V1, V2, V4, and V5) is a composite of rook configuration 30 and bishop configuration 42, (the princess configuration 62 is replaced by the queen configuration 104 in the third-version game or V3), b) The queen configuration 104 (of V3) is also a composite of rook configuration 30 and bishop configuration 42, just like the princess configuration 62, but also has an additional queen-tiara section 106 (the queen configuration 104 replaces the princess configuration 62 in the third-version or V3), and is the tallest of the duplex configurations.

c) The duke configuration 66 (of V4, and V5) or the crown-prince configuration 66 (of V1, V2, and V3) is a composite of rook configuration 30 and knight configuration 50, d) The earl configuration 70 (of V4, and V5) or the archbishop configuration 70 (of V1, V2, and V3) is a composite of knight configuration 50 and bishop configuration 42.

e) The marquess configuration 140 (of V4, and V5) is a composite of rook configuration 30 and bowman configuration 130.

f) The viscount configuration 144 (of V4, and V5) is a composite of bishop configuration 42 and bowman configuration 130.

g) The baron configuration 148 (of V4, and V5) is a composite of bowman configuration 130 and knight configuration 50.

3) The Triplex Symmetrical Geometric Representational Configurations:

Each of the four triplex representational configurations are designed and constructed as different triple-tier composites of three of the four different simplex representational configurations, and have greater heights than the duplex representational configurations:

a) the queen-II configuration 152 (of V4, and V5) is a composite of bishop configuration 42, knight configuration 50, and rook configuration 30, plus queen-II-tiara section 154, and is the tallest of the triplex configurations, b) the crown-prince-II configuration 158 (of V4, and V5) is a composite of bowman configuration 130, knight configuration 50, and rook con figuration 30, c) the counsellor configuration 162 (of V4, and V5) is a composite of bishop configuration 42, bowman configuration 130, and rook configuration 30, d) the archbishop-II configuration 166 (of V4, and V5) is a composite of bishop configuration 42, bowman configuration 130, and knight configuration 50.

4) The Objective and Singular Pieces:

Three non-composite representational configurations have unique designs:

a) The king configuration 90 (of V3) is a figure having the greatest height on the board for V3.

b) The king-II configuration 170 (of V4, and V5) is a figure having the greatest height on the board for V4, and V5.

c) The court-jester configuration 174 (of V4, and V5) is a singular figure of greater height than the duplex configurations and smaller height than the triplex configurations.

5) The Minimal Pieces:

The pawn configuration 110 (of V3, V4, and V5) is a very simple unit figure of less structural height than simplex and duplex playing pieces and having the simplest construction of a pawn configuration 110 segment.

VIII) ALTERNATIVE FUNCTIONAL PLAYING PIECES: (-F)

Figure 23A:
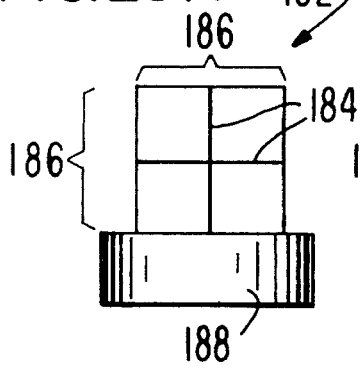
Figure 23B:
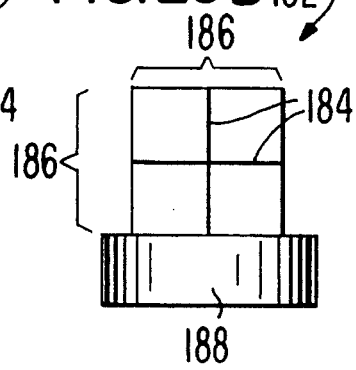
Figure 23C:
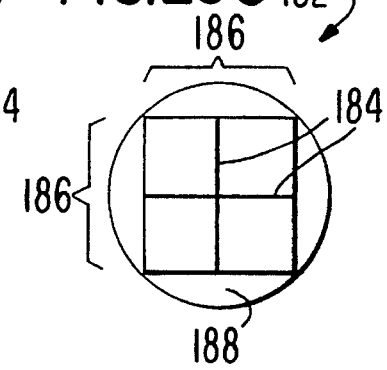

(FIGS. 23A, 23B, 23C; 24A, 24B, 24C; 25A, 25B, 25C; 26A, 26B, 26C; 27A, 27B, 27C; 28A, 28B, 28C; 29A, 29B, 29C; 30A, 30B, 30C; 31A, 31B, 31C; 32A, 32B, 32C; 33A, 33B, 33C; 34A, 34B, 34C; 35A, 35B, 35C; 36A, 36B, 36C; 37A, 37B, 37C; 38A, 38B, 38C; 39A, 39B, 39C; 40A, 40B, 40C; 41A, 41B, 41C; 42A, 42B, 42C, 42D, 42E, 42F; 43A, 43B; 44A, and 44B)

The five different versions of the chess-type games described above can also be played by using a very different kind of playing pieces, which are designed with functional operational considerations in mind, instead of representational considerations. These alternative functional playing pieces are designated by the suffix (-F) and comprise symmetrical geometric functional configurations having relatively simple geometric functional symbols inscribed within a square frame of reference upon at least one structural surface of each playing piece, which indicates the mode of operation for each playing piece on the gameboard. The basic single-function symbols can be combined readily by superimposition without obscuring each other, thereby enabling the creation of both double-function and triple-function symbols. These functional symbols have the ability to facilitate increasing the complexity of the game, while simultaneously diminishing the confusion of the game.

The functional symbols which are used primarily represent actual functional operation and only secondarily represent specific entities. When any of these symbols are used within a square frame of reference, either singly or in combination with any of the other symbols by superimposition concentrically, the function and identity of each symbol is clearly apparent.

These functional symbols also easily lend themselves to an alternative style of three-dimensional structural playing pieces for use on the multiple-concentric-perimeter gameboards 02, 72, and 112, FIGS. 1, 8, and 12, respectively, and are described as follows:

FIGS. 23A, 23B, and 23C illustrate a first-simplex functional playing piece or alternative rook 182 (for all five versions of the game) comprising a first-single-function symbol, or straight-cross symbol, or "+" 184 centered within a square frame of reference of at least the upper horizontal surface of a first-uniform-single-tier structure or first-cubic form or simplex cubic form 186 optionally fixed upon a wider cylindrical base 188. The first-single-function symbol, or straight-cross symbol, or "+" 184 centered within the square frame of reference of the first-cubic form 186 provides a first-simplex-functional configuration which indicates extended orthogonal movement in any of four possible directions for the alternative rook 182.

Figure 24A:
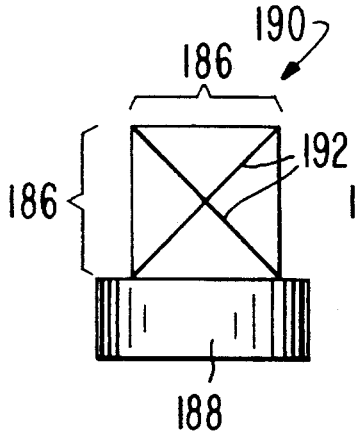
Figure 24B:
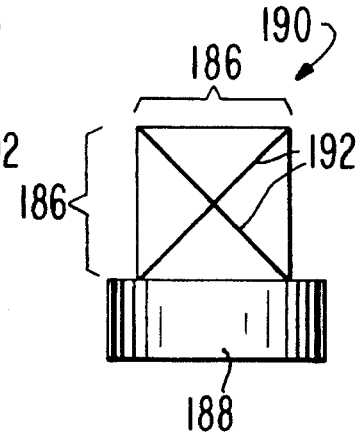
Figure 24C:
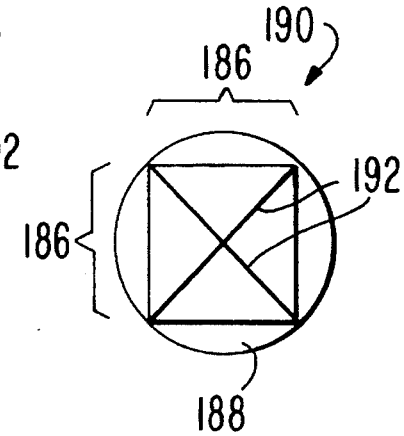

FIGS. 24A, 24B, and 24C illustrate a second-simplex functional playing piece or alternative bishop 190 (for all five versions of the game) comprising a second-single-function symbol, or diagonal-cross symbol, or "x" 192 centered within a square frame of reference of at least the upper horizontal surface of a first-uniform-single-tier structure or first-cubic form or simplex cubic form 186 optionally fixed upon a wider cylindrical base section 188. The second-single-function symbol, or diagonal-cross symbol, or "x" 192 centered within the square frame of reference of the first-cubic form 186 provides a second-simplex functional configuration which indicates extended diagonal movement in any of four possible directions for the alternative bishop 190.

Figure 25A:
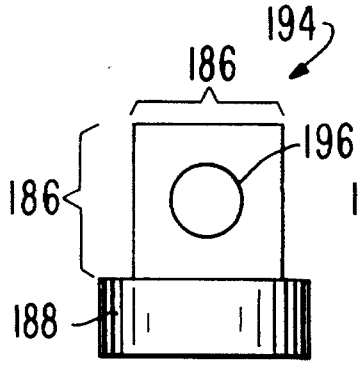
Figure 25B:
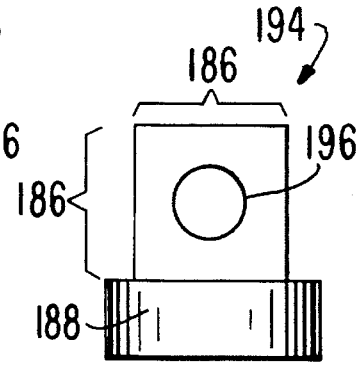
Figure 25C:
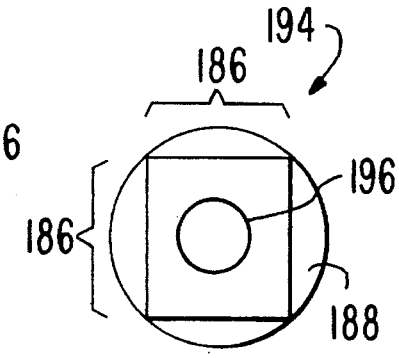

FIGS. 25A, 25B, and 25C illustrate a third-simplex functional playing piece or alternative knight 194 (for all five versions of the game) comprising a third-single-function symbol, or small-circle symbol, or "o" 196 centered within a square frame of reference of at least the upper horizontal surface of a first-uniform-single-tier structure or first-cubic form or simplex cubic form 186 optionally fixed upon a wider cylindrical base 188. The third-single-function symbol, or small-circle symbol, or "o" 196 centered within the square frame of reference of the first-cubic form 186 provides a third-simplex functional configuration which indicates the small-circle movement and capturing range of one jumping dog-leg in any of eight possible directions for the alternative knight 194.

Figure 26A:
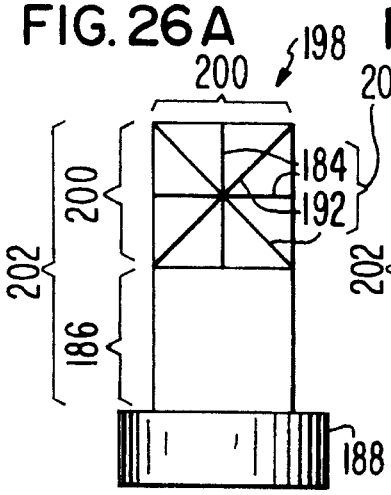
Figure 26B:
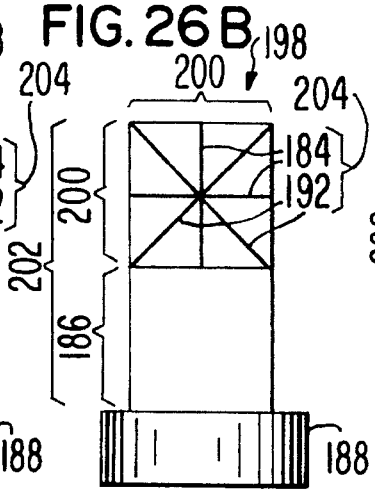
Figure 26C:
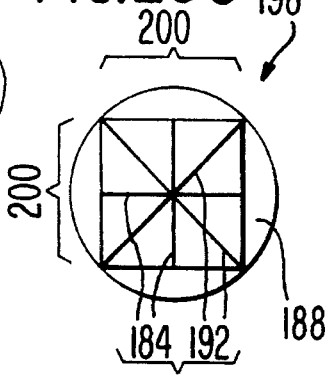

FIGS. 26A, 26B, and 26C illustrate an first-duplex functional playing piece or alternative princess 198 (for the first, second, fourth, and fifth versions of the game) comprising a first-single-function symbol, or straight-cross symbol, or "+" 184 superimposed upon a second-single-function symbol, or diagonal-cross symbol, or "x" 192 centered within a common square frame of reference of at least the upper horizontal surface of an upper second-uniform-single-tier structure or second-cubic form 200 fixed in vertical alignment upon a lower first-uniform-single-tier structure or first-cubic form 186 creating a uniform double-tier structure or duplex cubic form 202 optionally fixed upon a wider cylindrical base 188. The resultant composite first-double-function symbol, or superimposed straight-cross/diagonal-cross symbol, or "+ / x" 204 within the common square frame of reference of the second-cubic form 200 provides a first-duplex functional configuration which indicates the alternative moves of rook, and bishop for the alternative princess 198.

Figure 27A:
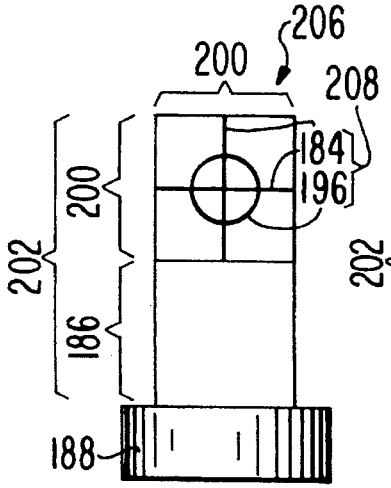
Figure 27B:
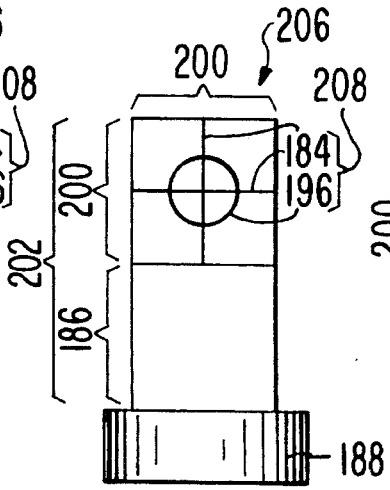
Figure 27C:
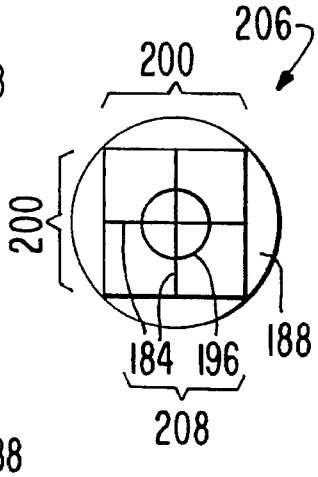

FIGS. 27A, 27B, and 27C illustrate an second-duplex functional playing piece or alternative crown-prince 206 (for the first, second, and third versions of the game) or alternative duke 206 (for the fourth, and fifth versions of the game) comprising a first-simplex-function symbol, or straight-cross symbol, or "+" 184 superimposed upon a third-single-function symbol, or small-circle symbol, or "o" 196 centered within a common square frame of reference of at least the upper horizontal surface of an upper second-uniform-single-tier structure or second-cubic form 200 fixed in vertical alignment upon a lower first-uniform-single-tier structure or first-cubic form 186 creating a uniform double-tier structure or duplex cubic form 202 optionally fixed upon a wider cylindrical base 188. The resultant composite second-double-function symbol, or superimposed straight-cross / small-circle symbol, or "+ / o" 208 within the common square frame of reference of the second-cubic form 200 provides a second-duplex functional configuration which indicates the alternative moves of rook, and knight for the alternative crown-prince or alternative duke 206.

Figure 28A:
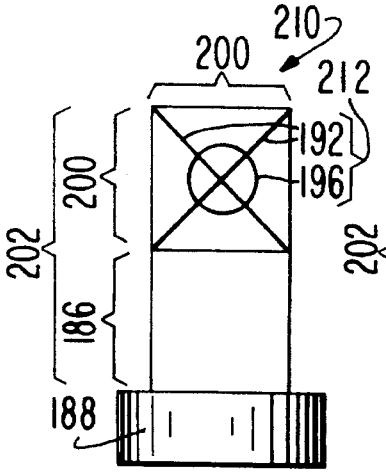
Figure 28B:
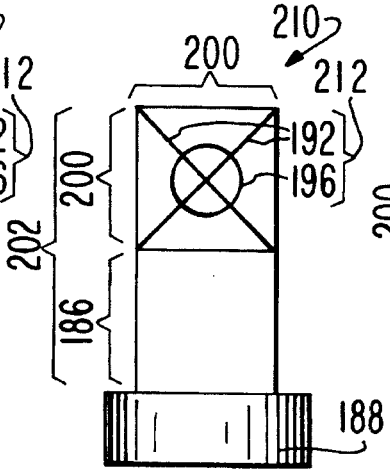
Figure 28C:
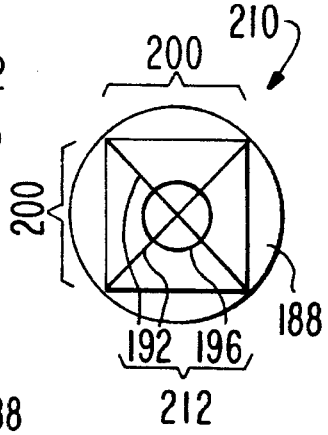

FIGS. 28A, 28B, and 28C illustrate a third-duplex functional playing piece or alternative archbishop 210 (for the first, second, and third versions of the game) or alternative earl 210 (for the fourth, and fifth versions of the game) comprising a second-single-function symbol, or diagonal-cross symbol, or "x" 192 superimposed upon a third-single-function symbol, or small-circle symbol, or "o" 196 within a common square frame of reference of at least the upper horizontal surface of an upper second-uniform-single-tier structure or second-cubic form 200 fixed in vertical alignment with a lower first-uniform-single-tier structure or first-cubic form 186 creating a uniform double-tier structure or duplex cubic form 202 optionally fixed upon a wider cylindrical base 188. The resultant composite third-double-function symbol, or superimposed diagonal-cross / small-circle symbol, or "x / o" 212 within the common square frame of reference of the second-cubic form 200 provides a third-duplex functional configuration which indicates the alternative moves of bishop, and knight for the alternative archbishop or alternative earl 210.

Figure 29A:
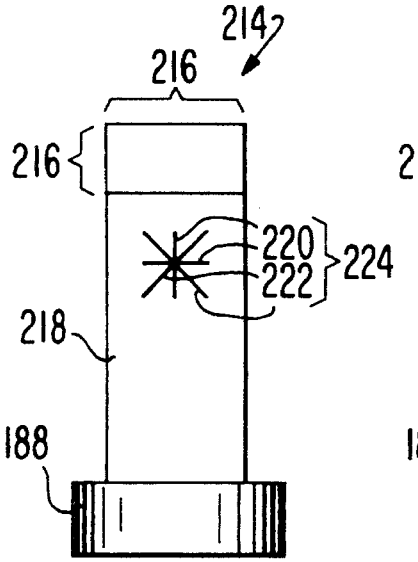
Figure 29B:
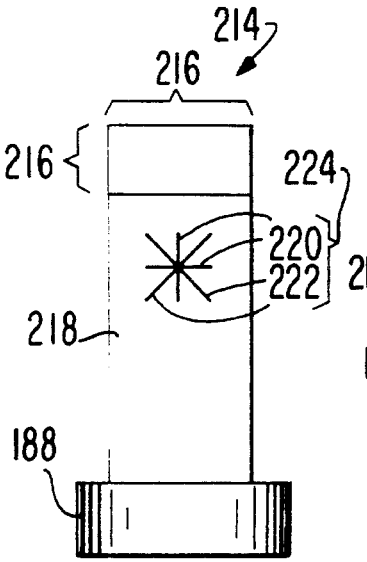
Figure 29C:
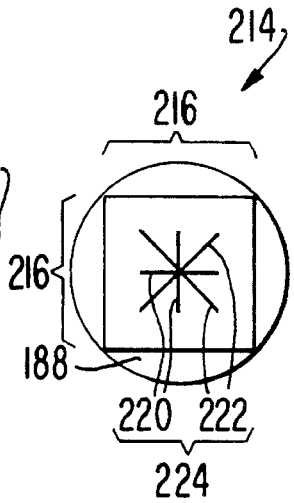

FIGS. 29A, 29B, and 29C illustrate a objective functional playing piece or alternative king 214 (for the third-version of the game) comprising a half-cube-size alternative king-crown 216 fixed horizontally in vertical alignment upon the upper end of a lower double-cube-size vertical alternative king-torso 218 optionally fixed vertically upon a wider cylindrical base 188. A small-straight-cross symbol, or "(small)+" 220 superimposed upon a small-diagonal-cross symbol, or "(small)x" 222 which are centered at least within the common square frame of reference of the upper horizontal surface of the alternative king-crown 216 and also optionally on the upper lateral surfaces of the alternative king-torso 218. The resultant objective-function symbol, or superimposed small-straight-cross / small-diagonal-cross symbol, or "(small)+ / (small)x" 224 within the common square frame of reference of the alternative king-crown 216 and also optionally on the alternative king-torso 218 provides an objective functional configuration which indicates the alternative moves of one square orthogonally and one square diagonally in eight possible directions for the alternative king 214.

Figure 30A:
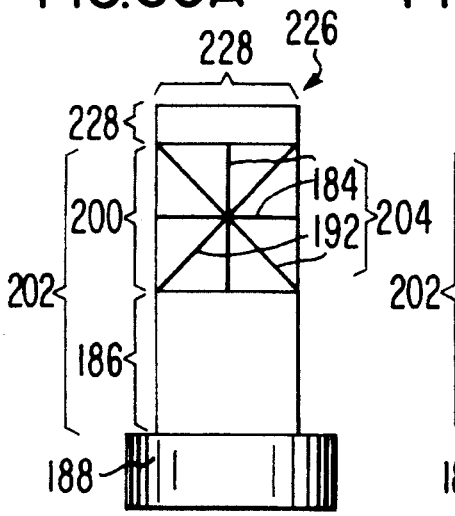
Figure 30B:
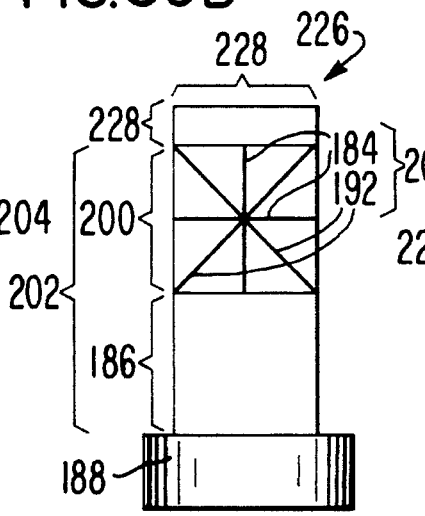
Figure 30C:
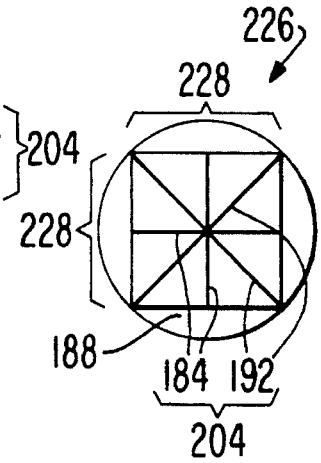

FIGS. 30A, 30B, and 30C illustrate a substitute-first-duplex functional playing piece or alternative queen 226 (for the third-version of the game) comprising a first-single-function symbol, or straight-cross symbol, or "+" 184 superimposed upon a second-single-function symbol, or diagonal-cross symbol, or "x" 192 within a common square frame of reference of at least the upper horizontal surface of an upper one-quarter-cubic-size alternative queen-tiara 228 and also optionally within the common square frame of reference of the lateral surfaces of an upper second-uniform-single-tier structure or second-cubic form 200 fixed in vertical alignment upon a lower first-uniform-single-tier structure or first-cubic form 186 creating a uniform double-tier structure or duplex cubic form 202 optionally fixed upon a wider cylindrical base 188. The resultant composite first-double-function symbol, or superimposed straight-cross / diagonal-cross symbol, or "+ / x" 204 inscribed within the common square frame of reference of the alternative queen-tiara 228 and also optionally on the second-cubic form 200 provides a substitute-first-duplex functional configuration which indicates the alternative moves of rook, and bishop for the alternative queen 226.

Figure 31A:
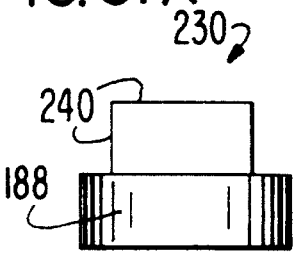
Figure 31B:
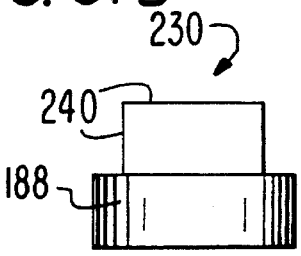
Figure 31C:
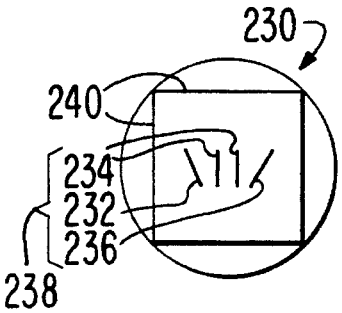

FIGS. 31A, 31B, and 31C illustrate a minimal functional playing piece or alternative pawn 230 (for the third, fourth, and fifth versions of the game) comprising a left-diagonal-function symbol, or "\" 232, a double-straight-function symbol, or "||" 234, a right-diagonal-function symbol, or "/" 236, providing a composite minimal-function symbol, or consecutive left-diagonal / double-straight / right-diagonal symbol, or "\||/" 238 within a common square frame of reference of the upper horizontal surface of a half-cube-size alternative pawn body 240 optionally fixed upon a wider cylindrical base 188. The resultant composite minimal-function symbol, or consecutive left-diagonal /double-straight /right-diagonal symbol, or "\||/" 238 within the common square frame of reference of the alternative pawn body 240 provides an alternative minimal functional configuration which indicates the alternative moves of: 1) one square left-diagonal-forward to capture (annihilate), 2) one or two squares forward movement any turn (without capturing), and 3) one square right-diagonal-forward to capture (annihilate); for the alternative pawn 230.

Figure 32A:
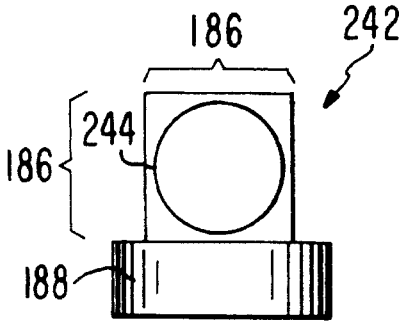
Figure 32B:
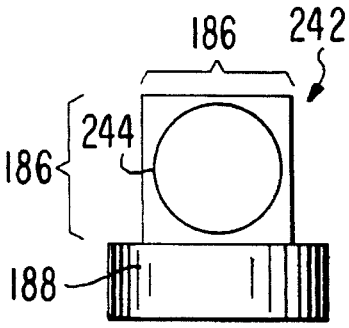
Figure 32C:
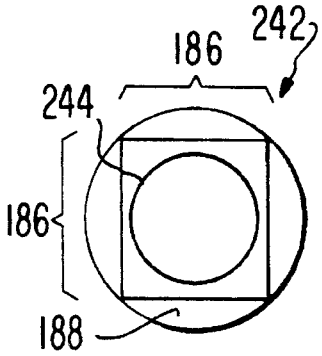

FIGS. 32A, 32B, and 32C illustrate a fourth-simplex functional playing piece or alternative bowman 242 (for the fourth, and fifth versions of the game) comprising a fourth-single-function symbol, or large-circle symbol, or "○" 244 within a square frame of reference of at least the upper horizontal surface of a first-uniform-single-tier structure or first-cubic form or simplex cubic form 186 optionally fixed upon a wider cylindrical base 188. The fourth-single-function symbol, or large-circle symbol, or "○" 244 within the square frame of reference of the upper horizontal surface of the first-cubic form 186 provides a fourth-simplex functional configuration which indicates the large-circle capturing range of a two linear-dog-leg capturing (annihilation) pattern of the bowman, to any one of eight possible locations describing a large-circle around the bowman's square of origin for any given move on the gameboard.

Figure 33A:
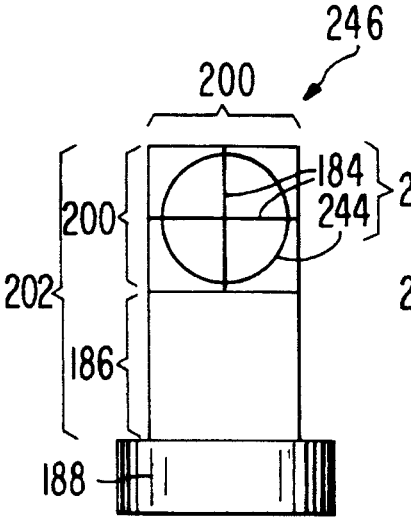
Figure 33B:
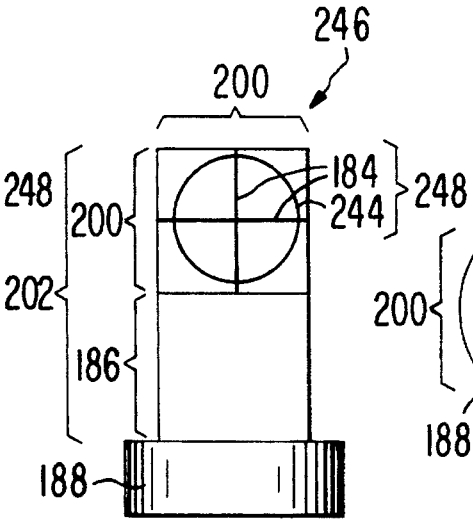
Figure 33C:
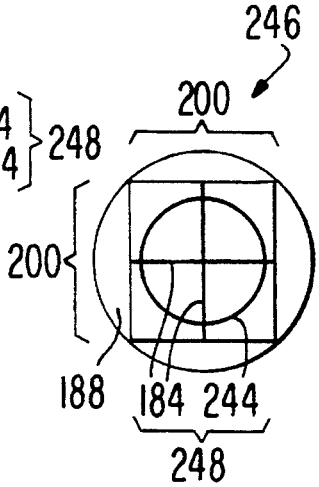

FIGS. 33A, 33B, and 33C illustrate a fourth-duplex functional playing piece or alternative marquess 246 (for the fourth, and fifth versions of the game) comprising a first-single-function symbol, or straight-cross symbol, or "+" 184 superimposed upon a fourth-single-function symbol: "○", or large-circle symbol 244 centered within a common square frame of reference of at least the upper horizontal surface of an upper second-uniform-single-tier structure or second-cubic form 200 fixed in vertical alignment upon a lower first-uniform-single-tier structure or first-cubic form 186 creating a uniform double-tier structure or duplex cubic form 202 optionally fixed upon a wider cylindrical base 188. The resultant composite fourth-double-function symbol, or superimposed straight-cross / large-circle symbol, or "+ / ○" 248 within the common square frame of reference of the second-cubic form 200 provides a fourth-duplex functional configuration which indicates the alternative moves of rook, and bowman for the alternative marquess 246.

Figure 34A:
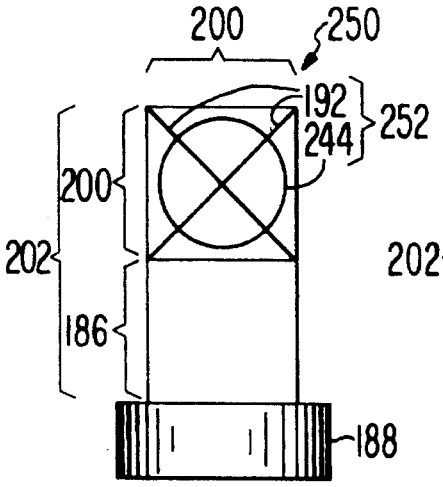
Figure 34B:
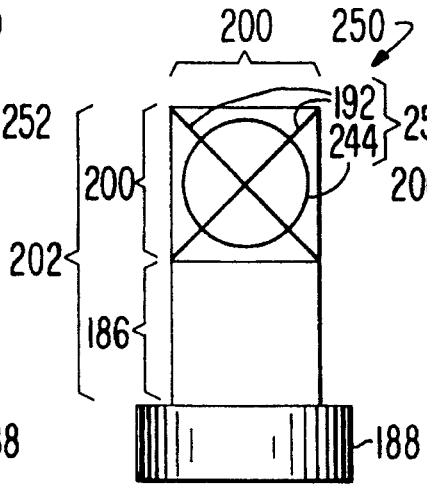
Figure 34C:
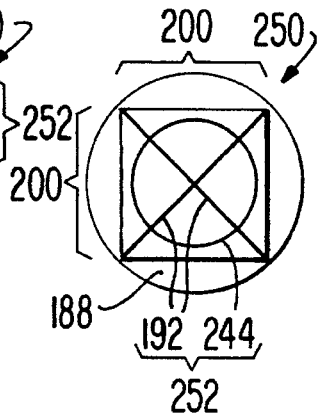

FIGS. 34A, 34B, and 34C illustrate a fifth-duplex functional playing piece or alternative viscount 250 (for the fourth, and fifth versions of the game) comprising a second-single-function symbol, or diagonal-cross symbol, or "x" 192 superimposed upon a fourth-single-function symbol, or large-circle symbol, or "○" 244 centered within a common square frame of reference of at least the upper horizontal surface of an upper second-uniform-single-tier structure or second-cubic form 200 fixed in vertical alignment upon a lower first-cubic form 186 creating a uniform double-tier structure or duplex cubic form 202 optionally fixed upon a wider cylindrical base 188. The resultant composite fifth-double-function symbol, or superimposed diagonal-cross / large-circle symbol, or "x / ○" 252 within the common square frame of reference of the second-cubic form 200 provides a fifth-duplex functional configuration which indicates the alternative moves of bishop, and bowman for the alternative viscount 250.

Figure 35A:
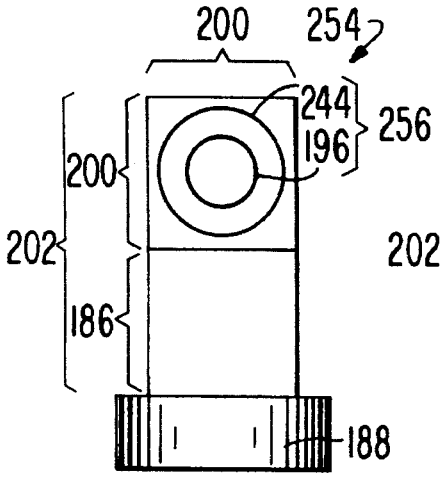
Figure 35B:
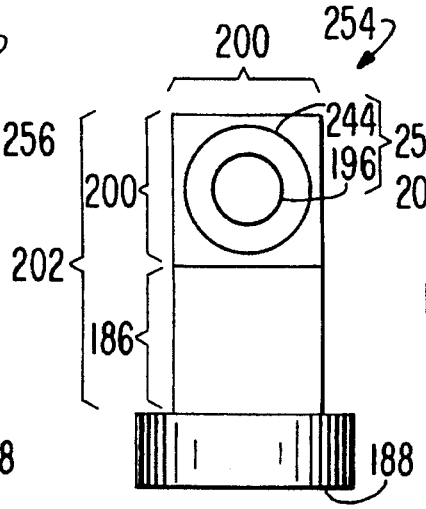
Figure 35C:
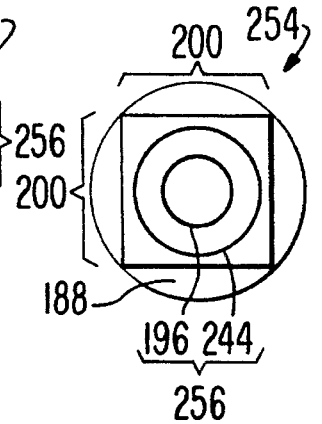

FIGS. 35A, 35B, and 35C illustrate a sixth-duplex functional playing piece or alternative baron 254 (for the fourth, and fifth versions of the game) comprising a third-single-function symbol, or small-circle symbol, or "o" 196 superimposed upon a fourth-single-function symbol, or large-circle symbol, or "○" 244 centered within a common square frame of reference of at least the upper horizontal surface of an upper second-uniform-single-tier structure or second-cubic form 200 fixed in vertical alignment upon a lower first-cubic form 186 creating a uniform double-tier structure or duplex cubic form 202 optionally fixed upon a wider cylindrical base 188. The resultant composite sixth-double-function symbol, or superimposed small-circle / large-circle symbol, or "o / ○" 256 within the common square frame of reference of the second-cubic form 200 signifies a sixth-duplex functional configuration which indicates the alternative moves of knight, and bowman for the alternative baron 254.

Figure 36A:
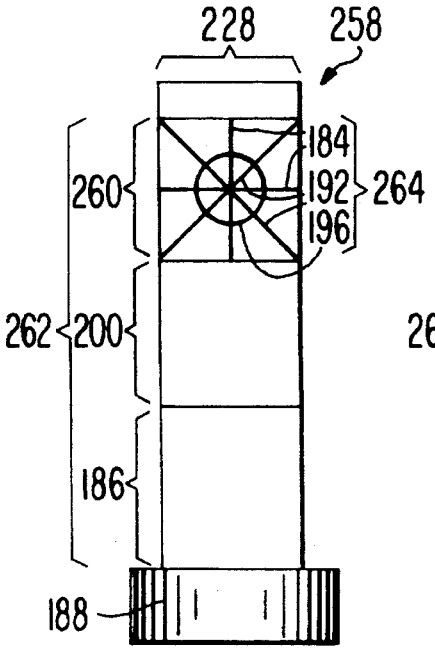
Figure 36B:
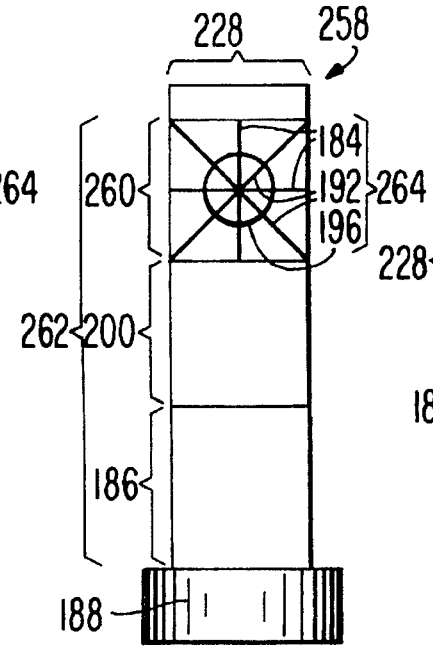
Figure 36C:
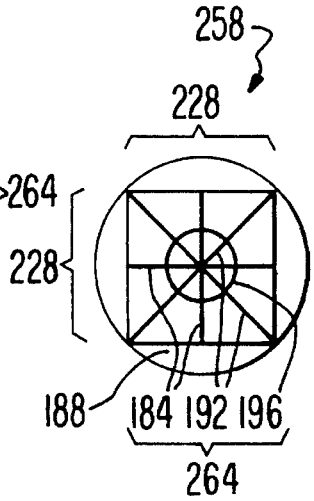

FIGS. 36A, 36B, and 36C illustrate a first-triplex functional playing piece or alternative queen-II 258 (for the fourth, and fifth versions of the game) comprising a first-single-function symbol, or straight-cross symbol, or "+" 184 superimposed upon a second-single-function symbol, or diagonal-cross symbol, or "x" 192 superimposed upon a third-single-function symbol, or small-circle symbol, or "o" 196 centered at least within a common square frame of reference of the upper horizontal surface of an upper one-quarter-cubic-size alternative queen-II-tiara 228' and optionally centered within the common square frames of reference of the lateral surfaces of an upper third-uniform-single-tier structure or third-cubic form 260 fixed in vertical alignment upon a middle second-uniform-single-tier structure or second-cubic form 200 fixed in vertical alignment upon a lower first-uniform-single-tier structure or first-cubic form 186, creating a uniform triple-tier structure or triplex cubic form 262 optionally fixed upon a wider cylindrical base 188. The resultant composite first-triple-function symbol, or superimposed straight-cross / diagonal-cross / small-circle symbol, or "+ / x / o" 264 within the common square frame of reference of the alternative queen-II-tiara 228' signifies an alternative first-triplex functional configuration or alternative queen-II functional configuration and indicates the alternative moves of rook, bishop, and knight for the alternative queen-II 258.

Figure 37A:
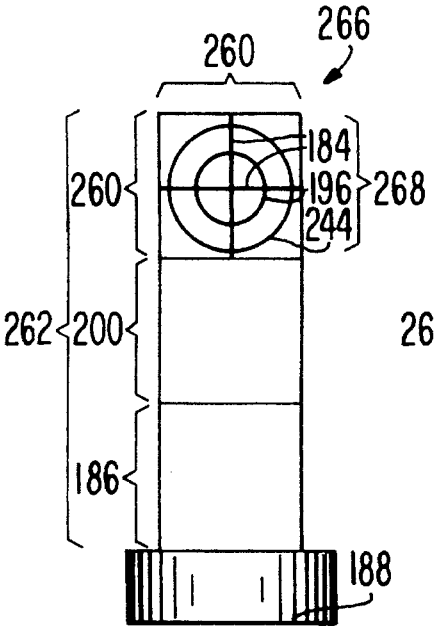
Figure 37B:
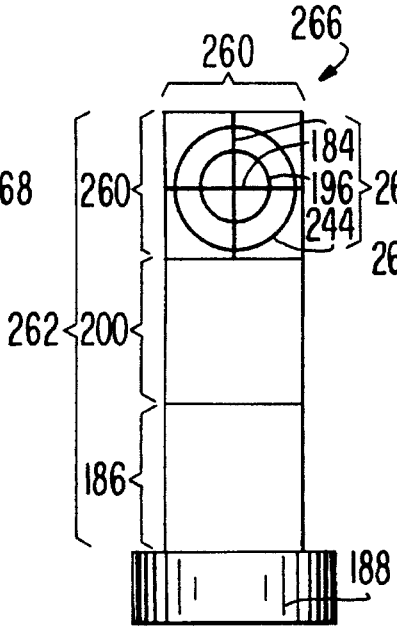
Figure 37C:
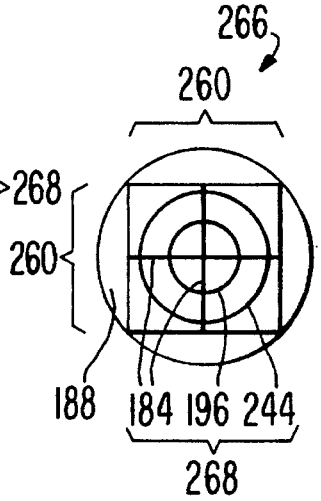

FIGS. 37A, 37B, and 37C illustrate an alternative second-triplex functional playing piece or alternative crown-prince-II 266 (for the fourth, and fifth versions of the game) comprising a first-single-function symbol, or straight-cross configuration, or "+" 184 superimposed upon a third-single-function symbol, or small-circle configuration, or "o" 196 superimposed upon a fourth-single-function symbol, or large-circle configuration, or "○" 244 centered within a common square frame of reference of at least the upper horizontal surface of an upper third-uniform-single-tier structure or third-cubic form 260 fixed in vertical alignment upon a middle second-uniform-single-tier structure or second-cubic form 200 fixed in vertical alignment upon a lower first-uniform-single-tier structure or first-cubic form 186 creating a uniform triple-tier structure or triplex cubic form 262 optionally fixed upon a wider cylindrical base 188. The resultant composite second-triple-function symbol, or superimposed straight-cross / small-circle / large-circle configuration, or "+ / o / ○" 268 within the common square frame of reference of the upper third-cubic form 260 signifies an alternative second-triplex functional configuration or alternative crown-prince-II functional configuration and indicates the alternative moves of rook, knight, and bowman for the alternative crown-prince-II 266.

Figure 38A:
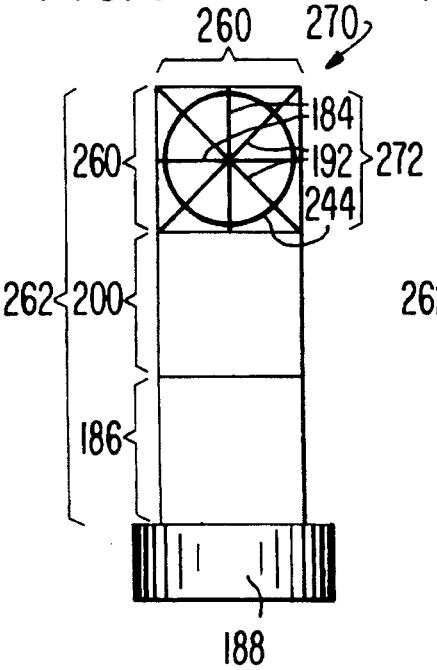
Figure 38B:
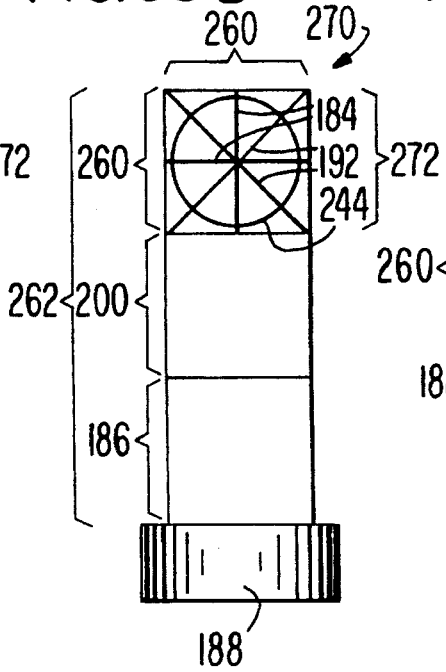
Figure 38C:
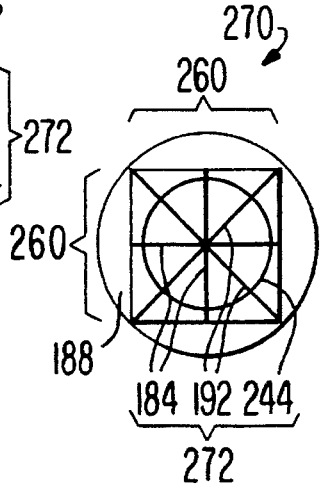

FIGS. 38A, 38B, and 38C illustrate an alternative third-triplex functional playing piece or alternative counsellor 270 (for the fourth, and fifth versions of the game) comprising a first-single-function symbol, or straight-cross configuration, or "+" 184 superimposed upon a second-single-function symbol, or diagonal-cross configuration, or "x" 192 superimposed upon a fourth-single-function symbol, or large-circle configuration, or "○" 244 centered within a common square frame of reference of at least the upper horizontal surface of an upper third-uniform-single-tier structure or third-cubic form 260 fixed in vertical alignment upon a middle second-uniform-single-tier structure or second-cubic form 200 fixed in vertical alignment upon a lower first-uniform-single-tier structure or first-cubic form 186 creating a uniform triple-tier structure or triplex cubic form 262 optionally fixed upon a wider cylindrical base 188. The resultant composite third-triple-function symbol, or superimposed straight-cross /diagonal-cross /large-circle configuration, or "+ / x / ○" 272 within the common square frame of reference of the upper third-cubic form 260 signifies an alternative third-triplex functional configuration or alternative counsellor functional configuration and indicates the alternative moves of rook, bishop, and bowman for the alternative counsellor 270.

Figure 39A:
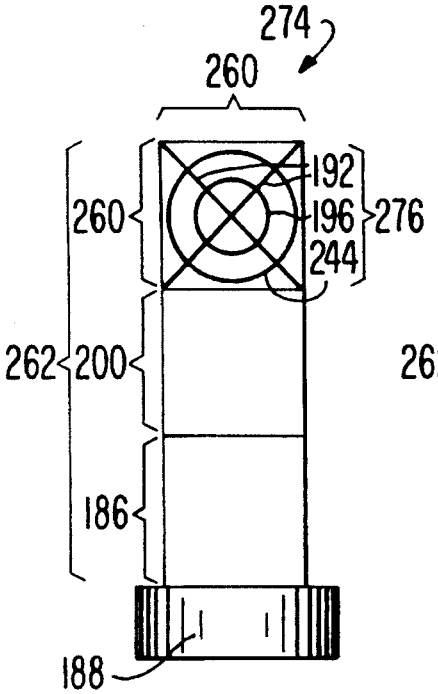
Figure 39B:
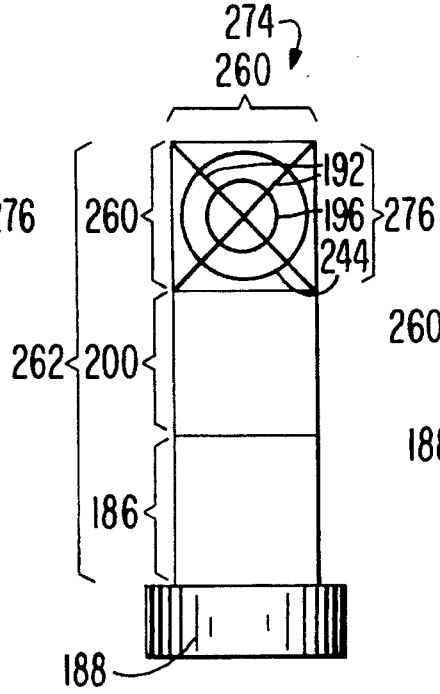
Figure 39C:
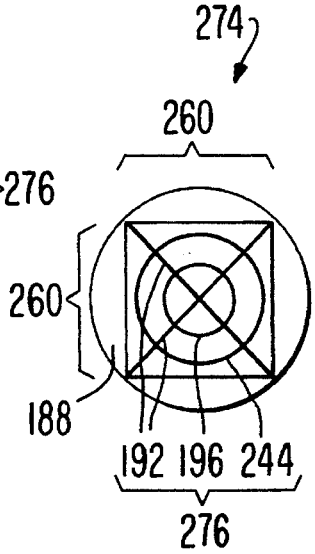

FIGS. 39A, 39B, and 39C illustrate an alternative fourth-triplex functional playing piece or alternative archbishop-II 274 (for the fourth, and fifth versions of the game) comprising a second-single-function symbol, or diagonal-cross configuration, or "x" 192 superimposed upon a third-single-function symbol, or small-circle configuration, or "o" 196 superimposed upon a fourth-single-function symbol, or large-circle configuration, or "○" 244 centered within a common square frame of reference of at least the upper horizontal surface of an upper third-uniform-single-tier structure or third-cubic form 260 fixed in vertical alignment upon a middle second-uniform-single-tier structure or second-cubic form 200 fixed in vertical alignment upon a lower first-uniform-single-tier structure or first-cubic form 186 creating a uniform triple-tier structure or triplex cubic form 262 optionally fixed upon a wider cylindrical base 188. The resultant composite fourth-triple-function symbol, or superimposed diagonal-cross / small-circle / large-circle configuration, or "x / o / ○" 276 within the common square frame of reference of the upper third-cubic form 260 signifies an alternative fourth-triplex functional configuration or alternative archbishop-II functional configuration and indicates the alternative moves of bishop, knight, and bowman for the alternative archbishop-II 274.

Figure 40A:
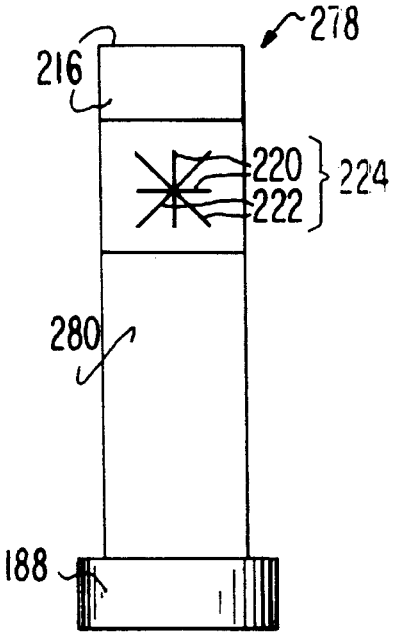
Figure 40B:
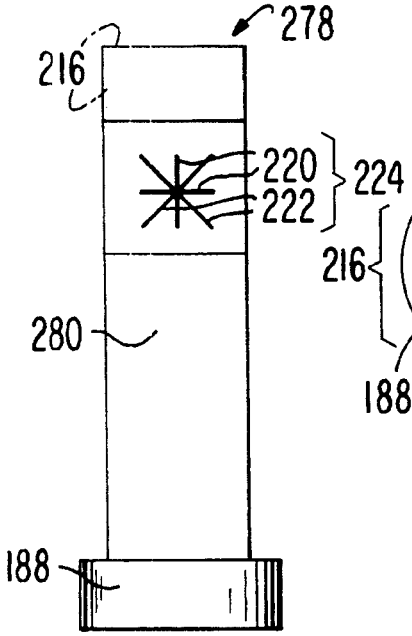
Figure 40C:
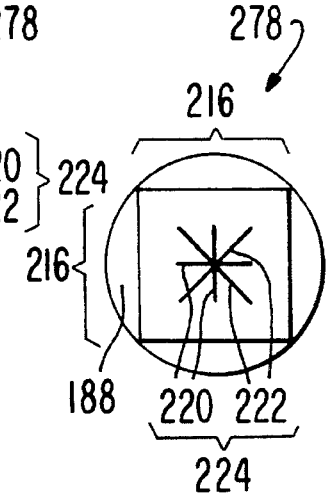

FIGS. 40A, 40B, and 40C illustrate an alternative substitute-objective functional playing piece or alternative king-II 278 (for the fourth, and fifth versions of the game) comprising a half-cube size alternative crown section 216 fixed horizontally and in vertical alignment upon a lower triple-cube-size vertical alternative king-II-torso 280 optionally fixed upon a wider cylindrical base 188. A small-straight-cross symbol, or "(small)+" 220 superimposed upon a small-diagonal-cross symbol, or "(small)x" 222 is centered in a common square frame of reference of the upper horizontal surface of the alternative king-crown 216 and also optionally centered on all four lateral vertical surfaces on the upper-third of the triple-cube-size section 280. The resultant composite objective-function symbol, or superimposed small-straight cross / small-diagonal-cross symbol, or "(small)+ / (small)x" 224 within the common square frame of reference of the alternative king-crown 216 and also optionally centered in the upper-third of the alternative king-II-torso 280 symbolizes an alternative king-II functional configuration and indicates alternative moves of one square orthogonally and one square diagonally in eight possible directions for the alternative king-II 278.

Figure 41A:
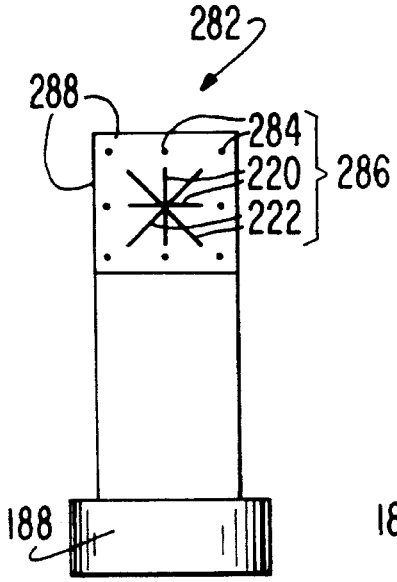
Figure 41B:
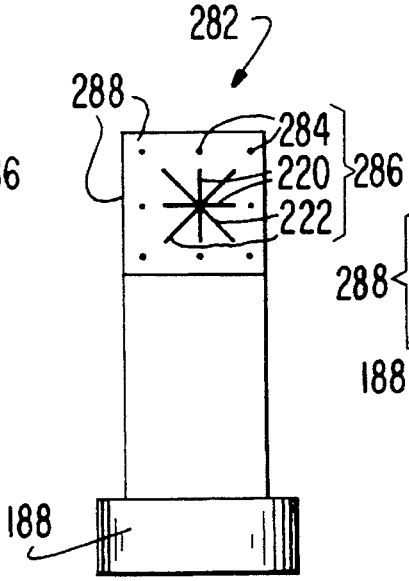
Figure 41C:
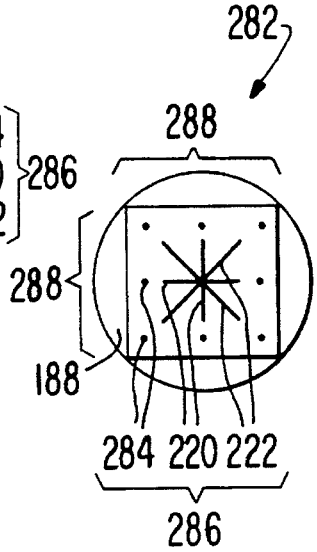

FIGS. 41A, 41B, and 41C illustrate an alternative singular functional playing piece or alternative court-jester 282 (for the fourth, and fifth versions of the game) comprising a small-straight-cross symbol, or "(small)+" 220 superimposed upon a small-diagonal-cross symbol, or "(small)x" 222, with an eight-radial-dots symbol, or "(2x)::" 284 which are located just beyond the end of the lines of the superimposed configurations 220 and 222. This composite singular-function symbol, or superimposed small-straight-cross / small-diagonal-cross / eight-radial-dots symbol, or "(small)+ / (small)x / (2x)::" 286 is centered in the common square frame of reference of at least the upper horizontal surface and also optionally on the lateral vertical surfaces of the upper two-fifths of the two-and-one-half-cube-size alternative court-jester-torso 288, optionally fixed upon a wide cylindrical base 188. The resultant composite singular-function symbol, or superimposed small-straight-cross / small-diagonal-cross / eight radial dots symbol, or "(small)+ / (small)x / ( 2x)::" 286 within the common square frame of reference of the alternative court-jester-torso 288 signifies an alternative court-jester functional configuration and indicates alternative moves of: 1) either one square orthogonally or one square diagonally in eight possible directions, 2) a two square jumping move either orthogonally or diagonally in eight possible directions, providing there is an adjacent intervening piece to jump over, and 3) lastly, the ability to exchange positions with any like-colored piece, even the king, by means of either of the two previously described moves.

IX) VARIATIONS OF ALTERNATIVE FUNCTIONAL PLAYING PIECES (FIGS. 23C, 24C, 25C, 26C, 27C, 28C, 29C, 30C, 31C, 32C, 33C, 34C, 35C, 36C, 37C, 38C, 39C, 40C, 41C; 42A, 42B; 43A, 43B, 43C, 43D; 44A, 44B, 44C, and 44D)

Although the alternative functional playing pieces have been shown as one particular kind, there are a number of other ways of making the fundamental invention. Several are presented as different examples of some other possible variations of the alternative functional playing pieces.

These different variations of the alternative functional playing pieces are similar with respect to the four basic symbols used but are fundamentally different with respect to their three-dimensional structure. The structure of some of these variations are relatively flat pieces (like checkers) of uniform height, having upper surface appearance and inscriptions similar to that of the "C" series of FIGS. 23C through FIG. 41C, inclusive. The functional symbols may be either two or three-dimensional in nature. The second and third variations lack the emphasis of height of duplex and triplex playing pieces, which are used in the other versions to signify multiple alternative potential movements.

The simplified second and third versions are adequate to play the game and have the advantage of requiring less material and labor to construct. They also have the further advantage of requiring less storage space than the larger structural pieces. From the perspective of simplicity and design, these variations are closely related to the computer versions which will be described later.

A ) First-Variation Alternative Functional Playing Pieces (-F1)

Figure 42A:
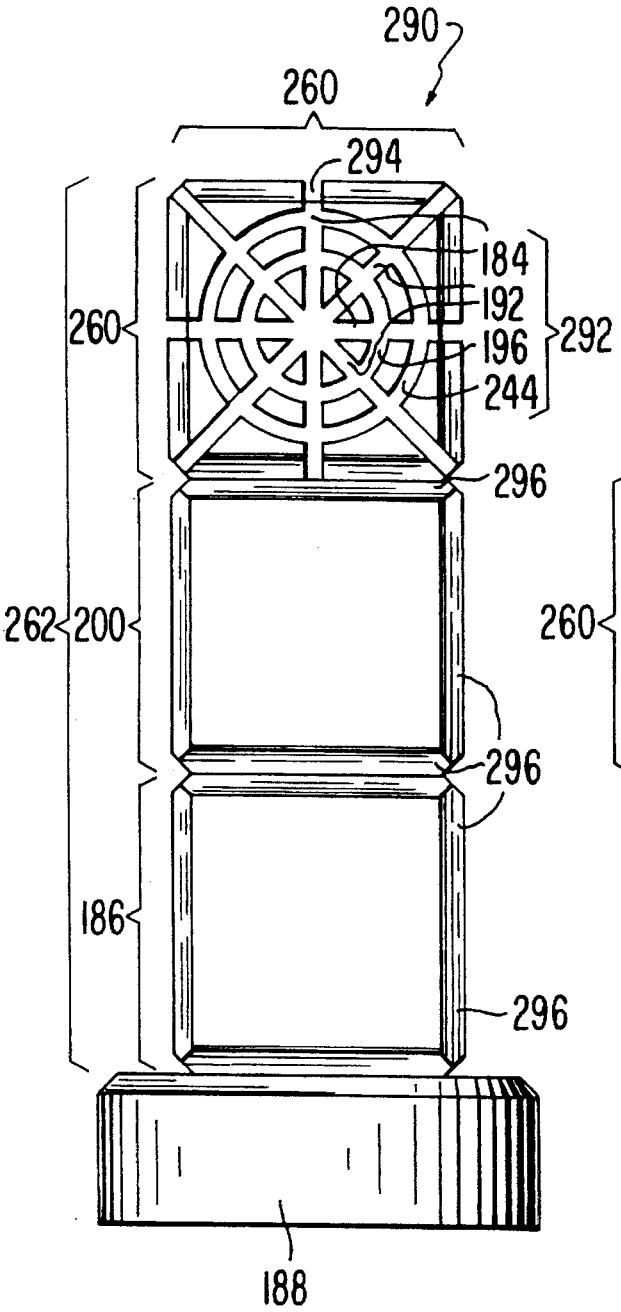
FIG. 42A is a side and frontal view and FIG. 42B is a top plan view of a hypothetical-universal first-variation functional playing piece comprising a hypothetical-universal functional symbol, to illustrate a variant form of functional playing pieces for use with five described versions (V1-F1, V2-F1, V3-F1, V4-F1, and V5-F1) of the chess-type strategy strategy game.
Figure 42B:
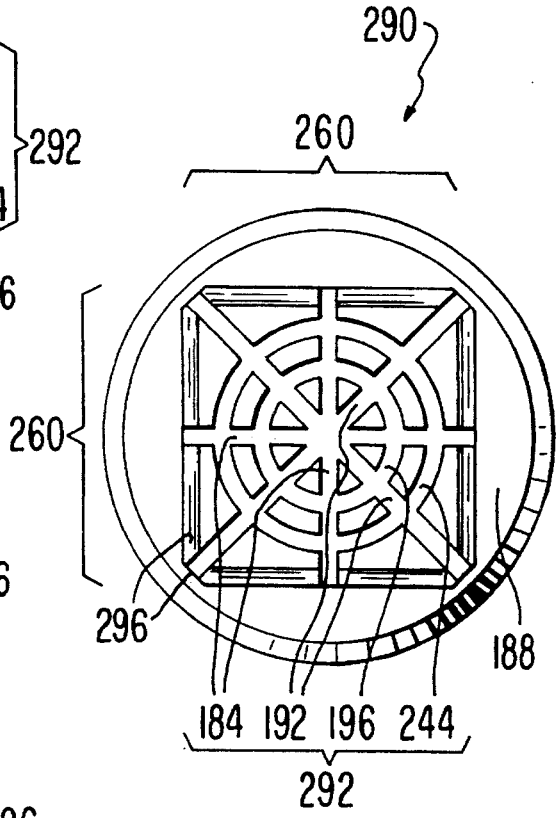

(FIGS. 42A, and 42B)

As indicated in the description above regarding alternative functional playing pieces, all of the functional symbolic configurations, which indicate the moves and capturing patterns of the various pieces, may be formed as recessed grooves in the cubic surface. This provides three-dimensional function symbols which extends between two parallel, two-dimensional planes. This design concept has the advantage of giving the playing pieces clearer definition without applied two-dimensional indicia, which can wear off with excessive use and abuse.

FIGS. 42A, and 42B represent a composite playing piece, which does not belong in an actual set of playing pieces, but is useful to demonstrate the design concept involved. This composite playing piece is referred to as a hypothetical-universal functional playing piece since it has all the moves of all of the simplex pieces, but it has no actual utility in the game because it would have little vulnerability to the other pieces and consequently would destroy the balance of power of the various pieces to each other. However, the purpose of illustrating this composite hypothetical-universal functional playing piece is to show and compare simultaneously all of the four different function symbols that are incorporated in it, without having to represent them all in separate drawings, since the basic design concept is obvious. All four simplex, six duplex, and four triplex playing pieces are readily conceptualized from this one hypothetical composite piece, because each different simplex playing piece comprises one different function symbol, each different duplex playing piece comprises two different function symbols, and each different triplex playing piece comprises three different function symbols. Given the previously described alternative functional style playing pieces, even the king, queen, and court-jester can be easily conceived in terms of this first-variation:

FIG. 42A illustrates both side and frontal views, and FIG. 42B illustrates a top view of a hypothetical-universal first-variation alternative functional playing piece 290 comprising a first-single-function symbol, or straight-cross symbol, or "+" 184 superimposed upon a second-single-function symbol, or diagonal-cross symbol, or "x" 192 superimposed upon a third-single-function symbol, or small-circle symbol, or "o" 196 superimposed upon a fourth-single-function symbol, or large-circle symbol, or "○" 244, all centered within a common square frame of reference of at least the upper horizontal surface of an upper third-uniform-single-tier structure or third-cubic form 260 fixed in vertical alignment upon a middle second-uniform-single-tier structure or second-cubic form 200 fixed in vertical alignment upon a lower first-uniform-single-tier structure or first-cubic form 186 creating a uniform triple-tier structure or triplex cubic form 262 optionally fixed upon a wider cylindrical base 188. The resultant composite hypothetical-universal-function symbol, or superimposed straight-cross / diagonal-cross / small-circle / large-circle symbol, or "+ / x / o / ○" 292 comprises three-dimensional recessed grooves 294 for enhancing definition within the square frame of reference of at least the upper horizontal surface of the upper third-uniform-single-tier structure or third-cubic form 260 and symbolizes hypothetical-universal-function and indicates the alternative moves of rook, bishop, knight, and bowman. The beveled edges 296 of the first-cubic form 186, the second-cubic form 200, and the third-cubic form 260 consequently also provide three-dimensional grooves separating the surfaces of the different cubic forms. The hypothetical-universal first-variation alternative functional playing piece 290 contains the four basic function symbols necessary to make a set of three-dimensional first-variation alternative functional playing pieces for all versions of the game.

Each simplex symmetrical geometric configuration comprises one function symbol component of the hypothetical-universal-function symbol or superimposed straight-cross / diagonal-cross / small-circle / large-circle symbol or "+ / x / o / ○" 292 centered at least within the square frame of reference of the upper horizontal surface of a first-uniform-single-tier structure or first-cubic form or simplex cubic form 186.

Each duplex symmetrical geometric functional configuration comprises two different function symbol components of the hypothetical-universal-function symbol or superimposed straight-cross / diagonal-cross / small-circle / large-circle symbol or "+ / x / o / ○" 292 centered at least within the square frame of reference of the upper horizontal surface of a uniform double-tier structure or duplex cubic form 202.

Each triplex configuration symmetrical geometric functional comprises three different function symbol components of the hypothetical-universal-function symbol or superimposed straight-cross / diagonal-cross / small-circle / large-circle symbol or "+ / x / o / ○" 292 centered at least within the square frame of reference of the upper horizontal surface of a uniform triple-tier structure or triplex cubic form 262.

B) Second-Variation Alternative Functional Playing Pieces (-F2)

Figure 43A:
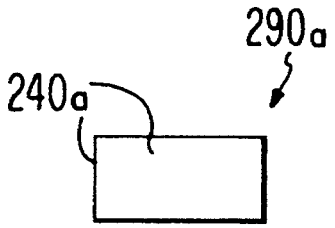
FIG. 43A is a side and frontal view and FIG. 43B is a top plan view of a hypothetical-universal second-variation functional playing piece comprising a hypothetical-universal functional symbol to illustrate a variant form of functional playing pieces for use with five versions (V1-F2, V2-F2, V3-F2, V4-F2, and V5-F2) of the chess-type strategy game.
Figure 43B:
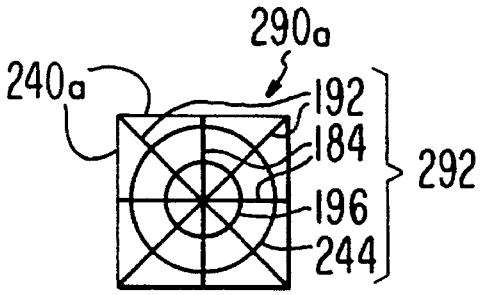

(FIGS. 43A, and 43B)

The function symbol design concept also allows for all playing pieces to be of identical size and identical shape, such as uniform orthogonal-blocks.

FIG. 43A illustrates side and frontal views of a hypothetical-universal second-variation alternative functional playing piece **290*a* comprising a uniform orthogonal-block 240*a***.

FIG. 43B illustrates a top view of a hypothetical-universal second-variation alternative functional playing piece **290*a* comprising a uniform orthogonal-block 240*a* comprising a first-single-function symbol, or straight-cross symbol, or "+" 184 superimposed upon a second-single-function symbol, or diagonal-cross symbol, or "x" 192 superimposed upon a third-single-function symbol, or small-circle symbol, or "o" 196 superimposed upon a fourth-single-function symbol, or large-circle symbol, or "○" 244. The resultant composite hypothetical-universal-function symbol, or superimposed straight-cross / diagonal-cross / small-circle / large-circle symbol, or "+ / x / o / ○" 292 being centered within the square frame of reference of the square upper horizontal surface of the uniform orthogonal-block 240*a*. All playing pieces of each set have the same structural size and same size square frame of reference upon the upper horizontal surface, but have different types of function symbols centered upon the square upper horizontal surface. The hypothetical-universal second-variation alternative functional playing piece 290*a* comprising the hypothetical-universal-function symbol 292** has the four basic functional symbols necessary to make a set of second-variation alternative functional playing pieces from uniform orthogonal-blocks for all versions of the game (which may also comprise recessed grooves in the upper square surfaces).

Each of four different simplex symmetrical geometric functional configurations comprise one different function symbol component of the hypothetical-universal-function symbol 292 centered at least within the square frame of reference of the upper horizontal surface of a uniform orthogonal-block 240*a*.

Each of six different duplex configurations comprise two different function symbol components of the hypothetical-universal-function symbol 292 centered at least within the square frame of reference of the upper horizontal surface of a uniform orthogonal-block 240*a*.

Each of four different triplex symmetrical geometric functional configurations comprise three different function symbol components of the hypothetical-universal-function symbol 292 centered at least within the square frame of reference of the upper horizontal surface of a uniform orthogonal-block 240*a*.

C ) Third-Variation Alternative Functional Playing Pieces (-F3)

Figure 44A:
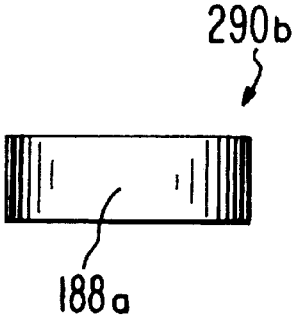
FIG. 44A is a side and frontal view and FIG. 44B is a top plan view of a hypothetical-universal third-variation functional playing piece comprising a hypothetical-universal functional symbol to illustrate a variant form of functional playing pieces for use with five versions (V1-F3, V2-F3, V3-F3, V4-F3, and V5-F3) of the chess-type strategy game.
Figure 44B:
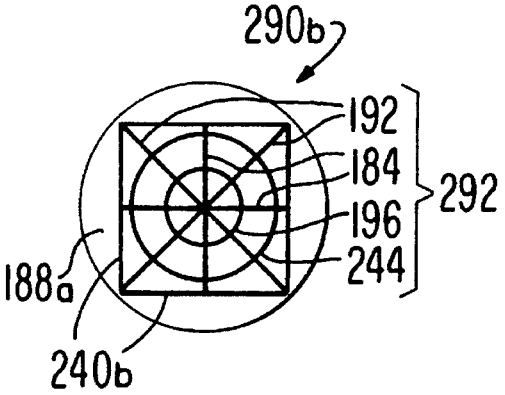

(FIGS. 44A, and 44B)

The function symbol design concept also allows for all playing pieces to be of identical size and identical shape, such as uniform cylindrical-blocks.

FIG. 44A illustrates side and frontal views of a hypothetical-universal third-variation alternative functional playing piece 290*b* comprising a uniform cylindrical-block 188*a*.

FIG. 44B shows a top view of a hypothetical-universal third-variation alternative functional playing piece 290*b* comprising a uniform cylindrical-block 188*a* comprising a first single-function symbol, or straight-cross symbol, or "+" 184 superimposed upon a second-single-function symbol, or diagonal-cross symbol, or "x" 192 superimposed upon a third-single-function symbol, or small-circle symbol, or "o" 196 superimposed upon a fourth-single-function symbol, or large-circle symbol, or "○" 244. The resultant composite hypothetical-universal-function symbol, or superimposed straight-cross / diagonal-cross / small-circle / large-circle symbol, or "+ / x / o / ○" 292 being centered within a inscribed uniform square frame of reference 240*b* centered upon the upper horizontal surface of the uniform cylindrical-block 188*a* having a uniform structural size, and a uniform circular upper horizontal surface. All playing pieces of each set having the same height and same upper surface size, but different function symbols inscribed on the upper horizontal surface within an inscribed uniform square frame of reference. The hypothetical-universal third-variation alternative functional playing piece 290*b* contains the four basic symbols necessary to make a set of third-variation alternative functional playing pieces from uniform cylindrical-blocks for all versions of the game (which may also comprise recessed grooves in the upper surfaces).

Each of four different simplex symmetrical geometric functional configurations comprise one function symbol component of the hypothetical-universal-function symbol 292 centered at least within the square frame of reference of the upper horizontal surface of a uniform cylindrical-block 240*a*.

Each of six different duplex symmetrical geometric functional configurations comprise two different function symbol components of the hypothetical-universal-function symbol 292 centered at least within the square frame of reference of the upper horizontal surface of a uniform cylindrical-block 240*a*.

Each of four different triplex symmetrical geometric functional configurations comprise three different function symbol components of the hypothetical-universal-function symbol 292 centered at least within the square frame of reference of the upper horizontal surface of a uniform cylindrical-block 240*a*.

D ) Fourth-Variation Alternative Functional Playing Pieces (-F4)

(FIGS. 45A, 45B, 45C, and 45D)

The functional symbol design concept also allows for playing pieces to be of single uniform shapes and multiple permanent vertically stacked uniform shapes, such as uniform single-tier, uniform-double-tier, and uniform-triple-tier orthogonal-blocks.

FIG. 45A illustrates side and frontal views of a simplex (single-tier) fourth-variation alternative functional playing piece 290*c*' comprising one uniform orthogonal-block 240*a*.

FIG. 45B illustrates side and frontal views of a duplex (double-tier) fourth-variation alternative functional playing piece 290*c*" comprising two permanently, and vertically stacked uniform orthogonal-blocks 240*a*.

FIG. 45C illustrates side and frontal views of a triplex (triple-tier) fourth-variation alternative functional playing piece 290*c*"' comprising three permanently, and vertically stacked uniform orthogonal-blocks 240*a*.

FIG. 45D illustrates a top view of a hypothetical-universal fourth-variation alternative functional playing piece 290*c* comprising the upper horizontal surface of from one to three permanently and vertically stacked uniform orthogonal-blocks 240*a* comprising a first-single-function symbol, or straight-cross symbol, or "+" 184 superimposed upon a second-single-function symbol, or diagonal-cross symbol, or "x" 192 superimposed upon a third-single-function symbol, or small-circle symbol, or "o" 196 superimposed upon a fourth-single-function symbol, or large-circle symbol, or "0" 244. The resultant composite hypothetical-universal-function symbol, or superimposed straight-cross/diagonal-cross/small-circle/large-circle symbol, or "+/x/o/0" 292 being centered within the square frame of reference of the square upper horizontal surface of the upper-most uniform orthogonal-block 240*a*. Consequently, the various simplex, duplex, and triplex playing pieces are of different heights, but they have the same size square frame of reference upon the upper horizontal surface. The hypothetical-universal fourth-variation alternative functional playing piece 290*c* comprising the hypothetical-universal functional symbol 292 has the four basic function symbols necessary to make a set of single and multiple permanently stacked fourth-variation alternative functional playing pieces from uniform orthogonal-blocks for all versions of the game (which may also comprise recessed grooves in the upper square surfaces).

Each of four different simplex symmetrical geometric functional configurations comprise one function symbol component of the hypothetical-universal-function symbol 292 centered at least within the square frame of reference of the upper horizontal surface of one uniform orthogonal-block 240*a*.

Each of six different duplex symmetrical geometric functional configurations comprise two different function symbol components of the hypothetical-universal-function symbol 292 centered at least within the square frame of reference of the upper horizontal surface of two permanently stacked uniform orthogonal-blocks 240*a*.

Each of four different triplex symmetrical geometric functional configurations comprise three different function symbol components of the hypothetical-universal-function symbol 292 centered at least within the square frame of reference of the upper horizontal surface of three permanently stacked uniform orthogonal-blocks 240*a*.

E) Fifth-Variation Alternative Functional Playing (-F5)

FIGS. 46A, 46B, 46C, and 46D

The function symbol design concept also allows for playing pieces to be of any single uniform shapes and permanent vertically stacked uniform shapes, such as uniform single-tier, uniform-double-tier, and uniform-triple-tier cylindrical-blocks.

FIG. 46A illustrates side and frontal views of a simplex (single-tier) fifth-variation alternative functional playing piece 290*d*' comprising one uniform cylindrical-blocks 188*a*.

FIG. 46B illustrates side and frontal views of a duplex (double-tier) fifth-variation alternative functional playing piece 290*d*'' comprising two permanently, and vertically stacked uniform cylindrical-blocks 188*a*.

FIG. 46C illustrates side and frontal views of a triplex (triple-tier) fifth-variation alternative functional playing piece 290*d*''' comprising three permanently, and vertically stacked uniform cylindrical-blocks 188*a*.

FIG. 46D shows a top view of a hypothetical-universal fifth-variation alternative functional playing piece 290*d* comprising a uniform cylindrical-block 188*a* comprising a first-single-function symbol, or straight-cross symbol, or "+" 184 superimposed upon a second-single-function symbol, or diagonal-cross symbol, or "x" 192 superimposed upon a third-single-function symbol, or small-circle symbol, or "o" 196 superimposed upon a fourth-single-function symbol, or large-circle symbol, or "0" 244. The resultant composite hypothetical-universal-function symbol, or superimposed straight-cross/diagonal-cross/small-circle/large-circle symbol, or "+/x/o/0" 292 being centered within a inscribed uniform square frame of reference 240*b* centered upon the horizontal surface of the upper-most of from one to three permanently, vertically stacked uniform cylindrical-blocks 188*a* having a uniform structural size, and a uniform circular upper horizontal surface. Consequently, the simplex, duplex, and triplex playing pieces are of different heights, but they have the same size inscribed uniform square frame of reference upon the same size circular upper horizontal surface. The hypothetical-universal fifth-variation alternative functional playing piece 290*d* contains the four basic symbols necessary to make a set of single and permanently stacked fifth-variation alternative functional playing pieces from uniform cylindrical-blocks for all versions of the game (which may also comprise recessed grooves in the upper surfaces).

Each of four different simplex symmetrical geometric functional configurations comprise one function symbol component of the hypothetical-universal-function symbol 292 centered at least within the square frame of reference of the upper horizontal surface of one uniform cylindrical-block 188*a*.

Each of six different duplex symmetrical geometric configurations comprise two different function symbol components of the hypothetical-universal-function symbol 292 centered at least within the square frame of reference of the upper horizontal surface of two permanently stacked uniform cylindrical-blocks 188*a*.

Each of four different triplex configurations comprise three different function symbol components of the hypothetical-universal-function symbol 292 centered at least within the square frame of reference of the upper horizontal surface of three permanently stacked uniform cylindrical-blocks 188*a*.

X) Computer Versions of the Game:

The function symbol design concept also provides a practical, meaningful symbolism for conversion of the game to computer generated versions, because the function symbols are essentially single, readily distinguishable, superimposable, two-dimensional simple geometric forms having relevant operational symbolism.

The representational type of playing pieces previously described are in some respects less suitable for adaptation to a computer monitoring device because the pieces and their combinations are three-dimensional entities which sometimes tend to obscure each other when imaged on a computer monitor screen, whereas the function symbols of the alternative functional playing pieces are essentially flat two-dimensional symbols which can be combined by superimposition upon each other, upon a two-dimensional surface, without obscuring each other in any way on a computer monitor screen, so that all of their different functional operations are readily apparent.

A suffix (-C) after the chess-type strategy game version-number indicates computer adaptation of the game.

All of the various different versions (V1, V2, V3, V4, and V5) of the chess-type strategy games described above using either representational playing pieces (-R) or alternative functional playing pieces (-F) can also be played by computer using either:

A) computer monitor displayed two-dimensional functional playing piece icons (-CF), which are directed and manipulated upon a computer monitor displayed rectilinear checkered grid, or B) computer monitor displayed three-dimensional representational playing piece images (-CR), which are directed and manipulated upon a computer monitor displayed three-dimensional perspective checkered grid.

A) Computer Monitor Displayed Two-Dimensional Functional Playing Piece Icons (-CF) electronically manipulated upon a Computer Monitor Displayed Two-Dimensional Rectilinear Checkered Grid:

V5-CF, V4a-CF, V4b-CF, and V3-CF (FIGS. 23C, 24C, 25C, 26C, 27C, 28C, 29C, 30C, 31C, 32C, 33C, 34C, 35C, 36C, 37C, 38C, 39C, 40C, 41C; 47A, 47B; 48A, and 48B)

A suffix (-CF) following the game version indicates the utilization of function symbols centered within a square frame of reference to provide computer monitor displayed functional playing piece icons or functional playing piece icons or functional icons signifying playing pieces upon a computer monitor displayed rectilinear checkered grid with marginal indicia representing a gameboard playing surface.

The last chess-type strategy game, version-five (V-5), will be illustrated by using the configurations of the function symbols (described previously under alternative functional playing pieces), each centered within a square frame of reference, to portray the computer monitor displayed functional playing piece icons used in the various computer versions.

1) Computer-Functional-Version-Five: with Seventy-Two Computer Monitor Displayed Functional Playing Piece Icons electronically deployed upon a Computer Monitor Displayed One Hundred Forty-Four Square Gameboard Playing Surface: (V5-CF)

The computerized chess-type strategy game, functional-version-five, utilizing the function symbols (previously described) centered within a square frame of reference to provide computer monitor displayed functional playing piece icons that signify the various playing pieces in operation on a rectilinear checkered grid with marginal numerical and alphabetical indicia constituting a computer monitor displayed gameboard playing surface.

There are two contrasting sets of thirty-six computer monitor displayed functional playing piece icons, each set of thirty-six like-contrast functional playing piece icons which comprise the various different function symbols within a square frame of reference of similar like-contrast and identical-size to provide various computer monitor displayed functional playing piece icons to symbolize the various playing pieces.

The designs of the various function symbols used meet the requirements of being logical operational indicators and the possibility of superimposition of the different single-function symbols upon each other without obscuring each other, thereby enabling the creation of double-function symbols and triple-function symbols.

The other four computer versions of the game using computer monitor displayed functional playing piece icons can be readily conceived following a description of computer version-five (V5-CF) which follows:

a) The Playing Surface (for V5-CF): FIG. 47A illustrates a computer monitor displayed one hundred forty-four square gameboard playing surface for computer functional version-five 298*a* showing the various starting positions of two contrasting sets of thirty-six computer monitor displayed functional playing piece icons: rook icon 184', bishop icon 192', knight icon 196', princess icon 204', duke icon 208', earl icon 212', king icon 224', pawn icon 238', bowman icon 244', marquess icon 248', viscount icon 252', baron icon 256', queen-II icon 264', crown-prince-II icon 268', counsellor icon 272', archbishop-II icon 276', and court-jester icon 286', and comprising a computer monitor displayed twelve-by-twelve square rectilinear checkered grid 300 having a square-perimeter surrounding one hundred forty-four squares 302 with alternating light-squares of twelve-by-twelve square rectilinear checkered grid 304 and dark-squares of twelve-by-twelve square rectilinear checkered grid 306 beginning with a light-square in the right lower corner, and having a margin of twelve-by-twelve square rectilinear checkered grid 308 surrounding the square-perimeter surrounding one hundred forty-four squares 302 of the computer monitor displayed twelve-by-twelve square rectilinear checkered grid 300. A left-margin with numbered indicia from "1" through "12" 310 and a right-margin with numbered indicia from "1" through "12" 312 indicate horizontal ranks of contiguous squares. A lower-margin with alphabetical indicia from letter "a" through letter "l" 314 and an upper-margin with alphabetical indicia from letter "a" through letter "l" 316 indicate vertical files of contiguous squares. Whereby these indicia enable any given square to be located or designated algebraically by a single letter, the file, followed by a single number, the rank. The outer margin of the computer monitor displayed one hundred forty-four square gameboard playing surface for computer functional version-five 298*a* represents the computer monitor screen perimeter 318.

b) Computer Monitor Displayed Functional Playing Piece Icons (for V5-CF): having two contrasting sets of thirty-six functional playing piece icons, each set of like-contrast functional playing piece icons comprising various function symbols centered within a square frame of reference of like-contrast lines, and identical square size. These computer monitor displayed functional playing piece icons are directable upon, conformable with, and removable from any square of the computer monitor displayed rectilinear checkered grid by means computer operational controls, such as a handheld stylus, a mouse, or a computer keyboard, with each contrasting set of computer monitor displayed functional playing piece icons comprising:

(1) four different types of computer monitor displayed simplex functional playing piece icons: rook icon 184', bishop icon 192', knight icon 196', bowman icon 244' with each different type comprising a different simplex configuration having a different single-function symbol centered within a square frame of reference, which can be positioned to conform with any square of the computer monitor displayed twelve-by-twelve square rectilinear checkered grid 300, thereby each different type of simplex configuration indicates a different type of potential movement and capturing pattern:

(a) a computer monitor displayed first-simplex functional playing piece icon, or rook icon, or "[+]" 184' comprising a first-simplex configuration having a first-single-function symbol or straight-cross symbol or "+" 184 centered within a square frame of reference "[ ]", which can be positioned to conform with any square of the computer monitor displayed twelve-by-twelve square rectilinear checkered grid 300, thereby indicating an extended orthogonal movement and capturing pattern in four possible directions, (b) a computer monitor displayed second-simplex functional playing piece icon or bishop icon or "[x]" 192' comprising a second-simplex configuration having a second-single-function symbol or diagonal-cross symbol or "x" 192 centered within a square frame of reference "[ ]", which can be positioned to conform with any square of the computer monitor displayed twelve-by-twelve square rectilinear checkered grid 300, thereby indicating an extended diagonal movement and capturing pattern in four possible directions, (c) a computer monitor displayed third-simplex functional playing piece icon or knight icon or "[o]" 196' comprising a third-simplex configuration having a third-single-function symbol or small-circle symbol or "o" 196 centered within a square frame of reference "[ ]", which can be positioned to conform with any square of the computer monitor displayed twelve-by-twelve square rectilinear checkered grid 300, thereby indicating the small-circle outline of the eight possible jumping dog-leg movement and capturing patterns, (d) a computer monitor displayed fourth-simplex functional playing piece icon or bowman icon or "[0]" 244' comprising a fourth-simplex configuration having a fourth-single-function symbol or large-circle symbol or "0" 244 centered within a square frame of reference "[ ]", which can be positioned to conform with any square of the computer monitor displayed twelve-by-twelve square rectilinear checkered grid 300, thereby indicating primarily the large-circle outline of a two linear dog-leg movement and capturing pattern to eight possible locations around the square of origin of the bowman for any given move, provided the targeted piece is not obstructed by a playing at the first dog-leg position, (2) six different types of computer monitor displayed duplex functional playing piece icons, with each different type comprising a different duplex configuration having a different double-function symbol, comprising two of four different single-function symbols, which are superimposed upon each other, and centered within a common square frame of reference, which can be positioned to conform with any square of the computer monitor displayed twelve-by-twelve square rectilinear checkered grid 300, thereby each different type of duplex configuration indicates two different alternative potential movement and capturing patterns:

(a) a computer monitor displayed first-duplex functional playing piece icon or princess icon (for V1, V2, V4, and V5) or queen icon (for V3) or "[+]/[x]" 204' comprising a first-duplex configuration having a first-double-function symbol or superimposed straight-cross/diagonal cross symbol or "+/x" 204, comprising a first-single-function symbol or straight-cross symbol or "+" 184, superimposed upon a second-single-function symbol or diagonal-cross symbol or "x" 192, with the composite first-double-function symbol or superimposed straight-cross/diagonal cross symbol or "+/x" 204 centered within a common square frame of reference "[ ]", which can be positioned to conform with any square of the computer monitor displayed twelve-by-twelve square rectilinear checkered grid 300, thereby indicating two alternative potential movement and capturing patterns of the two superimposed simplex functional symbols, (b) a computer monitor displayed second-duplex functional playing piece icon or crown-prince icon (for V1, V2, and V3) or duke icon (for V4 and V5) or "[+]/[o]" 208' comprising a second-duplex configuration having a second-double-function symbol or superimposed straight-cross/diagonal-cross symbol or "+/o" 208, comprising a first-single-function symbol or straight-cross symbol or "+" 184, superimposed upon a third-single-function symbol or small-circle symbol or "o" 196, with the composite second-double-function symbol or superimposed straight-cross/diagonal-cross symbol or "+/o" 208 centered within a common square frame of reference "[ ] ", which can be positioned to conform with any square of the computer monitor displayed twelve-by-twelve square rectilinear checkered grid 300, thereby indicating two alternative potential movement and capturing patterns of the two superimposed simplex functional symbols, (c) a computer monitor displayed third-duplex functional playing piece icon or archbishop icon (for V1, V2, and V3) or earl icon (for V4 and V5) or "[x]"/"[o]" 210' comprising a third-duplex configuration having a third-double-function symbol or superimposed diagonal-cross/small-circle symbol or "x/o" 210, having a second-single-function symbol or diagonal-cross symbol or "x" 192, superimposed upon a third-single-function symbol or small-circle symbol or "o" 196, with the composite third-double-function symbol or superimposed diagonal-cross/small-circle symbol or "x/o" 210 centered within a common square frame of reference "[ ] ", which can be positioned to conform with any square of the computer monitor displayed twelve-by-twelve square rectilinear checkered grid 300, thereby indicating two alternative potential movement and capturing patterns of the two superimposed simplex functional symbols, (d) a computer monitor displayed fourth-duplex functional playing piece icon or marquess icon or "[+]/[0]" 248' comprising a duplex configuration having a fourth-double-function symbol or superimposed straight-cross/large-circle symbol or "+/0" 248, having a first-single-function symbol or straight-cross symbol or "+" 184, superimposed upon a fourth-single-function symbol or large-circle symbol or "0" 244, with the composite fourth-double-function symbol or superimposed straight-cross/large-circle symbol or "+/0" 248 centered within a common square frame of reference "[ ]", which can be positioned to conform with any square of the computer monitor displayed twelve-by-twelve square rectilinear checkered grid 300, thereby indicating two alternative potential movement and capturing patterns of the two superimposed simplex functional symbols, (e) a computer monitor displayed fifth-duplex functional playing piece icon or viscount icon or "[x]/[0]" 252' comprising a duplex configuration having a fifth-double-function symbol or superimposed diagonal-cross/large-circle symbol or "x/0" 252, having a second-single-function symbol or "x" 192, superimposed upon a fourth-single-symbol or "0" 244, with the composite fifth-double-function symbol 252 centered within a common square frame of reference "[ ]" which can be positioned to conform with any square of the computer monitor displayed twelve-by-twelve square rectilinear checkered grid 300, thereby indicating two alternative potential movement and capturing patterns of the two superimposed simplex functional symbols, (f) a computer monitor displayed sixth-duplex functional playing piece icon or baron icon or "[o]/[0]" 256' comprising a duplex configuration having a sixth-double-function symbol or superimposed small-circle/large-circle symbol or "o/0" 256, having a sixth-single-function symbol or small-circle symbol or "o" 196, superimposed upon a fourth-single-function symbol or large-circle symbol or "0" 244, with the composite sixth-double-function symbol or superimposed small-circle/large-circle symbol or "o/0" 256 centered within a common square frame of reference "[ ]", which can be positioned to conform with any square of the computer monitor displayed twelve-by-twelve square rectilinear checkered grid 300, thereby indicating two alternative potential movement and capturing patterns of the two superimposed simplex functional symbols, (3) four different types of computer monitor displayed triplex functional playing piece icons, with each different type comprising a different triplex configuration having a different triple-function symbol, comprising three of four different single-function symbols, which are superimposed upon each other, and centered within a common square frame of reference, which can be positioned to conform with any square of the computer monitor displayed twelve-by-twelve square rectilinear checkered grid 300, thereby each different type of triplex configuration indicates three different alternative potential movement and capturing patterns:

(a) a computer monitor displayed first-triplex functional playing piece icon or queen-II icon or "[+]/[x]/[o]" 264' comprising a first-triplex configuration having a first-triple-function symbol or superimposed straight-cross/diagonal-cross/small-circle symbol or "+/x/o" 264, having a first-single-function symbol or straight-cross symbol or "+" 184, superimposed upon a second-single-function symbol or diagonal-cross symbol or "x" 192, superimposed upon a third-single-function symbol or small-circle symbol or "o" 196, with the composite first-triple-function symbol or superimposed straight-cross/diagonal-cross/small-circle symbol or "+/x/o" 264 centered within a common square frame of reference "[ ]", which can be positioned to conform with any square of the computer monitor displayed twelve-by-twelve square rectilinear checkered grid 300, and thereby indicating three different alternative potential movement and capturing patterns of the three superimposed simplex functional symbols, (b) a computer monitor displayed second-triplex functional playing piece icon or crown-prince-II icon or "[+]/[o]/[0]" 268' comprising a second-triplex configuration having a second-triple-function symbol or superimposed straight-cross/small-circle/large-circle symbol or "+/o/0" 268, having a first-single-function symbol or straight-cross symbol or "+" 184, superimposed upon a third-single-function symbol or small-circle symbol or "o" 196, superimposed upon a fourth-single-function symbol or large-circle symbol or "0" 244, with the composite second-triple-function symbol or superimposed straight-cross/small-circle/large-circle symbol or "+/o/0" 268 centered within a common square frame of reference "[ ]", which can be positioned to conform with any square of the computer monitor displayed twelve-by-twelve square rectilinear checkered grid 300, thereby indicating three different alternative potential movement and capturing patterns of the three superimposed simplex functional symbols, (c) a computer monitor displayed third-triplex functional playing piece icon or counsellor icon or "[+]/[x]/[0]" 272' comprising a third-triplex configuration having a third-triple-function symbol or superimposed straight-cross/diagonal-cross/large-circle symbol or "+/x/0" 272, having a first-single-function symbol or straight-cross symbol or "+" 184, superimposed upon a second-single-function symbol or diagonal-cross symbol or "x" 192, superimposed upon a fourth-single-function symbol or large-circle symbol or "0" 244, with the composite third-triple-function symbol or superimposed straight-cross/diagonal-cross/large-circle symbol or "+/x/0" 272 centered within a common square frame of reference "[ ]", which can be positioned to conform with any square of the computer monitor displayed twelve-by-twelve square rectilinear checkered grid 300, thereby indicating three different alternative potential movement and capturing patterns of the three superimposed simplex functional symbols, (d) a computer monitor displayed fourth-triplex functional playing piece icon or archbishop-II icon or "[x]/[o]/[0]" 276' comprising a fourth-triplex configuration having a fourth-triple-function symbol or superimposed diagonal-cross/small-circle/large-circle symbol or "x/o/0" 276, having a second-single-function symbol or diagonal-cross symbol or "x" 192, superimposed upon a third-single-function symbol or small-circle symbol or "o" 196, superimposed upon a fourth-single-function symbol or large-circle symbol or "0" 244, with the composite fourth-triple-function symbol or superimposed diagonal-cross/small-circle/large-circle symbol or "x/o/0" 276 centered within a common square frame of reference "[ ]", which can be positioned to conform with any square of the computer monitor displayed twelve-by-twelve square rectilinear checkered grid 300, thereby indicating three different alternative potential movement and capturing patterns of the three superimposed simplex functional symbols, (4) one computer monitor displayed objective functional playing piece icon or king icon (for V3, V4, and V5) or "(small) [+]/(small) [x]" 224' comprising an objective configuration having a composite objective-function symbol or superimposed small-straight-cross/small-diagonal-cross symbol or "(small)+/(small)x" 224, having a small-straight-cross symbol or "(small)+" 220, superimposed upon a small-diagonal-cross symbol or "(small)x" 222, with the superimposed small-straight-cross/small-diagonal-cross symbol or "(small)+/(small)x" 224 being centered within a common square frame of reference "[ ]", which can be positioned to conform with any square of the computer monitor displayed twelve-by-twelve square rectilinear checkered grid 300, and thereby indicating two different alternative potential movement and capturing patterns of the two superimposed half-size simplex functional symbols, indicating alternatively, either one square orthogonally, or one square diagonally, (5) one computer monitor displayed singular functional playing piece icon or court-jester icon or "(small) [+]/(small) [x]/(2x) [::]" 286 comprising a singular-function symbol or small-straight-cross / small-diagonal-cross/eight radial dots symbol or "(small)+/(small)x/(2x)::" 286, having a small-straight-cross symbol 220, superimposed upon a small-diagonal-cross symbol 222, and an eight radial dots symbol 284, with the singular-function symbol or "(small)+/(small)x/(2x)::" 286 centered within a common square frame of reference "[ ]", which can be positioned to conform with any square of the computer monitor displayed twelve-by-twelve square rectilinear checkered grid 300, thereby indicating three different types of potential movement and capturing patterns, (6) twelve computer monitor displayed minimal functional playing piece icons or pawn icons or 238', each comprising a minimal-function symbol or composite left-diagonal/double-straight/right-diagonal symbol or "\||/" 238, having a left-diagonal symbol or "\" 232, a double-straight symbol or "||" 234, and a right-diagonal symbol or "/" 236, all centered in sequence within a common square frame of reference "[ ]", which can be positioned to conform with any square of the computer monitor displayed twelve-by-twelve square rectilinear checkered grid 300, thereby indicating two different types of potential movement, and two different types of capturing patterns.

c) The Number, Function Symbols, and Relative Strength of the various Computer Monitor Displayed Functional Playing Piece Icons (for V5-CF) :

The abbreviations for the names of the various computer monitor displayed functional playing piece icons are listed below. The numbers within parentheses indicate the numbers of computer monitor displayed functional playing piece icons per player. The function symbols are enclosed within brackets, and the functional playing piece icons are enclosed within quotation marks, thereby illustrating the function symbol composition of the various simplex, duplex and triplex functional playing piece icons, and the special function symbols used to represent king, pawn, and court-jester functional playing piece icons. The numbers within braces indicate the relative strengths of the various functional playing piece icons (based on the number of squares that a particular type of functional playing piece icon can reach from a central square on an empty one hundred forty-four square grid gameboard).

R=rooks (2): "[+]": {22 }

B=bishops (2): "[x]": {21 }

N=knights (4):"[0]": {8}

W=bowmen (4):"[0]": {8–16}

S=princess (1):"[x]/[+]": {43}

D=duke (1): "[+]/[o]": {30}

M=marquess (1):"[0]/[+]": {30}

V=earl (1):"[x]/[o]": {29}

E=viscount (1):"[x]/[0]": {29}

0=baron (1):"[0]/[o]": {16}

Q=queen-II (1): "[x]/[o]"/[+]": {51}

P=crown prince-II (1):"[0]/[o]/[+]": {38}

C=counsellor (1): "[x]/[0]/[+]": {51}

A=archbishop-II (1):"[x]/[0]/[o]": {37}

K=king (1): "(small) [+]"/"(small) [x]": {8}

J=court jester (1): "(small) [+]"/"(small) [x]"/(2x) [::]": {8–16}

*=pawns (12): "[\|/]": {2–4} d) The Starting Positions of the Computer Monitor Displayed Functional Playing Piece Icons (for V5-CF) :

(1) players may take alternate turns to select any computer monitor displayed functional playing piece icon and to direct it to any square on their own side of the board, this procedure continues until all of the functional playing piece icons are positioned on the computer monitor displayed rectilinear checkered grid 300, and (2) alternatively, players may begin play from predetermined starting positions. FIG. 47A shows the recommended starting positions for the various computer monitor displayed functional playing piece icons. Simplex functional playing piece icons are indicated by the four different single-function symbols, each centered within a square frame of reference. Both duplex and triplex functional playing piece icons are composites of two and three different single-function symbols, respectively, which are superimposed concentrically upon each other, and centered within a common square frame of reference. King, pawn, and court-jester functional playing piece icons all have different special-function symbols, each centered within a square frame of reference. The various computer monitor displayed functional playing piece icons comprise their respective function symbols centered within a square frame of reference. These functional playing piece icons can be positioned by stylus, mouse, or keyboard to conform with any of the various squares of the computer monitor displayed rectilinear checkered grid. Reading from left to right (FIG. 47A):

(a) on the first rank: baron icon 256', marquess icon 248', princess icon 204', court-jester icon 286', archbishop-II icon 276', queen-II icon 264', king icon 224', crown-prince-II icon 268', counsellor icon 272', earl icon 212', duke icon 208', and viscount icon 252', (b) on the second rank: rook icon 184', knight icon 196', bishop icon 192', bowman icon 244', knight icon 196', bowman icon 244', bowman icon 244', knight icon 196', bowman icon 244', bishop icon 192', knight icon 196', rook icon 184', and (c) on the third rank: pawn icons 238' (across the entire rank).

The opposing computer monitor displayed functional playing piece icons are aligned in positions which are mirror image opposites of the first player's computer monitor displayed functional playing piece icons: on the tenth rank (pawn icons), eleventh rank (simplex icons), and twelfth rank (duplex, triplex, jester, and king icons). These opposing functional playing piece icons are set-up in mirror image opposite positions: queen opposite queen, and king opposite king, etc., the two opposing set being of contrasting indicia.

e) Detailed Description of the Computer Monitor Displayed Functional Playing Piece Icons (for V5-CF) :

The designs of the computer monitor displayed function symbols have been described previously. When these function symbols are centered within a square frame of reference and represented by computer monitor display, they are designated as two dimensional computer monitor displayed functional playing piece icons which are identical in design to the illustrations shown in the "C" series of FIGS. 23C through FIG. 41C, inclusively, but without the cylindrical bases 188 (these figures represent top views of the three dimensional alternative functional playing pieces previously described). The computer monitor displayed functional playing piece icons are also represented on the computer monitor displayed one hundred forty-four square gameboard playing surface of FIG. 47A, FIG. 47B, FIG. 48A, and FIG. 48B, where the square frame of reference of each functional icon coincides with the lines of the computer monitor displayed rectilinear grid.

f) The Method of Play (for V5-CF) :

(1) Provide the following elements:

(a) computer hardware: general purpose data bank and control computer, special purpose search control, move generator and position evaluation processors, computer hard disc, computer monitor, and computer operational controls (stylus, mouse, and keyboards), (b) computer software:

[1] a computer monitor display program for a rectilinear checkered grid having one hundred forty-four squares, and marginal numerical / alphabetical indicia, all projected on the computer monitor screen, as illustrated in FIG. 47A,

[2] a computer monitor display program for two contrasting sets of thirty-six functional playing icons, each contrasting set of functional playing piece icons comprising different function symbols, each function symbol centered within a square frame of reference of the same size as the checkered grid squares, such that each computer monitor displayed functional playing piece icon may be either positioned exactly upon or removed from any square of the computer monitor displayed rectilinear checkered grid, as represented in FIG. 47A.

[a] four different types of simplex functional playing piece icons: a first, a second, a third, and a fourth-simplex functional playing piece icon, each different type having one of four different types of single-function symbols, each of the different types of single-function symbols are centered within a square frame of reference and indicate a different specific potential movement and capturing pattern,

[b] six different types of composite duplex functional playing piece icons: a first, a second, a third, a fourth, a fifth, and a sixth-duplex functional playing piece icon, each type having one of six different composite double-function symbols comprising two of four different types of single-function symbols superimposed concentrically, each of the different types of composite double-function symbols are centered within a common square frame of reference and indicate two specific alternative potential movement and capturing patterns,

[c] four different types of composite triplex functional playing piece icons: a first, a second, a third, and a fourth triplex functional playing piece icon, each different type having one of four different composite triple-function symbols comprising three of four different types of single-function symbols superimposed concentrically, each of the different types of composite triple-function symbols are centered within a common square frame of reference and indicate three specific alternative potential movement and capturing patterns,

[d] a plurality of minimal functional playing piece icons, having a different specific function symbol centered within a square frame of reference and indicating a different specific potential movement pattern, and a different specific capturing pattern,

[e] an objective functional playing piece icon, having a different specific function symbol centered within a square frame of reference and indicating two different specific potential movement and capturing patterns.

[f] a singular functional playing piece icon, having a different specific function symbol centered within a square frame of reference and indicating several different specific potential movement and capturing patterns.

(2) Encode and program the various simplex, duplex, triplex, minimal, objective, and singular computer monitor displayed functional playing piece icons and their movement and capturing patterns, together with game rule data, pattern recognition data, search priority data, move generator data, and goal oriented planning systems into computer software architecture.

(3) Manipulate the computer monitor displayed functional playing piece icons on the computer monitor displayed rectilinear checkered grid playing screen, by means of computer operational controls (stylus, mouse, and keyboards), according to the following rules:

(a) move individual functional playing piece icons according to the following patterns:

[1] a first-simplex functional playing piece icon: according to a first movement and capturing (captivating) pattern identified as pattern (a), or orthogonally,

[2] a second-simplex functional playing piece icon: according to a second movement and capturing (captivating) pattern, which is different from pattern (a), and is identified as pattern (b), or diagonally,

[3] a third-simplex functional playing piece icon: according to a third movement and capturing (annihilating) pattern, which is different from pattern (a) and pattern (b), and is identified as pattern (c), or one jumping dog-leg,

[4] a fourth-simplex functional playing piece icon: according to alternative movement and capturing (annihilating) pattern (d):

[a] a movement without capturing: by moving a non-capturing, non-jumping, single-dog-leg, or movement of one square orthogonally, followed by one square diagonally, at forty-five degrees deviation from the first direction moved, and alternatively, movement of one square diagonally, followed by one square orthogonally, at forty-five degrees deviation from the first direction moved, to one of eight possible locations describing a small-circle around the initial position of the fourth-simplex playing piece for that move, but without jumping ability or capturing potential, and

[b] a movement with capturing (annihilation): by moving to and displacing any opponent's playing piece located exactly two-linear dog-legs distant or moving two jumping dog-legs in the same direction, to one of eight possible locations describing a large-circle around the initial position of the fourth-simplex playing piece for that move, and provided that no playing piece is interposed at the end square of the first dog-leg, thereby obstructing the targeted piece and preventing the annihilation,

[5] a composite first-duplex functional playing piece icon: according to alternative movement and capturing (captivating) patterns (a) and (b), or alternatitive patterns (a) and (b),

[6] a composite second-duplex functional playing piece icon: according to alternative movement and capturing (captivating and annihilating) patterns (a) and (c), or alternative patterns (a) and (c),

[7] a composite third-duplex functional playing piece icon: according to alternative movement and capturing (captivating and annihilating) patterns (b) and (c), or alternative patterns (b) and (c),

[8] a composite fourth-duplex functional playing piece icon: according to alternative movement and capturing (captivating and annihilating) patterns (a) and (d), or alternative patterns (a) and (d),

[9] a composite fifth-duplex functional playing piece icon: according to alternative movement and capturing (captivating and annihilating) patterns (b) and (d), or alternative patterns (b) and (d),

[10] a composite sixth-duplex functional playing piece icon: according to alternative movement and capturing (annihilating) patterns (c) and (d), or alternative patterns (c) and (d),

[11] a composite first-triplex functional playing piece icon: according to alternative movement and capturing (captivating and annihilating) patterns (a), (b), and (c), or alternative patterns (a), (b) and (c),

[12] a composite second-triplex functional playing piece icon: according to alternative movement and capturing (captivating and annihilating) patterns (a), (c), and (d), or alternative patterns (a), (c) and (d),

[13] a composite third-triplex functional playing piece icon: according to alternative movement and capturing (captivating and annihilating) patterns (a), (b) and (d), or alternative patterns (a), (b) and (d),

[14] a composite fourth-triplex functional playing piece icon: according to alternative movement and capturing (captivating and annihilating) patterns (b), (c), and (d), or alternative patterns (b), (c) and (d),

[15] objective playing functional playing piece icon: according to a movement and capturing (captivating) pattern (e), alternatively one square orthogonally, and one square diagonally,

[16] singular playing functional playing piece icon: according to a movement and capturing (captivating) patterns (f), by:

[a] same as pattern (e), or pattern (f1), and

[b] the ability to jump two squares over an adjacent piece diagonally, and orthogonally, as pattern (f2), and

[c] the ability to exchange positions with any like-colored piece by either (1) or (2), as pattern (f3), and

[17] minimal playing functional playing piece icons: according to a different movement, and different capturing (annihilating) pattern (g):

[a] forward movement of one or two squares during any move anywhere on the board, without capturing (annihilating) ability, as pattern (g1), and

[b] the ability to capture (annihilate) by moving one square alternatively diagonally forward left and diagonally forward right, as pattern (g2), and

[c] the option to capture (annihilate) an adjacent passing pawn, anywhere on the board, following an opponent's two square move, as if the opposing pawn had moved only one square, as pattern (g3).

(b) take alternate turns:

[1] one player has the first move,

[2] players continue taking turns of moving computer monitor displayed functional playing piece icons and capturing (captivating and annihilating) the opponent's computer monitor displayed functional playing piece icons, one functional playing piece icon at a time according to the above patterns,

[3] both pawn icons and knight icons, when reaching the last ranks, can liberate any captivated functional playing piece icon, the liberated icon is exchanged for the liberating icon, the pawn icon is returned to the beginning pawn icon rank on the same file (and knighted if possible), and the knight icon is returned to a knight starting position, but if these positions are occupied, the knight is itself captivated in the act of liberation.

(g) Winning and scoring the game: by either player capturing (captivating and annihilating) an opponent's objective functional playing piece icon, or by the player whose opponent resigns. The winner is awarded one point, and alternatively, the winner may be determined by the multiple point awarding system.

h) Significance of the Game (V5-CF):

(1) enables players to play the chess-type game together without requiring a three-dimensional gameboard and individual playing pieces, (2) enables players separated by considerable distance to play the game together simultaneously, (3) provides for better visualization of the board and the playing figures, because the absence of three-dimensional figures eliminates problems arising from the partial visual obstruction of both playing pieces and playing piece images which can be partly hidden behind both other playing pieces and other playing piece images in the foreground, (4) helps comprehension of profoundly complex relationships by stripping sense data cues down to the bare essentials necessary to play the game, because function symbols indicate how the various different functional playing piece icons operate, better than representational figures, and (5) provides the opportunity for one player to compete against a computer opponent of variable degrees of competence.

(6) allows the computer monitor screen to be positioned horizontally as a table-top gameboard between two players operated with input and output controls (mouse, stylus, and keyboards), permits automatic recording and computer printout of game-play, provides for remote monitor viewing, and also is conducive to coin operated computer monitor displayed chess-type strategy game playing.

2) Computer Version-Four-Variations- "a" and "b": with Functional Playing Piece Icons: (V4a-CF), and (V4b-CF)

FIG. 47B, and FIG. 48A

Two alternatives of the computerized fourth-version, V4a-CF and V4b-CF, will be described briefly. They are both played by the same basic rules as for V4-R described previously. They use less computer monitor displayed functional playing piece icons than computer fifth-version (V5-CF), FIG. 47A, and the starting positions of the functional playing piece icons are different as illustrated in FIGS. 47B and 48A, respectively. (Note: These variations can also be implemented with the three-dimensional gameboards using the alternative functional playing pieces).

a) Computer Version-Four-Variation-"a": with Computer Monitor Displayed Functional Playing Piece Icons electronically deployed upon a Computer Monitor Displayed Computer Monitor Displayed One Hundred Forty-Four Square Gameboard Playing Surface: (V4a-CF)

FIG. 47B

This version and variation (V4a-CF) is similar to computer version-five (V5-CF) except for the following differences:

(1) The computer monitor displayed gameboard:

FIG. 47B illustrates a computer monitor displayed one hundred forty-four square gameboard playing surface for computer functional version-four-"a" 298*b* showing starting positions for two contrasting sets of thirty computer monitor displayed functional playing piece icons: rook icon 184', bishop icon 192', knight icon 196', princess (or queen) icon 204', duke (or crown-prince) icon 208', earl (or archbishop) icon 212', king icon 224', pawn icon 238', bowman icon 244', marquess icon 248', viscount icon 252', baron icon 256', queen-II icon 264', crown-prince-II icon 268', counsellor icon 272', archbishop-II icon 276', and court-jester icon 286'. This game uses the function symbols (of the previously described alternative functional playing pieces), centered within square frames of reference, to provide functional playing piece icons. The computer monitor displayed gameboard playing surface comprises a computer monitor displayed twelve-by-twelve square rectilinear checkered grid 300 having a square-perimeter enclosing one hundred forty-four squares 302 with alternating light squares of twelve-by-twelve square rectilinear checkered grid 304 and dark squares of twelve-by-twelve square rectilinear checkered grid 306 beginning with a light square in the right lower corner. A computer monitor displayed margin of twelve-by-twelve square rectilinear checkered grid 308 surrounds the square-perimeter enclosing one hundred forty-four squares 302 of the computer monitor displayed twelve-by-twelve square rectilinear checkered grid 300. A left-margin with numerical indicia from "1" through "12" 310 and a right-margin with numerical indicia from "1" through "12" 312 indicate horizontal ranks of contiguous squares. A lower-margin with alphabetical indicia from letter "a" through letter "l" 314 and an upper-margin with alphabetical indicia from letter "a" through letter "l" 316 indicate vertical files of contiguous squares, whereby these different marginal indicia enable any given square to be located or designated algebraically by a single letter, the file, followed by a single number, the rank. The outer limit of the margin of twelve-by-twelve square grid 308 represents the computer monitor screen perimeter 318.

(2) The number of computer monitor displayed functional playing piece icons per each contrasting set of functional playing piece icons for V4a-CF are less than for V5-CF:

(a) ten instead of twelve pawn icons, (b) two instead of four knight icons, (c) two instead of four bowmen icons, (d) (all other icons are the same).

(3) Method of play (for V4a-CF): essentially the same as for computer version-five (V5-CF), but with players being able to utilize the entire computer monitor displayed twelve-by-twelve square rectilinear checkered grid for movement of any of the various computer monitor displayed functional playing piece icons during the course of a game:

(a) players may take alternate turns to select any computer monitor displayed functional playing piece icon and to direct it to any square on their own side of the board, this procedure continues until all of the functional playing piece icons are positioned on the computer monitor displayed rectilinear checkered grid 300, and (b) alternatively, players may elect to begin the game using predetermined starting positions. The recommended starting positions for the various computer monitor displayed functional playing piece icons for computer version-four-variation-"a" (V4a-CF) are represented as shown in FIG. 47B, from left to right, beginning from the second or "b" file, and continuing through the "k" file:

[1] second rank: viscount icon 252', duke icon 208', earl icon 212', crown-prince-II icon 268', king icon 224', queen-II icon 264', archbishop-II icon 276', princess icon 204', marquess icon 248', baron icon 256',

[2] third rank: rook icon 184', knight icon 196', bishop icon 192', bowman icon 244', counsellor icon 272', court-jester icon 286', bowman icon 244', bishop icon 192', knight icon 196', rook icon 184',

[3] fourth rank: ten pawn icons 238' (across the rank),

[4] the opposing player's computer monitor displayed functional playing piece icons are positioned in mirror image opposite locations on the ninth, tenth, and eleventh ranks, and are differentiated by contrasting humanly sensible indicia, (c) playing by the same basic rules as for V5-CF, (d) winning the game: by either player capturing (captivating and annihilating) the opponent's objective functional playing piece icon, or by the opponent resigning. The winner is awarded one point, and alternatively, the winner may be determined by the multiple point awarding system.

(4) Significance of V4a-CF: since there are less computer monitor displayed functional playing piece icons to start with and also because the back row and side functional playing piece icons are not restricted by an adjacent margin, there is greater freedom and more initial options of movement, which helps to offset the tremendously increased power of the various duplex and triplex functional playing piece icons both individually and in combination. This makes it more difficult to trap and capture (captivate or annihilate) an opponent's king icon very early in the game as the king icon is less confined by the margin. The locations of the court-jester icon and the counsellor icon have been moved in front of the queen icon and king icon, respectively. The court-jester icon can provide escape from an early trap or vulnerable position, if this possibility is anticipated correctly. Castling is not permitted or even desirable in this game. Many new and varied strategies are possible in this variation, which generates a more open and very complex game.

b) Computer Version-Four-Variation-"b": with Computer Monitor Displayed Functional Playing Piece Icons electronically deployed upon a Computer Monitor Displayed One Hundred Square Gameboard Playing Surface: (V4b-CF)

FIG. 48A

This version (V4b-CF) is exactly the same as computer version-four-variation-"a" (V4a-CF) above, except for the following differences:

(1) The computer monitor displayed gameboard:

The computer monitor displayed rectilinear checkered grid is smaller (ten-by ten-squares instead of twelve by twelve squares) and although the starting positions of the various computer monitor displayed functional playing piece icons are in the same positions relative to each other, they are in different positions relative to the marginal indicia.

FIG. 48A illustrates a computer monitor displayed one hundred square gameboard playing surface for computer functional version-four-"b" 320*a* showing starting positions for two contrasting sets of thirty computer monitor displayed functional playing piece icons: rook icon 184', bishop icon 192', knight icon 196', princess (or queen) icon 204', duke (or crown-prince) icon 208', earl (or archbishop) icon 212', king icon 224', pawn icon 238', bowman icon 244', marquess icon 248', viscount icon 252', baron icon 256', queen-II icon 264', crown-prince-II icon 268', counsellor icon 272', archbishop-II icon 276', and court-jester icon 286'. The computer monitor displayed gameboard playing surface comprises a computer monitor displayed ten-by-ten square rectilinear checkered grid 322 having a square-perimeter surrounding one hundred squares 324 and having alternating light squares of ten-by-ten square rectilinear checkered grid 326 and dark squares of ten-by-ten square rectilinear checkered grid 328 beginning with a light square in the right lower corner, and a margin of ten-by-ten square rectilinear checkered grid 330 surrounds the square-perimeter surrounding one hundred squares 324 of the ten-by-ten square rectilinear checkered grid 322. A left-margin with numbered indicia from "1" through "10" 332 and a right-margin with numbered indicia from "1" through "10" 334 indicate horizontal ranks of contiguous squares. The lower-margin with alphabetical indicia from letter "a" through letter "j" 336 and the upper-margin with alphabetical indicia from letter "a" through letter "j" 338 indicate vertical files of contiguous squares. Whereby these marginal indicia enable any given square to be located or designated algebraically by a single letter, the file, followed by a single number, the rank. The outer limit of the ten-by-ten square rectilinear checkered grid 322 represents the computer monitor screen perimeter 318.

(2) The number of computer monitor displayed functional playing piece icons for V4b-CF are the same as for V4a-CF:

(3) Method of play: same as for computer version-four-variation-"a" (V4a-CF), but having a more limited grid size, since the grid is forty-four squares smaller.

(a) the players can take alternate turns to select any computer monitor displayed functional playing piece icon and to direct it to any square on their own side of the board, this procedure continues until all functional playing piece icons are positioned on the computer monitor displayed rectilinear checkered grid, and (b) alternatively, players may elect to use the the recommended starting positions of the various computer monitor displayed functional playing piece icons for computer version-four-variation-"b" (V4b-CF) as represented in FIG. 48A, from left to right:

[1] first rank: viscount icon 252', duke icon 208', earl icon 212, crown-prince-II icon 268', king icon 224', queen-II icon 264', archbishop-II icon 276', princess icon 204', marquess icon 248', baron icon 256',

[2] second rank: rook icon 184', knight icon 196', bishop icon 192, bowman icon 244', counsellor icon 272', court-jester icon 286', bowman icon 244', bishop icon 192', knight icon 196', rook icon 184',

[3] third rank: ten pawn icons 238' (across the rank),

[4] the opposing player's computer monitor displayed functional playing piece icons are positioned in mirror image opposite locations on the eighth, ninth, and tenth ranks, by contrasting humanly sensible indicia, (c) playing by the same basic rules as for V5-CF, (d) Winning the game: by capturing (captivating and annihilating) the opponent's computer monitor displayed objective functional playing piece icon, or by an opponent resigning. The winner is awarded one point, and alternatively, the winner may be determined by using the multiple point awarding system.

(4) Significance of V4b-CF: since there are six fewer computer monitor displayed functional playing piece icons per side to start with than with V5-CF, the game can be played on a smaller checkered grid. The locations of the court-jester icon and the counsellor icon have been moved in front of the queen-II icon and king icon, respectively. The court-jester icon can help to provide escape for the king icon from an early capture (captivation and annihilation), if correctly anticipated. Castling is not permitted or even desirable. A very compact variation of the computerized fourth-version (V4a-CF) of the game that still has the full spectrum of single-function, double-function, and triple-function symbols. Opening moves are critical to avoid being boxed in by one's own functional playing piece icons. A more confined but very complex variation of the game.

3) Computer Version-Three: with Computer Monitor Displayed Functional Playing Piece Icons electronically deployed upon a Computer Monitor Displayed One Hundred Square Gameboard Playing Surface: (V3-CF)

FIG. 48B

This version is the same as computerized version-four-variation-"b" (V4b-CF) above, except for the following differences:

a) The computer monitor displayed gameboard:

The computer monitor displayed rectilinear checkered grid is essentially the same (ten-by-ten squares) but the number of computer monitor displayed functional playing piece icons are substantially less (twenty instead of thirty for each side).

FIG. 48B illustrates a computer monitor displayed one hundred square gameboard playing surface for computer functional version-three **320*b* showing starting positions for two contrasting sets of twenty computer monitor displayed functional playing piece icons: rook icon 184', bishop icon 192', knight icon 196', queen (or princess) icon 204', crown-prince (or duke) icon 208', archbishop (or earl) icon 212', king icon 224', and pawn icon 238'. The playing surface screen comprises a computer monitor displayed ten-by-ten square rectilinear checkered grid 322 having a square-perimeter surrounding one hundred squares 324 with alternating light squares of ten-by-ten square rectilinear checkered grid 326 and dark squares of ten-by-ten square rectilinear checkered grid 328 beginning with a light square in the right lower corner, and a margin of ten-by-ten square rectilinear checkered grid 330 surrounds the square-perimeter surrounding one hundred squares 324 of the computer monitor displayed ten-by-ten square rectilinear checkered grid 322. A left-margin with numerical indicia from "1" through "10" 332 and a right-margin with numerical indicia from "1" through "10" 334 indicate horizontal ranks of contiguous squares. A lower-margin with alphabetical indicia from letter "a" through letter "j" 336 and an upper-margin with alphabetical indicia from letter "a" through letter "j" 338 indicate vertical files of contiguous squares, whereby these marginal indicia enable any given square to be located or designated algebraically by a single letter, the file, followed by a single number, the rank. The outer limit of the computer monitor displayed ten-by-ten square rectilinear checkered grid 322 represents the computer monitor screen perimeter 318**.

b) The number of computer monitor displayed functional playing piece icons are twenty per set, or forty per two contrasting sets, and the recommended starting positions for computer version-three (V3-CF) are as shown in FIG. 48B, which are from left to right:

(1) first rank: rook icon 184', knight icon 196', bishop icon 192', crown-prince icon 208', king icon 224', queen icon 264', archbishop icon 212', bishop icon 192', knight icon 196', and rook icon 184'.

(2) second rank: ten pawn icons 238' (all across the rank).

(3) the opposing player's computer monitor displayed functional playing piece icons are positioned in mirror image opposite locations on the ninth, and tenth ranks, by contrasting humanly sensible indicia.

c) Method of play (for V3-CF):

(1) Provide the following elements:

(a) computer hardware: general purpose data bank and control computer, special purpose search control, move generator and position evaluation processors, computer hard disc, computer monitor, and computer operational controls (stylus, mouse, or computer keyboard), (b) computer software:

[1] a computer monitor display program for a symmetrical rectilinear checkered grid having one hundred squares, and marginal indicia as in FIG. 48B, projected onto the computer monitor screen,

[2] a computer monitor display program for two contrasting sets of functional playing piece icons, each set having twenty functional playing icons, as illustrated in FIG. 48B:

[a] three different types of simplex functional playing piece icons, a first, a second, and a third-simplex functional playing piece icon, each type having a different simplex functional configuration comprising one of three different types of single-function symbols within a square frame of reference, each different type of simplex configuration indicating a different and specific potential movement and capturing (captivating and annihilating) pattern,

[b] three different types of duplex functional playing piece icons, a first, a second, and a third-duplex functional playing piece icon, each type having a different composite duplex functional configuration comprising two of three different types of single-function symbols superimposed concentrically within a common square frame of reference, each different type of duplex configuration indicating two specific alternative potential movement and capturing (captivating and annihilating) patterns,

[c] a plurality of minimal functional playing piece icons, having a minimal functional configuration comprising different specific function symbols within a square frame of reference indicating two different and specific potential movement and two different and specific potential capturing (annihilating) patterns,

[d] an objective functional playing piece icon, having an objective configuration comprising different specific function symbols indicating two different and specific potential movement and capturing (captivating) patterns.

(2) Encoding and programing said simplex, duplex, minimal, and objective functional playing piece icons and their movement and capturing patterns, together with game rule data, pattern recognition data, search priority data, move generator data, and goal oriented planning systems into computer software architecture.

(3) Manipulating computer monitor displayed functional playing piece icons on computer monitor displayed ten-by-ten rectilinear checkered grid gameboard according to the following rules:

(a) starting positions (for V3-CF):

[1] the players can take alternate turns to select any computer monitor displayed functional playing piece icon and to direct it to any square on their own side of the playing screen, this procedure continues until all functional playing piece icons are positioned on the computer monitor displayed ten-by-ten square rectilinear checkered grid, and

[2] alternatively, the recommended starting positions of the various computer monitor displayed functional playing piece icons, for computer version-three, are as represented in FIG. 48B, (b) moving individual computer monitor displayed functional playing piece icons according to the following patterns:

[1] a first-simplex functional playing piece icon: according to a first movement and capturing (captivating) pattern identified as pattern (a), orthogonally,

[2] a second-simplex functional playing piece icon: according to a second movement and capturing (captivating) pattern, which is different from said pattern (a), and is identified as pattern (b), diagonally,

[3] a third-simplex functional playing piece icon: according to a third movement and capturing (annihilating) pattern, which is different from said pattern (a), and said pattern (b), and is identified as pattern (c), one jumping dog-leg,

[4] a first-duplex functional playing piece icon: according to alternative movement and capturing (captivating) patterns (a) and (b), or alternative patterns (a) and (b),

[5] a second-duplex functional playing piece icon: according to alternative movement and capturing (captivating and annihilating) patterns (a) and (c), or alternative patterns (a) and (c),

[6] a third-duplex functional playing piece icon: according to alternative movement and capturing (captivating and annihilating) patterns (b) and (c), or alternative patterns (b) and (c),

[7] an objective functional playing icon: according to movement and capturing (captivating) pattern (e), alternatively one square orthogonally, and one square diagonally,

[8] minimal functional playing piece icons: according to alternative different movement and capturing (annihilating) patterns (g), by

[a] forward movement of one or two squares during any move anywhere on the board, without capturing (annihilating) ability, and

[b] the ability to capture (annihilate) by moving alternatively one square diagonally forward left, and diagonally forward right, including the option to capture (annihilate) an opponent's adjacent passing pawn, following a two square move, as if the opposing pawn had moved only one square, (c) alternating turns

[1] one player having the first move,

[2] players continue taking turns of moving computer monitor displayed functional playing piece icons, and capturing (captivating and annihilating) opponent's computer monitor displayed functional playing piece icons, one at a time, according to the patterns described above, and according to the general rules described previously, and

[3] players can liberate captivated functional playing piece icons by pawn icons and knight icons reaching the last ranks, (d) winning and scoring the game: by capturing (captivating and annihilating) the opponent's objective functional playing piece icon or king icon, and by an opponent resigning. The winner is awarded one point, and alternatively, the winner may be determined by the multiple point awarding system.

d) Significance of the game (V3-CF):

The computer version V3-CF of the chess-type strategy game has several features which make it particularly interesting:

(1) V3-CF has most of the advantages listed for V5-CF as stated above.

(2) V3-CF is a far less complicated game than V4a-CF, V4b-CF, and V5-CF.

(3) V3-CF is a natural prerequisite to learning the more complicated V4a-CF, V4b-CF, and V5-CF versions.

(4) Many players will find this game (V3-CF) to be of sufficient complexity that they will have little interest in playing a game of even greater dynamism and complexity such as V4a-CF, V4b-CF, and V5-CF. However, some players that develop a certain degree of proficiency with V3-CF eventually will want to progress on to V4a-CF, V4b-CF, and V3-CF. Some players, who learn to play the more complex games will still prefer playing V3-CF because of it's greater simplicity, fewer pieces, and smaller grid size. For many players V3-CF will have special appeal because of it's intermediate complexity, and realizing that the game is still far more complex and more dynamic than conventional chess.

B) Computer Monitor Displayed Representational Playing Piece Images (-CR) electronically deployed upon a Computer Monitor Displayed Thirty-Six Square Gameboard Playing Surface in Three-Dimensional Perspective:

The playing pieces and gameboards also can be represented by computer monitor display of both the board squares and any of the various different styles of playing pieces (functional and representational) in three-dimensional perspective.

1) Computer Version-One: using Representational Playing Piece Images: (V1-CR)

(FIGS. 2A, 2B, 2C; 3A, 3B, 3C; 4A, 4B, 4C; 5A, 5B, 5C; 6A, 6B, 6C; 7A, 7B, 7C; and 49)

The generic first-version (V1-R) of the game can be played also by computer (V1-CR), with either two players or by one player against a computer program. Both the gameboard and the representational playing pieces can be provided by computer monitor display in three-dimensional perspective.

A suffix (-C) indicates a computer monitor displayed game version, and the addition of a suffix (-R) to make a suffix (-CR) indicates the use of three-dimensional perspective representational playing piece images upon a three-dimensional perspective gameboard playing surface image, (FIG. 49).

a) The gameboard playing surface image (for V1-CR):

FIG. 49 illustrates a computer monitor displayed three-dimensional perspective thirty-six square gameboard playing surface for computer representational version-one 340 showing various computer monitor displayed three-dimensional perspective representational playing piece images. The gameboard playing surface image comprises a computer monitor displayed six-by-six square three-dimensional perspective checkered grid 342 with alternating three-dimensional perspective light-squares 344 and three-dimensional perspective dark-squares 346 such that like-squares are diagonally aligned and alternate orthogonally, with the computer monitor displayed six-by-six square checkered grid in three-dimensional perspective 342 surrounded by a left-margin comprising numerical indicia from "1" to "6" in three-dimensional perspective 348, and a right-margin comprising numerical indicia from "1" to "6" in three-dimensional perspective 350 signifying ranks; and a lower-margin comprising alphabetical indicia from "a" to "f" in three-dimensional perspective 352, and a upper-margin comprising alphabetical indicia from "a" to "f" in three-dimensional perspective 354 signifying files. Thereby, any specific square on the gameboard playing surface image can be identified by a letter and a number. A margin outer-perimeter in three-dimensional perspective 356 marks the limits of the playing surface image.

Various computer monitor displayed representational playing piece images in three-dimensional perspective are shown deployed upon the imaged gameboard playing surface, (FIG. 49):

(1) a computer monitor displayed light-first-simplex representational playing piece image in three-dimensional perspective, or light-rook image 358, at f6, (2) a computer monitor displayed dark-second-simplex representational playing piece image in three-dimensional perspective, or dark-bishop image 360, at b5, (3) a computer monitor displayed light-third-simplex representational playing piece image in three-dimensional perspective, or light-knight image 362, at d4, (4) a computer monitor displayed dark-first-duplex representational playing piece image in three-dimensional perspective, or dark-princess image 364, at c3, (5) a computer monitor displayed dark-second-duplex representational playing piece image in three-dimensional perspective, or dark-crown-prince image 366, at e2, and (6) a computer monitor displayed light-third-duplex representational playing piece image in three-dimensional perspective, or light-archbishop image 368, at a1.

All computer representational playing piece images and the gameboard playing surface images are enclosed within a computer monitor screen perimeter 318.

2) The Representational Playing Piece Images (for VI-CR):

The computer version (V1-CR) of the generic chess-type strategy game utilizes the same design of representational playing piece images as was used for the representational playing pieces of the generic first-version (V1-R) of the game, except that the playing pieces and gameboard are represented by computer monitor displayed representational playing piece images in three-dimensional perspective.

The computerized first-version (V1-CR) of the chess-type strategy game utilizes one of each of the six different types of representational playing piece images for each contrasting set of playing images:

a) a first-simplex representational playing piece image in three dimensional perspective, or rook image 358, b) a second-simplex representational playing piece image in three dimensional perspective, or bishop image 360, c) a third-simplex representational playing piece image in three dimensional perspective, or knight image 362, d) a first-duplex representational playing piece image in three dimensional perspective, or princess image 364, e) a second-duplex representational playing piece image in three dimensional perspective, or crown-prince image 366, and f) a third-duplex representational playing piece image in three dimensional perspective, or archbishop image 368.

3) The Method of Play (for V1-CR):

a) Provide the following elements:

(1) computer hardware: computer, computer hard disc, computer monitor, and computer keyboard, (2) computer software:

(a) three-dimensional perspective imaging data means for a checkered gameboard having alternately differentiated squares, and indicia as in FIG. 49, transposed onto the computer monitor screen, (b) three-dimensional imaging data means for two sets of contrasting representational playing piece images, each set having all six different type of representational playing piece images as indicated above, and as in FIG. 49,

[1] three different types of computer monitor displayed simplex representational playing piece images, comprising a first, a second, and a third simplex representational playing piece image, each type having a different simplex representational configuration indicating a different and specific potential movement and capturing pattern,

[2] three different types of computer monitor displayed duplex representational playing piece images, comprising a first, a second, and a third, duplex representational playing piece image, each type having a composite duplex configuration comprising two of three different types of simplex representational configurations, each different type of duplex configuration indicating two specific alternative potential movement and capturing patterns.

b) Encoding and programing the various simplex and duplex representational playing piece images in three-dimensional perspective and their movement and capturing patterns and operational data programs into computer software.

c) Manipulating the computer monitor displayed representational playing piece images in three-dimensional perspective upon the computer monitor displayed gameboard playing surface in three-dimensional perspective according to the following rules:

(1) starting positions (for V1-CR):

(a) the players can take alternate turns to select any computer monitor displayed functional playing piece icon and to direct it to any square on their own side of the playing screen, this procedure continues until all functional playing piece icons are positioned on the computer monitor displayed ten-by-ten square rectilinear checkered grid, and (b) alternatively, the starting positions of the various computer monitor displayed functional playing piece icons, for computer version-one, can be any mutually agreed upon means or pattern, (2) moving individual computer monitor displayed representational playing piece images in three-dimensional perspective according to the following patterns:

(a) a computer monitor displayed first-simplex representational playing piece image in three-dimensional perspective, or rook image: according to a first movement and capturing pattern identified as pattern (a), orthogonally, (b) a computer monitor displayed second-simplex representational playing piece image in three-dimensional perspective, or bishop image: according to a second movement and capturing pattern, which is different from said pattern (a), and is identified as pattern (b), diagonally, (c) a computer monitor displayed third-simplex representational playing piece image in three-dimensional perspective, or knight image: according to a third movement and capturing pattern, which is different from said pattern (a) and said pattern (b), and is identified as pattern (c), one jumping dog-leg, (d) a computer monitor displayed first-duplex representational playing piece image in three-dimensional perspective, or princess image: according to alternative movement and capturing patterns (a), and (b), (e) a computer monitor displayed second-duplex representational playing piece image, or crown-prince image: according to alternative movement and capturing patterns (a), and (c), (f) a computer monitor displayed third-duplex representational playing piece image in three-dimensional perspective, or archbishop image: according to alternative movement and capturing patterns (b), and (c), and (3) alternating turns:

(a) one player having the first move, (b) players continue taking turns of moving computer monitor displayed representational playing piece images in three-dimensional perspective and capturing opponent's computer monitor displayed representational playing piece images in three-dimensional perspective, one at a time, according to the patterns above.

(4) winning and scoring the game:

(a) The player that eliminates an opponent's computer monitor displayed representational playing piece icons from the board, and the player whose opponent resigns win the game. The winner is awarded one point, and alternatively, the winning player may be determined by the multiple point awarding system.

(b) After a first piece has been taken, if no pieces are taken for thirty turns, a truce is declared, the game is ended, and the game is drawn.

4) Significance of the Game (V1-CR):

The computer version (V1-CR) has several features which make it particularly interesting:

a) enables players to play the game together without requiring a three-dimensional gameboard and individual playing pieces, b) enables players separated by considerable distance to play the game together simultaneously, without requiring a three dimensional gameboard and playing pieces, and c) provides the opportunity for one player to compete against a computer opponent of variable degrees of competence.

d) provides the most simplified version of the chess-type strategy game, which gives beginning players the prerequisite experience for playing the more complicated chess-type strategy games of V2-CR, V3-CR, V4-CR, and V5-CR by the use of computer monitor displayed representational playing piece images in three dimensional perspective which are deployed and electronically manipulated upon a computer monitor displayed checkered grid gameboard playing surface in three-dimensional perspective.

2) Computer Versions-Two, Three, Four, and Five: using Representational Playing Piece Images: (V2-CR), (V3-CR), (V4-CR), and (V5-CR)

The description of all of these different versions are obvious from the descriptions of all of the previous material already presented.

XI) CONCLUSIONS, RAMIFICATIONS, AND SCOPE OF THE INVENTION

As can be seen, the significant elements of the present invention are essentially the following:

A) Representational and functional design concepts which permit an evolution of chess-type games into several better balanced, more dynamic, more complex, and intellectually more stimulating strategic games than conventional sixty-four square chess. The playing pieces are generated by the principal concept of the various more complex playing pieces (duplex and triplex playing pieces) being derived from different combinations of the various more simplex playing pieces. This enhances the ability to visualize and comprehend more readily the greatly increased dynamic complexity of spatial and functional inter-relationships that are involved between the various playing pieces in this game.

B) A hierarchical order of chess-type strategy games of increasing complexity both structurally and methodologically:

1) A generic sixteen and thirty-six square, twelve piece chess-type strategy game containing most of the basic principle of more reasonably balanced playing pieces which then also operate in all of the other more complex game forms. This game is without kings and pawns.

2) A more complex thirty-six and sixty-four square, eighteen piece chess-type strategy game, having pairs of simplex playing pieces, which is better balanced than the first game. A more complex and better balanced game, also without kings and pawns.

3) A one hundred square, forty piece chess-type strategy game, having a much greater balance of playing pieces then conventional chess because the over whelming power of the queen is now effectively counter-balanced by a crown-prince and an archbishop (which are all equally vulnerable to each other) creating a powerful triad which provides an entirely new dynamic dimension to the game of chess which was previously lacking. A critical improvement in pawn movement is essential to a reasonable balance of various playing pieces on the gameboard. These innovations create a greatly increased complexity which is simultaneously simplified by the design concept. The result generates a more profound and dynamically more interesting game than conventional chess.

4) A one hundred and a one hundred forty-four square, sixty piece chess-type strategy game, based on the next higher order of combinations and permutations stemming from the addition of some unique playing pieces (bowmen) and thereby creating a quartet of different simplex playing pieces (rooks, bishops, knights, and bowmen) having single-function options, which are incorporated structurally and functionally into two higher orders of playing piece complexity: a sextet of duplex playing pieces (princess, duke, marquess, earl, viscount, and baron) having double-function options, and a quartet of triplex playing pieces (queen-II, crown-prince-II, counsellor, and archbishop-II) having triple-function options; and a new singular playing piece (court-jester) which makes castling obsolete. This developmental progression raises the complexity of the game exponentially. These simplified representational and functional designs are essential to facilitate comprehension of the enormous number of inter-relationships of the diverse and very complex playing pieces of this game.

5) A one hundred forty-four square, seventy-two piece chess-type strategy game having all of the pieces of the previous game, with each set having two additional bowmen, two additional knights, and two additional pawns; thereby providing the most complex of all the various chess-type strategy games.

C) Different specific methods of game play which are appropriate for each different type of chess-type strategy game game.

D) The restoration of a more rational perspective to the game, since pawns (foot-soldiers) can no longer be promoted to queens and having more than one queen on either side is now impossible. Although promotion to queen is not permitted (as a gender change is unreasonable), the queen (or any piece except pawns) can still be "liberated" from captivity by pawns and knights. Crown-princes can ascended to the throne if the king is annihilated, and pawns can sometimes be "knighted" for liberating pieces from captivity. Pawns, knights, bowmen, and composite pieces using knight and bowmen components "annihilate" the pieces they "take" on the board. Kings, court-jesters, rooks, bishops, and any composite pieces using rook and bishop components "captivate" the pieces they "take" on the board. Knights can "liberate" captive pieces by reaching either corner square on the last rank, but pawns can "liberate" captive pieces by reaching any square on the last rank. However, the knight components of various composite duplex playing pieces cannot liberate captivated pieces.

E) Enhanced pawn strength is achieved by permitting a one or two square move forward, not just from the initial pawn rank but from any rank, thereby enabling the possibility of reaching the last rank in just four moves, (whereas, pawns require at least five moves to reach the last rank in conventional sixty-four square chess). This increased pawn potential is counterbalanced to a degree by employing the "en passant" rule for every double move of pawns at any rank on the board. Increased pawn strength is essential to enable the game to work sensibly on one hundred square and one hundred forty-four square symmetrical gameboards.

F) Although various sections of the gameboard and the different sets of playing pieces have been primarily described and shown as being differentiated by specific visual color differences, they are exemplary only and obviously can be changed according to preference. The board and pieces can also be distinguished by tactile or any other humanly sensible means.

G) Although the invention has been shown and described in terms of a flat tangible gameboard and tangible playing pieces, it can also be implemented in an electronic version by representation of the board and pieces on a computer monitor. Thus the drawings of the gameboard and pieces can represent images on a computer monitor as well as tangible hardware. Those skilled in the art of programming chess games will readily be able to implement the computer version, given the board layout, the pieces and their permitted moves and powers. Furthermore, although the games of this invention have been described generally as competition for two persons, the same games also can be played by one person competing against a computer opponent.

H) An alternative scoring system which rewards early victory with minimal loss of playing pieces, captivating versus annihilating an opponent's king as well as other playing pieces, and the stalemated player.

I) Although illustrative embodiments of the present invention have been described with reference to the accompanying drawings, it is to be understood that the invention is not limited to those precise embodiments, and that various other changes and modifications may be effected therein by one skilled in the art without departing from the scope or spirit of the invention.

Thus the scope of the invention should be determined by the appended claims and their legal equivalents, rather than by the examples given.

XII) INDEX OF REFERENCE NUMBERS

02 multiple-concentric-perimeter checkered gameboard playing surface

04 light squares, or non-colored squares, or non-shaded squares

06 dark squares, or colored squares, or shaded squares

08 square first-perimeter

10 square second-perimeter

12 square third-perimeter

14 square fourth-perimeter

16 square fifth-perimeter

28 square sixth-perimeter

20 left-margin with numerical indicia from "1" to "12"

22 right-margin with numerical indicia from "1" to "12"

24 lower-margin with alphabetical indicia from "a" to "l"

26 upper-margin with alphabetical indicia from "a" to "l"

28 first-simplex representational playing piece, or rook (for V1-R, V2-R, V3-R, V4-R, and V5-R)

30 first-simplex representational configuration, or first-single-tier structure, or rook configuration

32 parapet section

34 column sections

36 foundation section

38 pedestal section

40 second-simplex representational playing piece, or bishop (for V1-R, V2-R, V3-R, V4-R, and V5-R)

42 second-simplex representational configuration, or second-single-tier structure, or bishop configuration

44 headdress section

46 bishop-torso section

48 third-simplex representational playing piece, or knight (for V1-R, V2-R, V3-R, V4-R, and V5-R)

50 third-simplex representational configuration, or third-single-tier structure, or knight configuration

52 horse-head section

54 horse-body section

56 front-legs section

58 hind-legs section

60 first-duplex representational playing piece, or princess (for V1-R, V2-R, V4-R, and V5-R)

62 first-duplex representational configuration, or first-double-tier structure, or princess configuration

64 second-duplex representational playing piece, or crown-prince (for V1-R, V2-R, and V3-R), or duke (for V4-R, and V5-R)

66 second-duplex representational configuration, or second-double-tier structure, or crown-prince configuration, or duke configuration

68 third-duplex representational playing piece, or archbishop (for V1-R, V2-R, and V3-R), or earl (for V4-R, and V5-R)

70 third-triplex representational configuration, or third-double-tier structure, or archbishop configuration, or earl configuration

72 first-alternative multiple-concentric-perimeter checkered gameboard playing surface

74 first-color squares

76 second-color squares

78 third-color squares

80 fourth-color squares

82 fifth-color squares

84 sixth-color squares

86 first-alternative gameboard margin-perimeter

88 objective representational playing piece, or king (for V3-R)

90 objective representational configuration, or objective-structure, or king configuration

92 king-head section

94 king-neck section

96 king-torso sections

96' king-II-torso sections

98 crown section

100 crown-brim section

102 substitute-first duplex representational playing piece, or queen (for V3-R)

104 substitute-first-duplex representational configuration, or substitute-first-double-tier structure, or queen configuration

106 queen-tiara section

108 minimal representational playing piece, or pawn (for V3-R, V4-R, and V5-R)

110 minimal representational configuration, or minimal-structure, or pawn configuration

112 second-alternative multiple-concentric-perimeter checkered gameboard playing surface

114 first-shade square

116 second-shade square

118 third-shade square

120 fourth-shade square

122 fifth-shade square

124 sixth-shade square

126 second-alternative gameboard margin-perimeter

128 fourth-simplex representational playing piece, or bowman (for V4-R, and V5-R)

130 fourth-simplex representational configuration, or fourth-single-tier structure, or bowman configuration

132 crossbow section

134 stock and arrow section

136 bowman-torso section

138 fourth-duplex representational playing piece, or marquess (for V4-R, and V5-R)

140 fourth-duplex representational configuration, or fourth-double-tier structure, or marquess configuration

142 fifth-duplex representational playing piece, or viscount (for V4-R, and V5-R)

144 fifth-duplex representational configuration, or fifth-double-tier structure, or viscount configuration

146 sixth-duplex representational playing piece, or baron (for V4-R, and V5-R)

148 sixth-duplex representational configuration, or sixth-double-tier structure, or baron configuration

150 first-triplex representational playing piece, or queen-II (for V4-R, and V5-R)

152 first-triplex representational configuration, or first-triple-tier structure, or queen-II configuration

154 queen-II-tiara section

156 second-triplex representational playing piece, or crown-prince-II (for V4-R, and V5-R)

158 second-triplex representational configuration, or second-triple-tier structure, or crown-prince-II configuration

160 third-triplex representational playing piece, or counsellor (for V4-R, and V5-R)

162 third-triplex representational configuration, or third-triple-tier structure, or counsellor configuration

164 fourth-triplex representational playing piece, or archbishop-II (for V4-R, and V5-R)

166 fourth-triplex representational configuration, or fourth-triple-tier structure, or archbishop-II configuration

168 substitute-objective representational playing piece, or king-II (for V4-R, and V5-R)

170 substitute-objective representational configuration, or substitute-objective-structure, or king-II configuration

172 singular representational playing piece, or court-jester (for V4-R, and V5-R)

174 singular representational configuration, or singular-structure, or court-jester configuration

176 court-jester-head section

178 court-jester-neck section

180 court-jester-torso section

182 first-simplex functional playing piece, or alternative rook (for V1-F, V2-F, V3-F, V4-F, and V5-F)

184 first-single-function symbol, or straight-cross symbol, or "+"

184' computer monitor displayed first-simplex functional playing piece icon, or rook icon, or "[+]" (for V1-CF, V2-CF, V3-CF, V4-CF, and V5-CF)

186 first-uniform-single-tier structure, or first-cubic form, or simplex cubic form

188 cylindrical base

**188*a*** a uniform cylindrical-block

190 second-simplex functional playing piece, or alternative bishop (for V1-F, V2-F, V3-F, V4-F, and V5-F)

192 second-single-function symbol, or diagonal-cross symbol or "x"

192' computer monitor displayed second-simplex functional playing piece icon, or bishop icon, or "[x]" (for V1-CF, V2-CF, V3-CF, V4-CF, and V5-CF)

194 third-simplex functional playing piece, or alternative knight (for V1-F, V2-F, V3-F, V4-F, and V5-F)

196 third-single-function symbol, or small-circle symbol, or "o"

196' computer monitor displayed third-simplex functional playing piece icon, or knight icon, or "[o]" (for V1-CF, V2-CF, V3-CF, V4-CF, and V5-CF)

198 first-duplex functional playing piece, or alternative princess (for V1-F, V2-F, V4-F, and V5-F)

200 second-uniform-single-tier structure, or second-cubic form

202 uniform double-tier structure, or duplex cubic form

204 first-double-function symbol, or superimposed straight-cross/diagonal-cross symbol or "+/x"

204' computer monitor displayed first-duplex functional playing piece icon, or princess icon, or "[+]/[x]" (for V1-CF, V2-CF, V4-CF, and V5-CF) or queen icon, or "[+]/[x]" (for V3-CF)

206 second-duplex functional playing piece, or alternative crown-prince (for V1-F, V2-F, and V3-F), or alternative duke (for V4-F, and V5-F)

208 second-double-function symbol, or superimposed straight-cross/small-circle symbol or "+/o"

208' computer monitor displayed second-duplex functional playing piece icon, or crown-prince icon, or "[+]/[o]" (for V1-CF, V2-CF, and V3-CF), or duke icon, or "[+]/[o]", (for V4-CF, and V5-CF)

210 alternative third-duplex playing piece, or alternative archbishop (for V1-F, V2-F, and V3-F), or alternative earl (for V4-F, and V5-F)

212 third-double-function symbol, or superimposed diagonal-cross/small-circle symbol or "x/o"

212' computer monitor displayed third-duplex functional playing piece icon, or archbishop icon, or "[x]/[o]" (for V1-CF, V2-CF, and V3-CF), or earl icon, or "[x]/[o]" (for V4-CF, and V5-CF)

214 objective functional playing piece, or alternative king (for V3-F)

216 alternative crown section

218 alternative king-torso sections

220 small-straight-cross symbol, or "(small)+"

222 small-diagonal-cross symbol, or "(small) x"

224 objective-function symbol, or superimposed small-straight-cross/small-diagonal-cross symbol, or "(small)+/(small)x"

224' computer monitor displayed objective functional playing piece icon, or king icon, or "(small)[+]/(small)[x]" (for V3-CF, V4-CF, V5-CF)

226 substitute-first-duplex functional playing piece, or alternative queen (for V3-F)

228 alternative queen-tiara

**228*a*** a alternative queen-II-tiara

230 minimal functional playing piece, or alternative pawn (for V3-F, V4-F, and V5-F)

232 left-diagonal symbol, or "\"

234 double-straight symbol, or "||"

236 right-diagonal symbol, or "/"

238 minimal-function symbol, or left-diagonal/double-straight/right-diagonal symbol, or "\||/"

238' computer monitor displayed minimal functional playing piece icon, or pawn icon, or "[\||/]" (for V3-CF, V4-CF, and V5-CF)

240 alternative pawn body

**240*a*** a uniform orthogonal-block

**240*b*** inscribed uniform square frame of reference

242 fourth-simplex functional playing piece, or alternative bowman (for V4-F, and V5-F)

244 fourth-simplex functional symbol, or large-circle symbol, or "0"

244 ' computer monitor displayed fourth-simplex functional playing piece icon, or bowman icon, or "[0]" (for V4-CF, and V5-CF)

246 fourth-duplex functional playing piece, or alternative marquess (for V4-F, and V5-F)

248 fourth-double-function symbol, or superimposed straight-cross/large-circle symbol, or "+/0"

248' computer monitor displayed fourth-duplex functional playing piece icon, or marquess icon, or "[+]/[0]" (for V4-CF, and V5-CF)

250 fifth-duplex functional playing piece, or alternative viscount (for V4-F, and V5-F)

252 fifth-double-function symbol, or superimposed diagonal-cross/large-circle symbol, or "x"/"0"

252' computer monitor displayed fifth-duplex functional playing piece icon, or viscount icon, or "[x]/[0]" (for V4-CF, and V5-CF)

254 sixth-duplex functional playing piece, or alternative baron (for V4-F, and V5-F)

256 sixth-double-function symbol, or superimposed small-circle/large-circle symbol, or "o/0"

256' computer monitor displayed third-duplex functional playing piece icon, or baron icon, or "[o]/[0]" (for V4-CF, and V5-CF)

258 first-triplex functional playing piece, or alternative queen-II (for V4-F, and V5-F)

260 third-uniform-single-tier structure, or third-cubic form

262 uniform triple-tier structure, or triplex cubic form

264 first-triple-function symbol, or superimposed straight-cross/diagonal-cross/small-circle symbol, or "+/x/o"

264' computer monitor displayed first-triplex functional playing piece icon, or queen-II icon, or "[+]/[x]/[o]" (for V4-CF, and V5-CF)

266 second-triplex functional playing piece, or alternative crown-prince-II (for V4-F, and V5-F)

268 second-triple-function symbol, or superimposed straight-cross/small-circle/large-circle symbol, or "+/o/0"

268' computer monitor displayed second-triplex functional playing piece icon, or crown-prince-II icon, or "[+]/[o]/[0]" (for V4-CF, and V5-CF)

270 third-triplex functional playing piece, or alternative counsellor playing piece (for V4-F, and V5-F)

272 third-triple-function symbol, or straight-cross/diagonal-cross/large-circle symbol, or "+/x/0"

272' computer monitor displayed third-triplex functional playing piece icon, or counsellor icon, or "[+]/[x]/[0]" (for V4-CF, and V5-CF)

274 fourth-triplex functional playing piece, or alternative archbishop-II (for V4-F, and V5-F)

276 fourth-triple-function symbol, or superimposed diagonal-cross/small-circle/large-circle symbol, or "x/o/0"

276' computer monitor displayed composite fourth-triplex functional playing piece icon, or archbishop-II icon, or "[x]/[o]/[0]" (for V4-CF, and V5-CF)

278 substitute-objective functional playing piece, or alternative king-II (for V4-F, and V5-F)

280 alternative king-II-torso

282 singular functional playing piece, or alternative court-jester playing piece (for V4-F, and V5-F)

284 eight-radial-dots symbol, or "(2x) ::"

286 singular-function symbol, or superimposed small-straight-cross/small-diagonal-cross/eight-radial-dots symbol, or "(small)+/(small)x/(2x) ::"

286' computer monitor displayed composite singular functional playing piece icon, or court-jester icon, or "(small)[x]+/(small)[x]/(2x)[::]" (for V4-CF, and V5-CF)

288 alternative court-jester-torso

290 hypothetical-universal first-variation alternative functional playing piece (for Vx-F1)

**290*a*** hypothetical-universal second-variation alternative functional playing piece (for Vx-F2)

**290*b*** hypothetical-universal third-variation alternative functional playing piece (for Vx-F3)

**290*c*** hypothetical-universal fourth-variation alternative functional playing piece (for Vx-F4)

**290*c'*** simplex single-tier fourth-variation alternative functional playing piece (for Vx-F4)

**290*c''*** duplex double-tier fourth-variation alternative functional playing piece (for Vx-F4)

**290*c'''*** triplex triple-tier fourth-variation alternative functional playing piece (for Vx-F4)

**290*d*** hypothetical-universal fifth-variation alternative functional playing piece (for Vx-F5)

**290*d'*** simplex single-tier fifth-variation alternative functional playing piece (for Vx-F5)

**290*d''*** duplex double-tier fifth-variation alternative functional playing piece (for Vx-F5)

290''' triplex triple-tier fifth-variation alternative functional playing piece (for Vx-F5)

292 hypothetical-universal functional symbol, or superimposed straight-cross/diagonal-cross/small-circle/large-circle symbol, or "+/x/o/0"

294 recessed grooves

296 beveled edges

**298*a*** computer monitor displayed one hundred forty-four square gameboard playing surface for computer functional version-five (V5-CF)

**298*b*** computer monitor displayed one hundred forty-four square gameboard playing surface for computer functional version-four-"a" (V4a-CF)

300 computer monitor displayed twelve-by-twelve square rectilinear checkered grid

302 square-perimeter surrounding one hundred forty-four squares

304 light-squares of twelve-by-twelve square rectilinear checkered grid

306 dark-squares of twelve-by-twelve square rectilinear checkered grid

308 margin of twelve-by-twelve square rectilinear checkered grid

310 left-margin with numbered indicia from "1" through "12"

312 right-margin with numbered indicia from "1" through "12"

314 lower-margin with alphabetical indicia from letter "a" through letter "l"

316 upper-margin with alphabetical indicia from letter "a" through letter "l"

318 computer monitor screen perimeter

**320*a*** computer monitor displayed one hundred square gameboard playing surface for computer functional version-four-"b" (V4b-CF)

**320*b*** computer monitor displayed one hundred square gameboard playing surface for computer functional version-three (V3-CF)

322 computer monitor displayed ten-by-ten square rectilinear checkered grid

324 square-perimeter surrounding one hundred squares

326 light-squares of ten-by-ten square rectilinear checkered grid

328 dark-squares of ten-by-ten square rectilinear checkered grid

330 margin of ten-by-ten square rectilinear checkered grid

332 left-margin with numerical indicia from "1" to "10"

334 right-margin with numerical indicia from "1" to "10"

336 lower-margin with alphabetical indicia from "a" to "j"

338 upper-margin with alphabetical indicia from "a" to "j"

340 computer monitor displayed thirty-six square gameboard playing surface in three-dimensional perspective for computer representational versions one and two

342 computer monitor displayed six-by-six square checkered grid in three-dimensional perspective

344 light-squares in three-dimensional perspective

346 dark-squares in three-dimensional perspective

348 left-margin with numerical indicia from "1" to "6" in three-dimensional perspective

350 right-margin with numerical indicia from "1" to "6" in three-dimensional perspective

352 lower-margin with alphabetical indicia from "a" to "f" in three-dimensional perspective

354 upper-margin with alphabetical indicia from "a" to "f" in three-dimensional perspective

356 margin outer-perimeter in three-dimensional perspective

358 computer monitor displayed light-first-simplex representational playing piece image in three-dimensional perspective, or light-rook image

360 computer monitor displayed dark-second-simplex representational playing piece image in three-dimensional perspective, or dark-bishop image

362 computer monitor displayed light-third-simplex representational playing piece image in three-dimensional perspective, or light-knight image

364 computer monitor displayed dark-first-duplex representational playing piece image in three-dimensional perspective, or dark-princess image

366 computer monitor displayed dark-second-duplex representational playing piece image in three-dimensional perspective, or dark-crown-prince image

368 computer monitor displayed light-third-duplex representational playing piece image in three-dimensional perspective, or light-archbishop image

What is claimed is:

1. A chess-type strategy game, which comprises:

A) a gameboard having a playing surface comprising at least three different square concentric playing surfaces of at least four, sixteen, and thirty-six alternate contrasting squares in a checkerboard fashion, said different square concentric playing surfaces delineated by different square concentric perimeter lines, providing a multiple square concentric perimeter checkered gameboard playing surface comprising:

1) four central alternately contrasting squares providing a playing surface of four squares having a square first perimeter, 2) said four central alternately contrasting squares surrounded by an additional twelve alternately contrasting squares to provide a playing surface of sixteen squares having a square second perimeter, 3) said playing surface of sixteen squares surrounded by an additional twenty alternately contrasting squares to provide a playing surface of thirty-six squares having a square third perimeter, 4) thereby providing different size playing surfaces delineated by multiple square concentric perimeters distinguishable by different humanly sensible indicia, and B) at least two contrasting sets of playing pieces, each set of playing pieces being differentiated from the other set by a different humanly sensible indicia, and each set of playing pieces comprising:

1) at least three different types of simplex playing pieces, each different type of said simplex playing pieces comprising one of at least three different types of simplex symmetrical geometric configurations; whereby each different type of said simplex symmetrical geometric configurations represents one different specific potential movement and capturing pattern for each different type of said simplex playing piece upon said playing surface of said gameboard, and 2) at least three different types of duplex playing pieces, each different type of said duplex playing pieces comprising one of at least three different types of duplex symmetrical geometric configurations, each different type of said duplex symmetrical geometric configurations comprising two of at least three different types of said simplex symmetrical geometric configurations superimposed concentrically upon each other; whereby each different type of said duplex symmetrical geometric configurations represents two different alternative specific potential movement and capturing patterns for each different type of said duplex playing pieces upon said playing surface of said gameboard.

2. The chess-type strategy game of claim 1 wherein said square third perimeter is surrounded by a margin comprising specific indicia, a left-margin and a right-margin comprising the same sequential numerical indicia identifying said horizontal rows of contiguous squares or ranks, and a lower-margin and an upper-margin comprising the same sequential alphabetical indicia identifying said vertical rows of contiguous squares or files, such that any square on said playing surface of said gameboard can be located and designated simply by a letter and a number of said sequential alphabetical indicia and said sequential numerical indicia, respectively.

3. The chess-type strategy game of claim 1 wherein said playing surface of said gameboard has a plurality additional alternately contrasting squares to provide a plurality of additional multiple concentric square perimeters, and a plurality of additional sequential numerical indicia and alphabetical marginal indicia, comprising:

A) said square third perimeter surrounded by an additional twenty-eight alternately contrasting squares to provide a playing surface of sixty-four squares having a square fourth perimeter, B) said square fourth perimeter surrounded by an additional thirty-six alternately contrasting squares to provide a playing surface of one hundred squares having a square fifth perimeter, C) said square fifth perimeter surrounded by an additional forty-four alternately contrasting squares to provide a playing surface of one hundred forty-four squares having a square sixth perimeter, D) said square sixth perimeter surrounded by a margin comprising additional sequential numerical indicia or a left-margin and a right-margin comprising sequential numbers from "1" to "12" identifying ranks, and additional sequential alphabetical indicia or a lower-margin and an upper-margin comprising sequential lower case letters from "a" to "l" identifying files, such that any square on the gameboard can be located and designated by a letter and a number, and E) said multiple square concentric perimeters define the limits of each different board size, each square concentric perimeter being differentiated by any said different humanly sensible indicia such as texture, shade, and color which distinguish both:

1) different square perimeter lines, and 2) different sets of said alternately contrasting squares adjacent to said different square perimeter lines.

4. The chess-type strategy game of claim 1 wherein:

A) said different types of said simplex playing pieces comprise different types of simplex representational playing pieces, and different types of said simplex symmetrical geometric configurations comprise different types of simplex representational configurations or single-tier structures, and B) said different types of said duplex playing pieces comprise different types of duplex representational playing pieces, and different types of said duplex symmetrical geometric configurations comprise different types of duplex representational configurations or single-tier structures stacked vertically and permanently upon each other.

5. The chess-type strategy game of claim 4 wherein:

A) said different types of said simplex representational playing pieces comprise different types of simplex representational configurations or single-tier structures, 1) a first-simplex representational playing piece comprising a first-simplex representational configuration or a first-single-tier structure, 2) a second-simplex representational playing piece comprising a second-simplex representational configuration or a second-single-tier structure, and 3) a third-simplex representational playing piece comprising a third-simplex representational configuration or a third-single-tier structure, and B) said different types of said duplex representational playing pieces comprise different types of duplex representational configurations or double-tier structures, with said duplex representational configurations having a larger size than said simplex representational configurations, 1) a first-duplex representational playing piece comprising a first-duplex representational configuration or a first-double-tier structure comprising an upper-tier stacked vertically and permanently upon a lower-tier, with the two stacked tiers comprising:

a) said first-simplex representational configuration or said first-single-tier structure, and b) said second-simplex representational configuration or said second-single-tier structure, 2) a second-duplex representational playing piece comprising a second-duplex representational configuration or a second-double-tier structure comprising an upper-tier stacked vertically and permanently upon a lower-tier, with the two stacked tiers comprising:

a) said first-simplex representational configuration or said first-single-tier structure, and b) said third-simplex representational configuration or said third-single-tier structure, 3) a third-duplex representational playing piece comprising a third-duplex representational configuration or a third-double-tier structure comprising an upper-tier stacked vertically and permanently upon a lower-tier, with the two stacked tiers comprising:

a) said second-simplex representational configuration or said second-single-tier structure, and b) said third-simplex representational configuration or said third-single-tier structure.

6. The chess-type strategy game of claim 5, and further including, a plurality of said different types of said simplex representational playing pieces, for each of said contrasting sets of playing pieces:

A) a plurality of said first-simplex representational playing pieces, each comprising said first-simplex representational configuration or said first-single-tier structure, B) a plurality of said second-simplex representational playing pieces, each comprising said second-simplex representational configuration or said second-single-tier structure, and C) a plurality of said third-simplex representational playing pieces, each comprising said third-simplex representational configuration or said third-single-tier structure.

7. The chess-type strategy game of claim 6, and further including, three additional different types of representational playing pieces, for each of said contrasting sets of playing pieces:

A) a plurality of a minimal representational playing piece comprising a minimal representational configuration or a minimal-structure, each said minimal representational configuration having a smaller size than each of said simplex representational configurations, B) an objective representational playing piece comprising an objective representational configuration or objective-structure having a crown section and a larger size than said duplex representational configurations, and C) a substitute-first duplex representational playing piece comprising a substitute-first duplex representational configuration or a substitute-first-double-tier structure having a larger size than said double-tier structures, a smaller size than said objective-structure, and comprising a tiara section stacked vertically and permanently upon said first-duplex representational configuration or said first-double-tier structure, said first-duplex representational configuration or said first-double-tier structure comprising an upper-tier stacked vertically and permanently upon a lower-tier, with the two stacked tiers comprising:

1) said first-simplex representational configuration or said first-single-tier structure, and 2) said second-simplex representational configuration or said second-single-tier structure.

8. The chess-type strategy game of claim 6, and further including, ten additional different types of representational playing pieces comprising different types of representational configurations, for each of said contrasting sets of playing pieces:

A) a plurality of a fourth-simplex representational playing piece comprising a fourth-simplex representational configuration or fourth-single-tier structure, B) at least three additional different types of said duplex representational playing pieces, each additional different type of said duplex representational playing pieces comprising one of at least three additional different types of said duplex representational configurations or said double-tier structures, each additional different type of said duplex representational configurations comprising two of at least four different types of said simplex representational configurations or said single-tier structures stacked vertically and permanently upon each other:

1) a fourth-duplex representational playing piece comprising a fourth-duplex representational configuration or a fourth-double-tier structure comprising an upper-tier stacked vertically and permanently upon a lower-tier, with the two stacked tiers comprising:
   a) said first-simplex representational configuration or said first-single-tier structure, and
   b) said fourth-simplex representational configuration or said fourth-single-tier structure,
2) a fifth-duplex representational playing piece comprising a fifth-duplex representational configuration or a fifth-double-tier structure comprising an upper-tier stacked vertically and permanently upon a lower-tier, with the two stacked tiers comprising:
   a) said second-simplex representational configuration or said second-single-tier structure, and
   b) said fourth-simplex representational configuration or said fourth-single-tier structure,
3) a sixth-duplex representational playing piece comprising a sixth-duplex representational configuration or sixth-double-tier structure comprising an upper-tier stacked vertically and permanently upon a lower-tier, with the two stacked tiers comprising:
   a) said third-simplex representational configuration or said third-single-tier structure, and
   b) said fourth-simplex representational configuration or said fourth-single-tier structure, C) at least four different types of triplex representational playing pieces, each comprising one of at least four different types of triplex representational configurations or triple-tier structures, each different type of said triplex representational configurations or said triple-tier structures comprising three of at least four different types of said simplex representational configurations or said single-tier structures stacked vertically and permanently upon each other:

1) a first-triplex representational playing piece comprising a first-triplex representational configuration or a first-triple-tier structure comprising a tiara section stacked vertically and permanently upon an upper-tier, said upper-tier stacked vertically and permanently upon a middle-tier, said middle-tier stacked vertically and permanently upon a lower-tier, with the three stacked tiers comprising:
   a) said first-simplex representational configuration or said first-single-tier structure,
   b) said second-simplex representational configuration or said second-single-tier structure, and
   c) said third-simplex representational configuration or said third-single-tier structure,
2) a second-triplex representational playing piece comprising a second-triplex representational configuration or a second-triple-tier structure comprising an upper-tier stacked vertically and permanently upon a middle-tier, said middle-tier stacked vertically and permanently upon a lower-tier, with the three stacked tiers comprising:
   a) said first-simplex representational configuration or said first-single-tier structure,
   b) said third-simplex representational configuration or said third-single-tier structure, and
   c) said fourth-third-simplex representational configuration or said fourth-single-tier-structure,
3) a third-triplex representational playing piece comprising a third-triplex representational configuration or a third-triple-tier structure comprising an upper-tier stacked vertically and permanently upon a middle-tier, said middle-tier stacked vertically and permanently upon a lower-tier, with the three stacked tiers comprising:
   a) said first-simplex representational configuration or said first-single-tier structure,
   b) said second-simplex representational configuration or said second-single-tier structure, and
   c) said fourth-simplex representational configuration or said fourth-single-tier structure, and
4) a fourth-triplex representational playing piece comprising a fourth-triplex representational configuration or a fourth-single-tier structure comprising an upper-tier stacked vertically and permanently upon a middle-tier, said middle-tier stacked vertically and permanently upon a lower-tier, with the three stacked tiers comprising:
   a) said second-simplex representational configuration or said second-single-tier structure,
   b) said third-simplex representational configuration or said third-single-tier structure, and
   c) said fourth-simplex representational configuration or said fourth-single-tier structure, D) a substitute-objective representational playing piece comprising a substitute-objective representational configuration or a substitute-objective structure comprising said crown and a larger structural size than said triplex representational configurations, and E) a singular representational playing piece comprising a singular representational configuration or a singular structure having a larger size than said duplex representational configurations and a smaller size than said triplex representational configurations.

9. The chess-type strategy game of claim 1 wherein:

A) said different types of said simplex playing pieces comprise different types of simplex functional playing pieces, and said different types of said simplex symmetrical geometric configurations comprise different types of simplex functional configurations or single-function symbols centered within a uniform square frame of reference upon at least one surface of uniform-single-tier structures, and B) said different types of said duplex playing pieces comprise different types of duplex functional playing pieces, and said different types of said duplex symmetrical geometric configurations comprise different types of duplex functional configurations or double-function symbols centered within a uniform square frame of reference upon at least one surface of said uniform-single-tier structures, said double-function symbols comprise two of at least three said different types of said single-function symbols superimposed concentrically and permanently upon each other within a common said uniform square frame of reference.

10. The chess-type strategy game of claim 9 wherein:

A) each of said uniform-single-tier structures comprises a uniform-cylindrical block, and B) each said uniform square frame of reference comprises an inscribed uniform square frame of reference upon the upper circular surface of each said uniform-cylindrical block.

11. The chess-type strategy game of claim 9 wherein:

A) each of said uniform-single-tier structures comprises a uniform-orthogonal block, and B) each said uniform square frame of reference comprises a uniform square upper surface of each said uniform-orthogonal block.

12. The chess-type strategy game of claim 9 wherein:

A) said different types of said simplex-functional configurations comprise three-dimensional inscriptions of one of at least three different types of said single-function symbols centered within said uniform square frame of reference upon at least the upper horizontal surface of said uniform-single-tier structures, and B) said different types of said duplex-functional configurations comprise three-dimensional inscriptions of one of at least three different types of said double-function symbols, each of said double-function symbols comprise one of at least three said different types of said single-function symbols centered within a common said uniform square frame of reference upon at least the upper horizontal surface of said uniform-single-tier structures.

13. The chess-type strategy game of claim 1 wherein:

A) said different types of said simplex playing pieces comprise different types of simplex functional playing pieces, and said different types of said simplex symmetrical geometric configurations comprise different types of simplex functional configurations or single-function symbols centered within a uniform square frame of reference upon at least one surface of uniform-single-tier structures, and B) said different types of said duplex playing pieces comprise different types of duplex functional playing pieces, and said different types of said duplex symmetrical geometric configurations comprise different types of duplex functional configurations or double-function symbols centered within a uniform square frame of reference upon at least one surface of uniform-double-tier structures, said double-function symbols comprise two of at least three said different types of said single-function symbols superimposed concentrically and permanently upon each other within a common said uniform square frame of reference, and said uniform-double-tier structures comprise two said uniform-single-tier structures stacked vertically and permanently upon each other.

14. The chess-type strategy game of claim 13 wherein:

A) each of said uniform-single-tier structures comprises a uniform-cylindrical block, B) each of said uniform-double-tier structures comprises one said uniform-cylindrical block stacked vertically and permanently upon another said uniform-cylindrical block, and C) each said uniform square frame of reference comprises an inscribed uniform square frame of reference upon the upper circular surface of each said uniform-cylindrical block.

15. The chess-type strategy game of claim 13 wherein:

A) each of said uniform-single-tier structures comprises a uniform-orthogonal block, B) each of said uniform-double-tier structures comprises one said uniform-orthogonal block stacked vertically and permanently upon another said uniform-orthogonal block, and C) each said uniform square frame of reference comprises a uniform square upper surface of each said uniform-orthogonal block.

16. The chess-type strategy game of claim 13 wherein:

A) each of said uniform-single-tier structures comprise a simplex cubic form or a first-cubic form, B) each of said uniform-double-tier structures comprise a duplex cubic form or a second-cubic form stacked vertically and permanently upon said first-cubic form, and C) each said uniform square frame of reference comprises a uniform square upper surface of each said simplex cubic form, and a uniform square upper surface of each said duplex cubic form.

17. The chess-type strategy game of claim 13 wherein:

A) said different types of said simplex-functional playing pieces comprise different types of simplex functional configurations:

1) a first-simplex-functional playing piece comprising a first-simplex-functional configuration having a first-single-function symbol or a straight-cross symbol or a "+" centered within a uniform square frame of reference upon at least the upper horizontal surface of a first-uniform-single-tier structure, 2) a second-simplex-functional playing piece comprising a second-simplex-functional configuration having a second-single-function symbol or a diagonal-cross symbol or an "x" centered within a uniform square frame of reference upon at least the upper horizontal surface of a second-uniform-single-tier structure, and 3) a third-simplex-functional playing piece comprising a third-simplex-functional configuration having a third-single-function symbol or a small-circle symbol or an "o" centered within a uniform square frame of reference upon at least the upper horizontal surface of a third-uniform-single-tier structure, and B) said different types of said duplex-functional playing pieces comprise different types of duplex functional configurations:

1) a first-duplex-functional playing piece comprising a first-duplex-functional configuration comprising a first-double-function symbol or a superimposed straight-cross/diagonal-cross symbol or a "+/x" centered within a common uniform square frame of reference upon at least the upper horizontal surface of a first-uniform-double-tier structure, 2) a second-duplex-functional playing piece comprising a second-duplex-functional configuration comprising a second-double-function symbol or a superimposed straight-cross/small-circle symbol or a "+/o" centered within a common uniform square frame of reference upon at least the upper horizontal surface of a second-uniform-double-tier structure, and 3) a third-duplex-functional playing piece comprising a third-duplex-functional configuration comprising a third-double-function symbol or a superimposed diagonal-cross/small-circle symbol or an "x/o" centered within a common uniform square frame of reference upon at least the upper horizontal surface of a third-uniform-double-tier structure.

18. The chess-type strategy game of claim 17 and further including:

A) a plurality of said first-simplex functional playing piece comprising said first-simplex functional configuration, B) a plurality of said second-simplex functional playing piece comprising said second-simplex functional configuration, and C) a plurality of said third-simplex functional playing piece comprising said third-simplex functional configuration.

19. The chess-type strategy game of claim 18, and further including:

A) an objective functional playing piece comprising an objective-functional configuration comprising an objective-function symbol comprising a small-straight-cross symbol or a "(small)+" superimposed upon a small-diagonal-cross symbol or a "(small)x" centered within a common uniform square frame of reference upon at least the upper horizontal surface of about a half-size uniform-single-tier structure stacked permanently upon a uniform-double-tier size structure, B) a substitute-first-duplex-functional playing piece comprising a substitute-first-duplex-functional configuration comprising a first-double-function symbol or a superimposed straight-cross/diagonal-cross symbol or a "+/x" centered within a common uniform square frame of reference upon at least the upper horizontal surface of about a one-quarter-size uniform-single-tier structure mounted horizontally and permanently in vertical alignment upon another said uniform-double-tier structure, and C) a plurality of a minimal-functional playing piece comprising a minimal-functional configuration comprising a minimal-function symbol or a left-diagonal/double-straight/right-diagonal symbol or a "\||/" centered within a common uniform square frame of reference upon at least the upper horizontal surface of about a half-size uniform-single-tier structure.

20. The chess-type strategy game of claim 19, and further including:

A) a plurality of a fourth-simplex functional playing piece comprising a fourth-simplex functional configuration comprising a fourth-simplex functional symbol or a large-circle symbol or an "0" centered within a uniform square frame of reference upon at least the upper horizontal surface of a fourth- uniform-single-tier structure, B) three additional different types of said duplex-functional playing pieces:

1) a fourth-duplex functional playing piece comprising a fourth-duplex functional configuration comprising a fourth-double-function symbol or a superimposed straight-cross/large-circle symbol or a "+/0" centered within a common uniform square frame of reference upon at least the upper horizontal surface of a fourth-uniform-double-tier structure, 2) a fifth-duplex functional playing piece comprising a fifth-duplex functional configuration comprising a fifth-double-function symbol or a superimposed diagonal-cross/large-circle symbol or an "x/0" centered within a common uniform square frame of reference upon at least the upper horizontal surface of a fifth-uniform-double-tier structure, 3) a sixth-duplex functional playing piece comprising a sixth-duplex functional configuration comprising a sixth-double-function symbol or a superimposed small-circle/large-circle symbol or an "o/0" centered within a common uniform square frame of reference upon at least the upper horizontal surface of a sixth-uniform-double-tier structure, C) four different types of triplex functional playing pieces:

1) a first-triplex functional playing piece comprising a first-triplex functional configuration comprising a first-triple-function symbol or a superimposed straight-cross/diagonal-cross/small-circle symbol or a "+/x/o" centered within a common uniform square frame of reference upon at least the upper horizontal surface of a one-quarter-size uniform-single-tier structure stacked permanently and horizontally in vertical alignment upon a first-uniform-triple-tier structure, 2) a second-triplex functional playing piece comprising a second-triplex functional configuration comprising a second-triple-function symbol or a superimposed straight-cross/small-circle/large-circle symbol or a "+/o/0" centered within a common uniform square frame of reference upon at least the upper horizontal surface of a second-uniform-triple-tier structure, 3) a third-triplex functional playing piece comprising a third-triplex functional configuration comprising a third-triple-function symbol or a superimposed straight-cross/diagonal-cross/large-circle symbol or a "+/x/0" centered within a common uniform square frame of reference upon at least the upper horizontal surface of a third-uniform-triple-tier structure, and 4) a fourth-triplex functional playing piece comprising a fourth-triplex functional configuration comprising a fourth-triple-function symbol or a superimposed diagonal-cross/small-circle/large-circle symbol or an "x/o/0" centered within a common uniform square frame of reference upon at least the upper horizontal surface of a fourth-uniform-triple-tier structure, D) a substitute-objective functional playing piece comprising a substitute-objective functional configuration comprising an objective-function symbol or a superimposed small-straight-cross/small-diagonal-cross symbol or a "(small)+/(small)x" centered within the common uniform square frame of reference upon at least the upper horizontal surface of about a half-size uniform-single-tier structure stacked upon a uniform-triple-tier size structure, and E) a singular-functional playing piece comprising a singular-functional configuration comprising a singular-function symbol or a superimposed small-straight-cross/small-diagonal-cross/eight radial dots symbol or a "(small)+/(small)x/(2x)::" centered within the common uniform square frame of reference upon at least the upper horizontal surface of about a two-and-one-half-size uniform-single-tier structure.

21. The chess-type strategy game of claim 13 wherein:

A) said different types of said simplex-functional configurations comprise three-dimensional inscriptions of different types of said single-function symbols centered within said uniform square frame of reference upon at least the upper horizontal surface of said uniform-single-tier structures, and B) said different types of said duplex-functional configurations comprise three-dimensional inscriptions of different types of said double-function symbols, said double-function symbols comprise two of at least three said different types of three-dimensional inscriptions of said single-function symbols superimposed concentrically and permanently upon each other within a common said uniform square frame of reference, upon at least the upper horizontal surface of said uniform-double-tier structures.

22. A method of play for a generic chess-type strategy game, comprising:

A) providing the following elements:1)

1) a square checkered gameboard playing surface comprising at least a four by four, sixteen square board, 2) two contrasting sets of six pieces, each set comprising:

a) three different types of simplex playing pieces comprising:

(1) a first-simplex playing piece, (2) a second-simplex playing piece, and (3) a third-simplex playing piece, and b) three different types of duplex playing pieces comprising:

(1) a first-duplex playing piece, (2) a second-duplex playing piece, and (3) a third-duplex playing piece, B) placing said simplex playing pieces and said duplex playing pieces upon said gameboard playing surface by any mutually agreed upon procedure, and starting positions, C) alternating turns by both players in alternate sequence moving individual said simplex playing pieces, and individual said duplex playing pieces, and capturing opponent's individual said simplex playing pieces, and individual said duplex playing pieces, moving one piece each turn, D) manipulating said simplex playing pieces, and said duplex playing pieces on said gameboard according to the following rules:

1) moving individual said simplex playing pieces according to the following movement and capturing patterns:

a) moving a first-simplex playing piece according to a pattern 'a'; or orthogonally, b) moving a second-simplex playing piece according to a pattern 'b'; or diagonally, c) moving a third-simplex playing piece according to a pattern 'c'; or one jumping dog-leg or two squares orthogonally, followed by one square orthogonally at right angles to the first direction, and jumping over any intervening pieces, 2) moving individual said duplex playing pieces according to the following movement and capturing patterns:

a) moving a first-duplex playing piece according to alternative patterns 'a' and 'b', b) moving a second-duplex playing piece according to alternative patterns 'a' and 'c', c) moving a third-duplex playing piece according to alternative patterns 'b' and 'c', E) winning the game by:

1) eliminating all of an opponent's playing pieces from the board, and 2) accepting an opponent's resignation.

23. The method of play for a chess-type strategy game of claim 22, and further including:

A) providing the additional elements:

1) additional squares: said gameboard having at least an eight by eight, sixty-four square board, and preferably a ten by ten one hundred square board, 2) additional playing pieces: each set of said two sets of contrasting pieces further including:

a) a second said first-simplex playing piece, b) a second said second-simplex playing piece, and c) a second said third-simplex playing piece, thereby providing three pairs of said simplex playing pieces, and d) a substitute-first duplex playing piece, which is said first-duplex playing piece, plus a tiara, e) an objective playing piece, and f) ten minimal playing pieces, B) placing said pairs of simplex playing pieces, said duplex playing pieces, said objective playing piece, and said minimal playing pieces comprising each set of twenty playing pieces upon said gameboard playing surface, by using the same procedure as for claim 22, and placing each pair of said second-simplex playing pieces upon opposite contrasting squares on the gameboard, C) alternating turns by both players in alternate sequence moving playing pieces and capturing opponent's playing pieces, as in claim 22, D) manipulating said two sets of twenty playing pieces on said gameboard playing surface according to the rules of claim 22, and further including the following additional rules:

1) moving said objective playing piece by a movement and capturing pattern identified as a pattern 'e':

a) moving and capturing by moving alternatively, one square orthogonally, and one square diagonally, b) castling by moving said objective playing piece three squares, either left or right, and moving said first-simplex playing piece to the opposite side of said objective playing piece, c) prohibiting movement of said objective playing piece into a vulnerable position or to any square born upon by an opponent's piece, and d) taking said objective playing piece out of said vulnerable position immediately on the next move, whenever said objective playing piece is placed in a vulnerable position by an opponent's piece, whereby said objective playing piece could be taken on the next move, 2) moving each said minimal playing piece by a movement and capturing pattern identified as a pattern 'f':

a) moving alternatively one and two squares forward, during any turn from any rank on the board, b) moving to capture any opponent's piece located one square diagonally forward, either left or right, c) moving, optionally, to capture any two square move passing pawn, by the en passant rule, at any rank on the board, d) moving any said minimal playing piece to the last rank:

(1) liberating from captivity any selected previously captured playing piece, (2) returning any said selected previously captured playing piece to the board as a liberated piece by exchanging positions with said minimal playing piece, (3) returning the liberating said minimal playing piece to any of the minimal playing piece's starting positions, and E). winning the game by the same criteria as for claim 22, and further including winning by capturing an opponent's objective playing piece.

24. The method of play for a chess-type strategy game of claim 23, and further including:

A) providing the additional elements:

1) additional squares: said gameboard having at least a ten by ten, one hundred square board, and preferably a twelve-by-twelve, one hundred forty-four square board, 2) at least ten additional playing pieces per set: each set of said two sets of at least thirty contrasting playing pieces further including at least:
   a) a pair of a fourth-simplex playing piece,
   b) three additional different types of duplex playing pieces:
      (1) a fourth-duplex playing piece,
      (2) a fifth-duplex playing piece,
      (3) a sixth-duplex playing piece,
   c) four different types of triplex playing pieces, including:
      (1) a first-triplex playing piece,
      (2) a second-triplex playing piece,
      (3) a third-triplex playing piece, and
      (4) a fourth-triplex playing piece,
   d) a singular playing piece, B) setting up said two sets of said at least thirty playing pieces on said gameboard according to the same methods as in claim 23, and C) alternating turns, the same as in claim 23, D) manipulating each of said two sets of said at least thirty playing pieces on said gameboard according to all of the rules of claim 23, and further including: moving and capturing patterns of additional individual pieces:
   1) moving said fourth-simplex playing piece, by a pattern 'd': by alternatively,
      a) moving without capturing by moving one non-jumping dog-leg, or one square orthogonally, followed by one square diagonally, left and right, at forty-five degree angles to the first direction moved, and
      b) moving with capturing by moving to and displacing any opponent's playing piece located any two-linear dog-legs distant or two squares orthogonally, followed by two squares diagonally, at forty-five degrees from first direction moved, to one of eight possible locations describing a large-circle around initial position of said fourth-simplex playing piece, and provided that no playing piece is interposed on the square at one dog-leg,
   2) moving said fourth-duplex piece by said alternative pattern 'a' and 'd',
   3) moving said fifth-duplex piece by said alternative pattern 'b' and 'd',
   4) moving said sixth-duplex piece by said alternative pattern 'c' and 'd',
   5) moving said first-triplex piece by said alternative pattern 'a', 'b' and 'c',
   6) moving said second-triplex piece by said alternative pattern 'a', 'c' and 'd',
   7) moving said third-triplex piece by said alternative pattern 'a', 'b' and 'd',
   8) moving said fourth-triplex piece by said alternative pattern 'b', 'c' and 'd', and
   9) moving said singular playing piece by a pattern 'g', or by alternatively,
      a) moving without capturing by moving alternatively, one square orthogonally and one square diagonally,
      b) moving with capturing by moving alternatively, (a) orthogonally and jumping over one piece of either contrasting set, to the next square occupied by an opposite-contrasting piece, and (b) diagonally, and jumping over one piece of either contrasting set, to the next square occupied by an opposite-contrasting piece,
      c) exchanging positions of said singular playing piece by either of the above maneuvers with any like-contrasting piece, even said objective playing piece, and repeatedly, except whenever said objective playing piece is immediately vulnerable, E) winning the game by the same criteria as in claim 23.

* * * * *